US006346025B1

(12) United States Patent
Tachau et al.

(10) Patent No.: US 6,346,025 B1
(45) Date of Patent: Feb. 12, 2002

(54) METHODS AND SYSTEMS FOR JOINTS USEABLE IN TOYS

(75) Inventors: Jeremy Tachau, Los Angeles; Aldo Spadoni, Rancho Palo Verdes, both of CA (US)

(73) Assignee: Titanium Toys, Inc., Los Angeles, CA (US)

( * ) Notice: Subject to any disclaimer, the term of this patent is extended or adjusted under 35 U.S.C. 154(b) by 0 days.

(21) Appl. No.: 09/336,312

(22) Filed: Jun. 18, 1999

Related U.S. Application Data

(60) Provisional application No. 60/089,969, filed on Jun. 19, 1998.

(51) Int. Cl.[7] ..... A63H 33/00; F16C 11/06

(52) U.S. Cl. ..... 446/71; 446/487; 403/114

(58) Field of Search ..... 446/74, 80, 437, 446/435, 487, 381, 383, 67, 62, 61; 403/114, 115, 122

(56) References Cited

U.S. PATENT DOCUMENTS

| | | | | | |
|---|---|---|---|---|---|
| 1,359,030 | A | * | 11/1920 | Cabana | 446/381 |
| 2,693,372 | A | * | 11/1954 | Ludwig et al. | 403/114 |
| 2,723,571 | A | * | 11/1955 | Koenig | 403/114 X |
| 3,862,513 | A | | 1/1975 | Isaacson et al. | |
| 3,886,682 | A | | 6/1975 | Ieda et al. | |
| 4,219,962 | A | | 9/1980 | Dankman et al. | |
| 4,325,199 | A | | 4/1982 | McEdwards | |
| 4,467,556 | A | | 8/1984 | Iwao et al. | |
| 4,500,299 | A | | 2/1985 | Kelley et al. | |
| 4,668,205 | A | | 5/1987 | Choy et al. | |
| 4,673,374 | A | | 6/1987 | Kelley | |
| 4,674,985 | A | | 6/1987 | Orenstein et al. | |
| 4,696,653 | A | | 9/1987 | McKeefery | |
| 4,736,943 | A | | 4/1988 | Fukuda et al. | |
| 4,809,335 | A | | 2/1989 | Rumsey | |
| 4,863,412 | A | * | 9/1989 | Milhalinec | 446/66 |
| 4,917,645 | A | | 4/1990 | Amici et al. | |
| 4,993,983 | A | | 2/1991 | Kurita et al. | |
| 4,995,846 | A | | 2/1991 | Mariol | |
| 5,019,007 | A | * | 5/1991 | Miller | 446/62 |
| 5,029,214 | A | | 7/1991 | Hollander | |
| 5,045,016 | A | | 9/1991 | Stern et al. | |
| 5,073,140 | A | | 12/1991 | Lebensfeld et al. | |
| 5,120,065 | A | | 6/1992 | Driscoll et al. | |
| 5,125,866 | A | | 6/1992 | Arad et al. | |
| 5,147,237 | A | | 9/1992 | Kwan et al. | |
| 5,267,318 | A | | 11/1993 | Severson et al. | |
| 5,304,090 | A | | 4/1994 | Vanni | |
| 5,318,471 | A | | 6/1994 | Glovier | |
| 5,360,364 | A | | 11/1994 | Poulsen et al. | |
| 5,372,511 | A | | 12/1994 | Cheung | |
| 5,383,805 | A | * | 1/1995 | Tsai | 446/66 |
| 5,510,812 | A | | 4/1996 | O'Mara et al. | |
| 5,594,976 | A | | 1/1997 | Shkolnick et al. | |
| 5,621,207 | A | | 4/1997 | O'Mara | |
| 5,630,745 | A | | 5/1997 | Yeh | |
| 5,637,996 | A | | 6/1997 | McDarren et al. | |
| 5,643,041 | A | * | 7/1997 | Mukaida | 446/487 |
| 5,644,204 | A | | 7/1997 | Nagle | |
| 5,651,716 | A | | 7/1997 | Mowrer et al. | |
| 5,681,170 | A | | 10/1997 | Rieber et al. | |
| 5,728,963 | A | | 3/1998 | Reintjes | |
| 5,741,185 | A | | 4/1998 | Kwan et al. | |
| 5,752,880 | A | | 5/1998 | Gabai et al. | |
| 5,810,638 | A | | 9/1998 | Wood | |
| 6,234,703 | B1 | * | 5/2001 | Bieg et al. | 403/115 |

* cited by examiner

*Primary Examiner*—D. Neal Muir
(74) *Attorney, Agent, or Firm*—Knobbe, Martens, Olson & Bear, LLP

(57) ABSTRACT

The present invention provides methods and systems for toy joints. A first toy portion is rotatably and pivotally coupled to a toy body. A second toy portion is also rotatably positioned about the toy body, so that the second toy portion can be rotated at least partly about the toy body. A third toy portion is rotatably positioned about the toy body so that the third toy portion can be rotated to a position opposite the second toy portion.

4 Claims, 44 Drawing Sheets

METHODS AND SYSTEMS FOR JOINTS USEABLE IN TOYS

The present application claims priority from U.S. Provisional Patent Application No. 60/089,969 filed on Jun. 19, 1998. The contents of that application, in its entirety, is hereby incorporated by reference.

FIELD OF THE INVENTION

The present invention is related to methods and systems for toys, and in particular to methods and systems for joints useable in toys.

DESCRIPTION OF THE RELATED ART

Great efforts have been expended on making toys more fun and more stimulating. Typically, toys are either "reproductions" of real objects, such as jets, cars, and dolls, or are imagined-type objects, such as aliens, space ships, and the like. To make these toys more interesting to children, additional features have been added to toys to make them seem more active and real. For example, toys, such as dolls, have been equipped with devices for reproducing prerecorded or predetermined crying sounds. However, prior art toys still provide inadequate simulation of the reproduced object.

One disadvantage of conventional toy sound generation systems is that they simply play back a limited set of prerecorded sounds. Thus, for example, a toy doll may only be capable of reproducing a crying sound "waa," a cooing sound "ooh," and a the sound "mama" as well as a limited vocabulary of like sounds. Each sound is typically reproduced in response to a corresponding single type of stimuli. For example, the doll may play back a cooing sound in response to placing a bottle in the doll's mouth. Similarly, the doll may play back a laughing sound in response to being picked up. Thus, prior art toys are disadvantageously limited to reproducing a limited prerecorded or predetermined vocabulary of sounds in response to a corresponding single stimulus. This limitation greatly reduces toy realism, thus reducing the toy "fun factor."

More sophisticated conventional toys generate realistic sounds in response to commands issued by a remote control unit. Thus, in a remote control toy car of this type, when a remote control commands the engine to accelerate, these commands or related internal motor control lines are monitored by sound generation equipment and a peelout sound is generated. However, toys of this type require motors which receive remote control commands in order for realistic sound generation to be accomplished. These motorized toys are disadvantageously expensive and are not suitable for younger children or for non-motorized, non-remote control applications.

Furthermore, those prior art toys that emit a sound in response to the movement of the toy or pressure on the toy typically incorporate very simple sensors that provide limited information. These sensors are often merely electrical contacts that close in response to pressure on one contact. The prior art toys lacked sensors which would impart information which could be used to deduce the acceleration or velocity of movement of a portion of a toy, such as the motion of a canon on a tank or the motion of the arm of a doll or action figure. Furthermore, the sensors used in prior art toys typically fail to impart information on the three dimensional, X,Y,Z motion of the toy or of a portion of the toy.

Another disadvantage of prior art toys, such as toy action figures, is their limited modularity. Thus, if an action figure includes electronic circuits for detecting pressure on the action figure or for producing audio signals, those electronics cannot be reused in another action figure. Thus, if a child has ten electronic action figures then the toy purchaser must wastefully pay for ten sets of electronics included in the corresponding action figures.

In addition, many prior art toys that include movable elements use joints that allow only limited ranges of motion.

SUMMARY OF THE PREFERRED EMBODIMENTS

The present invention provides systems and methods for novel joints which may be used in toys, such as, by way of example, a toy tank, or a toy plane. In one embodiment, a joint is used to rotatably couple two wings to a fuselage of a toy plane so that each wing can be independently rotated at least part way around the fuselage. One embodiment of the joint includes a first substantially cylindrically shaped assembly rotatably positioned about the fuselage. A first wing is coupled to the first cylindrically shaped assembly, and a second cylindrically shaped assembly is rotatably positioned about the fuselage adjacent to the first cylinder. A second wing is coupled to the second cylindrically shaped assembly such that the first wing and the second wing can be rotated to be on opposing sides of the fuselage.

In another embodiment, a first toy portion is rotatably and pivotally coupled to a toy body. A second toy portion is also rotatably positioned about the toy body, so that the second toy portion can be rotated at least partly about the toy body. A third toy portion is rotatably positioned about the toy body so that the third toy portion can be rotated to a position opposite the second toy portion.

In yet another embodiment, a toy includes a first toy portion and a ball joint assembly, including a ball assembly and a socket assembly. The ball assembly is rotatatable and pivotable relative to the socket assembly. The socket assembly is coupled to the first toy portion. A shaft extends from the ball, and a second toy portion is coupled to the shaft so that the second toy portion can be pivoted and rotated relative to the first toy portion.

In still another embodiment, a joint is used to movably couple a first toy portion to a second toy portion. By way of example, the joint may include a housing coupleable to the first toy portion. A ball may be rotatably positioned in the housing, with a first yoke rotatably positioned about the ball. The first yoke may contain a slot, where the slot may be one of a variety of shapes, such as an oval, a round, or rectangular shape. A second yoke is rotatably positioned about the ball, the second yoke defining a second slot. A shaft coupleable to the second toy portion extends from at least one side of the ball through the first slot and the second slot, wherein the first yoke and the second yoke rotate at least partially about the ball when the shaft is moved in a first direction.

DETAILED DESCRIPTION OF THE PREFERRED EMBODIMENT

Figure 1A:
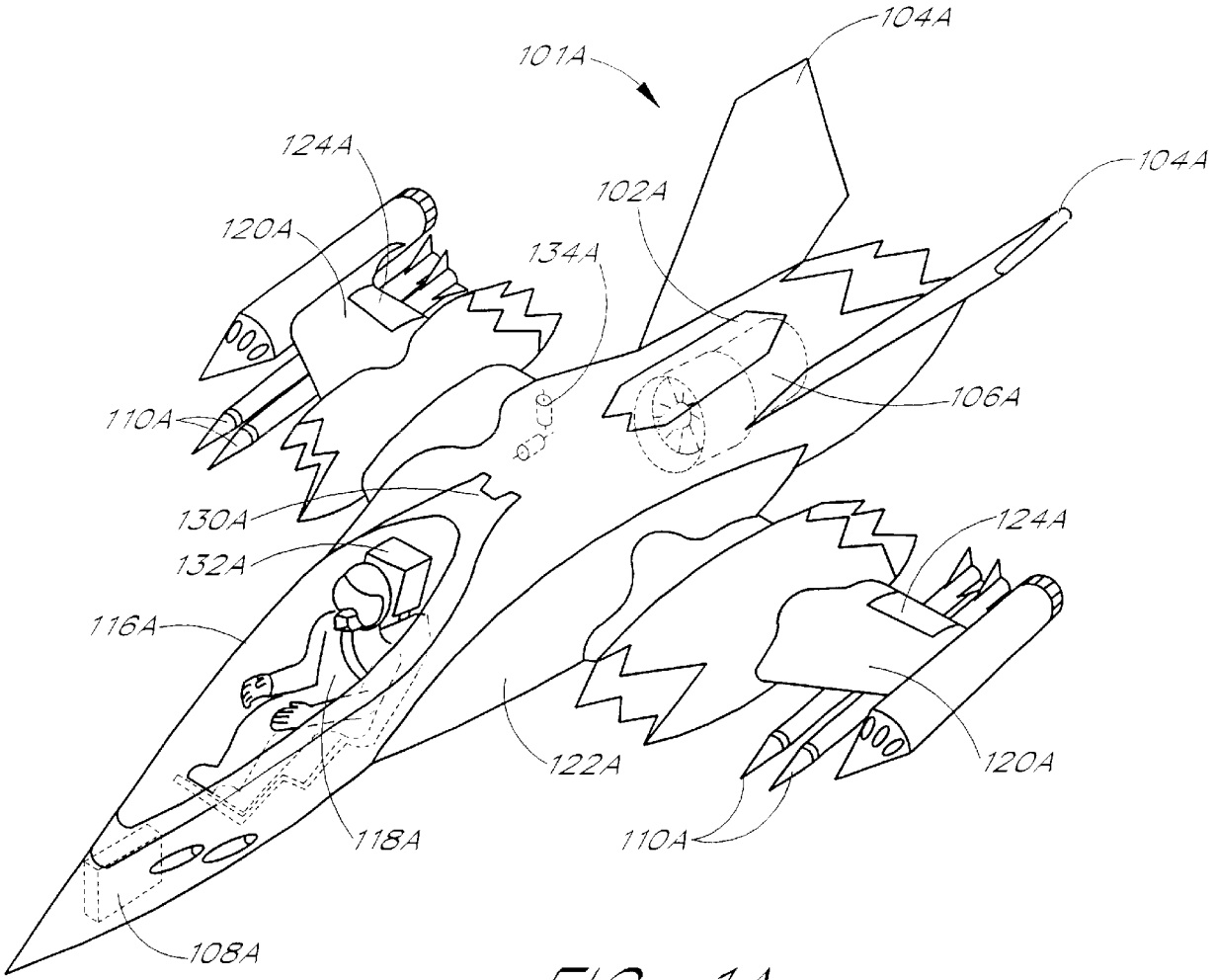
FIGS. 1A–1E illustrate several embodiments of the present invention.

The present invention provides methods and systems for an interactive toy. The toy provides for an immersive play experience for children, thus heightening their playing enjoyment. FIG. 1A illustrates one embodiment of an interactive toy 100A. In the illustrated embodiment, the toy 100A has the appearance of flying vehicle. As discussed below, in other embodiments, the toy has the appearance of a space vehicle, a land vehicle, a sea vehicle, or a combination of two or more types of vehicles. In addition, in still other embodiments, the toy has the appearance of a person, alien, plant or the like. Furthermore, in other embodiments, the toy has the appearance of a structure, such as, by way of example, one or more buildings, walls, drilling platforms and the like. Thus, as will be understood by one of ordinary skill in the art, the present invention is not restricted to any one type of toy, but may be used in a wide variety of toy types. The toy may also be an educational tool.

Figure 1B:
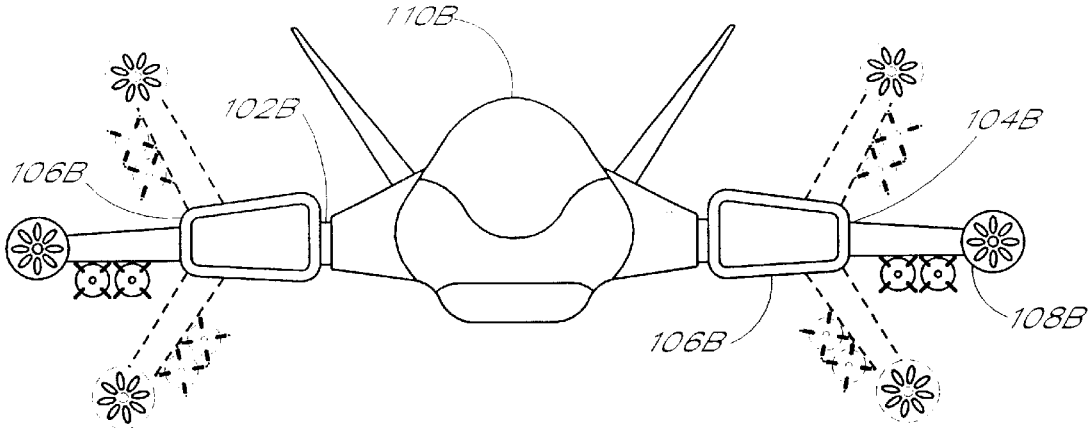
Figure 1C:
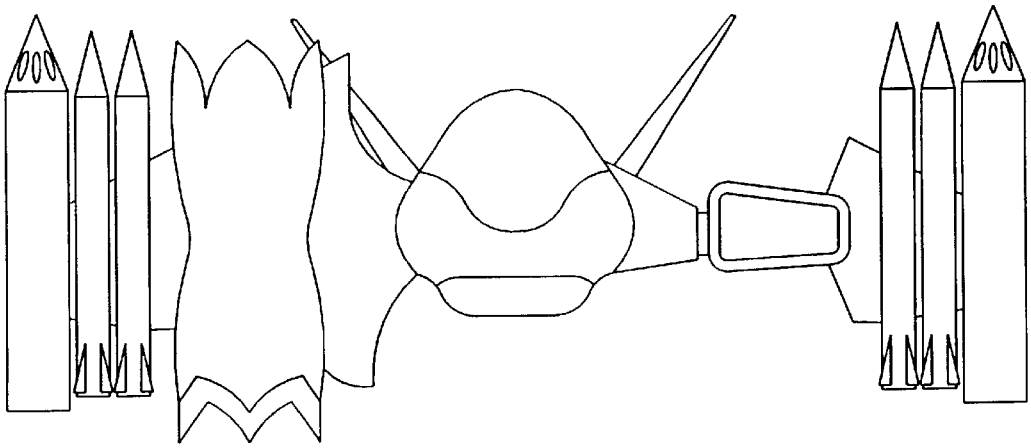
Figure 1D:
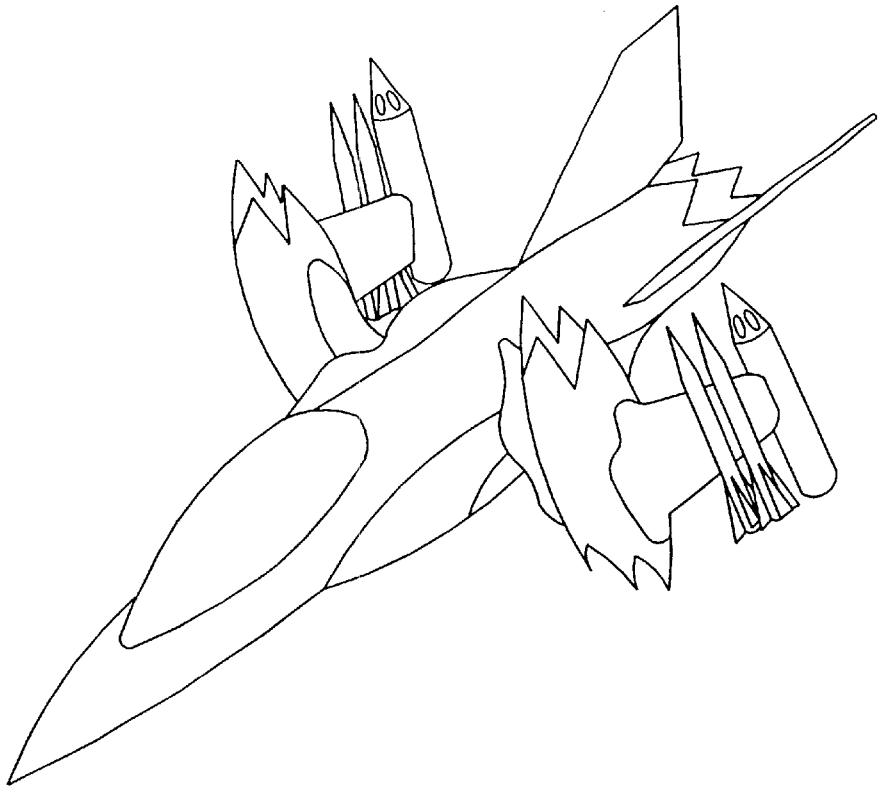
Figure 1E:
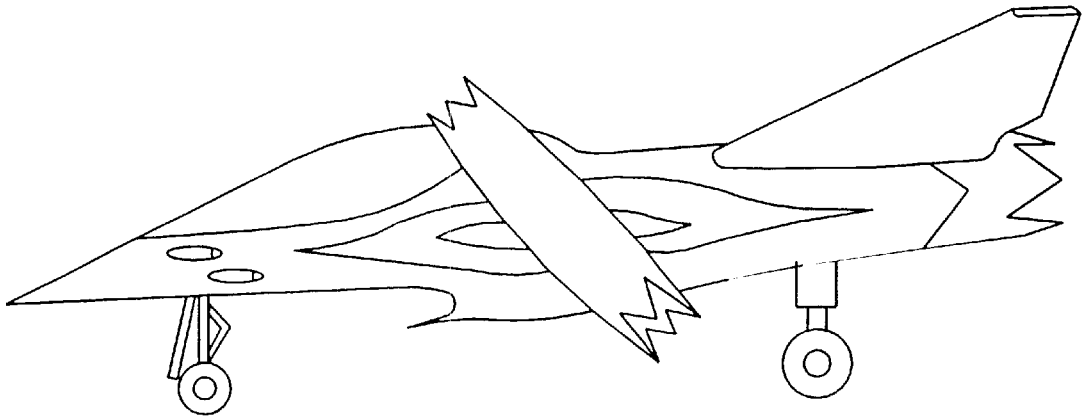

Referring back to FIG. 1A, the toy is a fighter jet. In one embodiment, the toy includes one or more movable portions. Thus, by way of example, the jet includes movable wings 120A attached to a fuselage 122A. The wings may rotate around one or more axes, as illustrated in FIGS. 1A–1E. Thus, in one embodiment, the wings rotate around a first axis that is parallel to the jet length in a swing wing configuration. Furthermore, as illustrated in FIG. 1D, the wings may optionally rotate around a second axis parallel to the plane width to simulate a vertical take off and landing (VTOL) aircraft. As illustrated in FIG. 1B, the wings may have both a primary rotation joint 102B where a wing 106B meets the fuselage and a second rotation joint 104B which joins two portions of the wing 106B, 108B. In addition, the illustrated aircraft optionally includes a speed brake portion 102A. The speed brake 102A can be raised to simulate an actual speed brake as is commonly used on fighter jets, such as an F-15 or the like. Furthermore, the illustrated toy 100A optionally includes control surfaces, such as rotatable tail fins 104A, and a removable jet engine module 106A optionally equipped with control surfaces, such as tiltable vanes (not shown). To further enhance the playing experience, the toy 100A a removable nose cover (radome) 108A concealing a radar, and removable armaments 110A, including toy bombs and missiles. As illustrated in FIG. 1E, the jet further includes retractable landing gear 102E. In another embodiment, the wings include movable control surfaces, such as, by way of example, wing flaps 124A. The nose of the toy 100A may optionally be tiltable or rotatable.

As illustrated in FIG. 1A, in one embodiment, the toy 100A includes a cockpit 116A with a substantially clear canopy 114A. The canopy 114A may be configured to open by partly rotating the canopy around a joint 130A at the rear of the canopy or the canopy may be completely removed. A toy FIG. 118A, such as a pilot, may be removably inserted into the cockpit 116A. In one embodiment, the cockpit 116A is configured to receive a standard sized 3.5 inch toy figure. In another embodiment, the jet 100A is equipped with an ejector seat 132A. In one embodiment, the ejector seat is spring loaded, and is activated by pushing a button (not shown). In still another embodiment, the ejector seat activation is under computer control. Thus, in one embodiment, the toy has the appearance of a high performance, fully articulated, fully equipped fighter jet.

As described below, one or more of the movable toy portions are optionally motorized under computer control. Furthermore, in one embodiment, the bombs 110A may be dropped and the missiles 110A "launched" via computer control or by pressing on a button (not shown) which physically unlatches the bomb or missile. In another embodiment, the user may activate a switch, which is read by a processor, which in turn releases the bomb or missile. In one embodiment, the switch is a contact switch. In another embodiment, the switch is a capacitive switch. One or more sensors, such as contact switches, are used to detect the presence of the bomb or missile or other ordinance.

In one embodiment, one or more of the movable portions are coupled to one or more corresponding sensors. The sensor provides a signal related to the movement of the corresponding movable portion. The sensors may provide either or both discrete indications of movement or continuous indications of movement. Thus, as illustrated in FIG. 1A, the wing is coupled to a two-axis sensor 134A that provides one or more signals related to the rotation of the wing 120A around both the first and second axes. In the illustrated embodiment a two-axis potentiometer 134A is used as the sensor which provides continuous rotation information for two axes of movement. However, other types of sensors may be used as well. By way of example, microswitches may be used discretely indicate if the wings 120A are in a fully rotated position. In the illustrated embodiment, the two-axis potentiometer 134A has an input coupled to a voltage source (not shown) and an output that provides a voltage related to a position of the movable portion. As discussed below, information provided by the sensors may be used to derive information regarding velocity, acceleration, position, angular motion, as well as other motion information.

Figure 2:
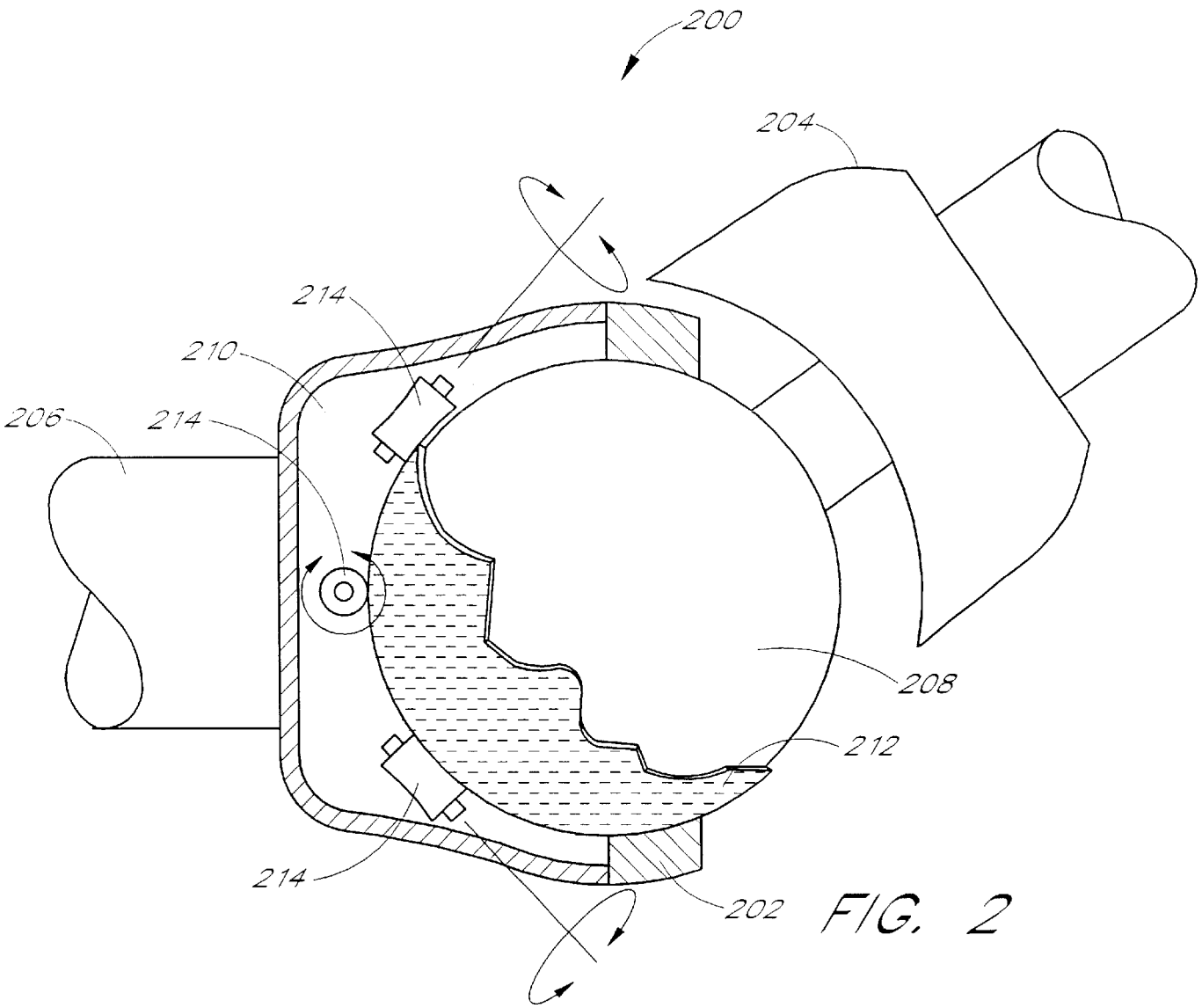
FIG. 2 illustrates a joint having multiple sensors

In one embodiment, two toy portions or subassemblies are movably coupled together by a joint or link. By way of example, as illustrated in FIGS. 2 and 4, a ball/socket joint is used in one embodiment. As illustrated in FIG. 5, in another embodiment, a hinged joint is used. In yet another embodiment, a combination ball/hinge joint is used. In still another embodiment, a slide joint is used. A variety of other types of coupling mechanisms may be used as well, though each coupling type may have unique advantages and disadvantages.

Figure 19A:
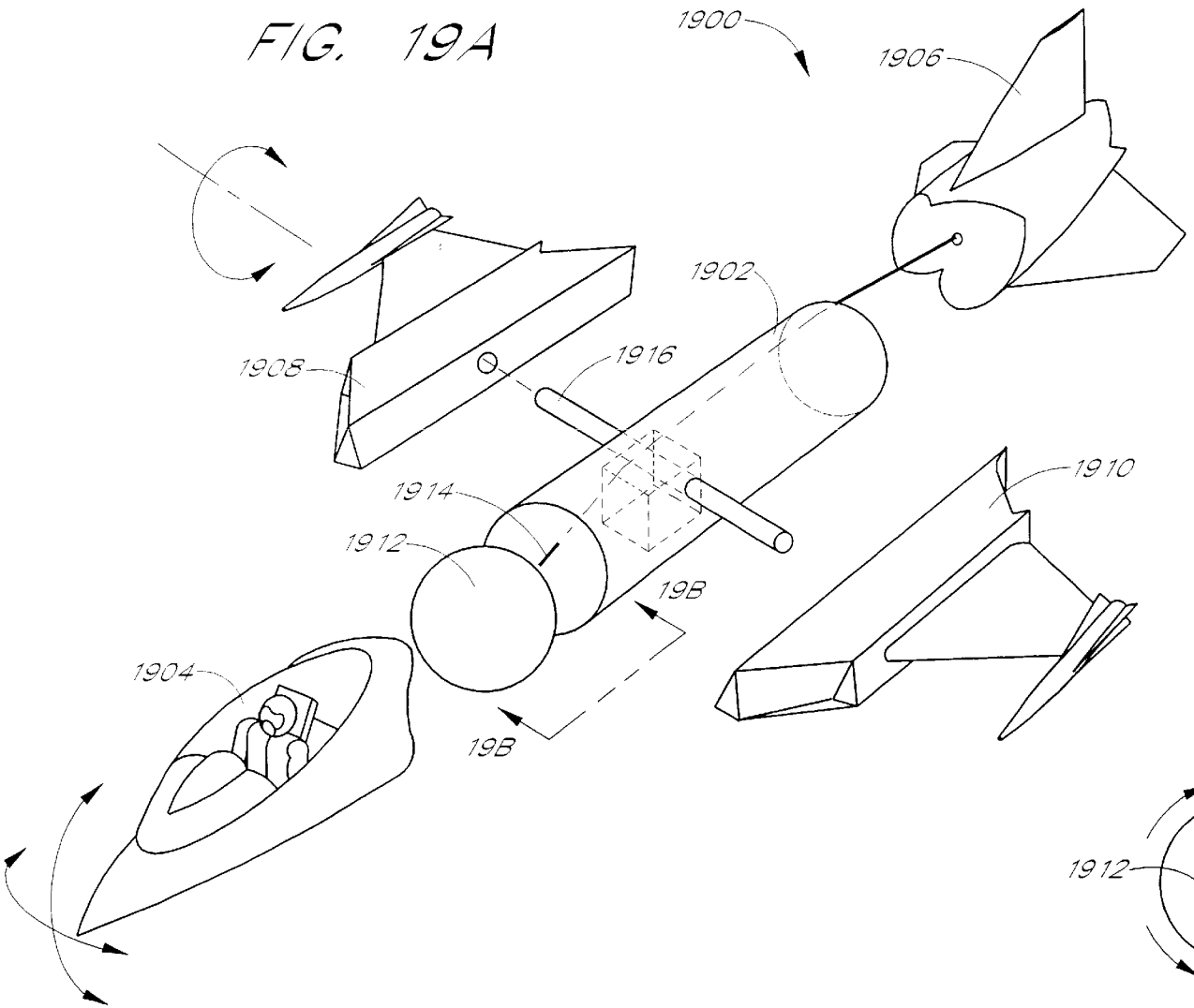
FIG. 19 illustrates one technique for joining toy components.
Figure 19B:
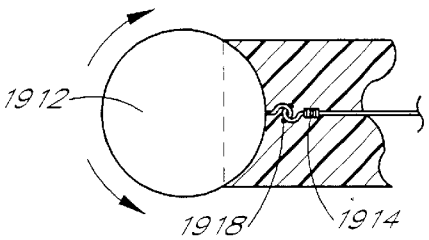

For example, FIGS. 19A–19B illustrate another method of movably coupling toy components together to form a toy 1900. An elastic band 1914 is run through a fuselage 1902. One end of the band 1914 is coupled to a first toy component, such as a ball 1912, while a second end of the band 1914 is coupled to a second toy component, such as a tail assembly 1906. The band may be coupled to the toy components via a hook 1918, as illustrated in FIG. 19B. The force exerted by the band pulls the ball 1912 and the tail 1906 tightly against respective fuselage openings, while still allowing the ball 1912 and the tail 1906 to rotate relative to each other and the fuselage 1902. A cockpit assembly 1904 may then be coupled to the ball 1912, using, by way of example, a compression, pinch or a friction fitting. Other toy components, such as wings 1908, 1910, may be rotatably attached to the fuselage by rotatably coupling them to an axle 1902.

FIG. 2 illustrates one embodiment of a ball/socket joint assembly 200. In one embodiment, the joint assembly 200 includes a socket assembly 206 and a ball assembly 204, which form a ball/socket input joint. The ball/socket input joint is used to form one or more mechanical and electrical interfaces between two portions or subassemblies of the toy, such as a wing and the fuselage. The ball/socket assembly 200 can be configured to provide one, two, or three axes of rotational freedom, as desired. Furthermore, the ball/socket assembly 200 can be configured to provide a predetermined angular travel. In the exemplary embodiment, three degrees of motion are provided. A ball portion 208 of the ball assembly 204 is seated in a socket portion 210 of the socket assembly 206. A retaining ring 202 is used to prevent the ball portion 208 from inadvertently popping out of the socket potion 210.

In the illustrated exemplary embodiment, a three-axis sensor 214 is used to detect motion in all three axes. For example, the three-axis sensor 214 provides information used to determine the rotation angle of the ball 208 with respect to the socket 210. Such movement may be a result of physical force applied by a user. In one embodiment, the three-axis sensor 214 includes three rotating roller drive devices. The axes of the rotating devices are oriented orthogonally with respect to each other, such that information relating to three degrees of rotational motion is provided. In one embodiment, the rotating devices include sealed conductive plastic potentiometers or the like, which convert rotation inputs into analog electrical signals. Rotation of the ball 208 relative to the socket 210 causes one or more of the rotating devices to rotate. As the rotating device rotates, a rotating device output voltage correspondingly varies, providing an indication of the relative motion of the ball assembly 204. As described below, the voltage output is coupled to a processor circuit for processing.

In another embodiment, the ball portion 208 of the ball joint is treated with a force-sensitive film, such as a piezo electric film sensor 212. The film outputs a voltage that is related to the pressure exerted on the film. By way of example, in one embodiment, the film is applied to a ball/socket joint coupling the landing gear to the jet fuselage. When a child "lands" the jet with the landing gear down, pressure is exerted on the film. The film sensor in turn outputs an electrical signal related to the pressure along one or more axes of the joint. In one embodiment, the toy may also include a heat sensor which may be used to detect if a user is holding the toy.

Figure 23A:
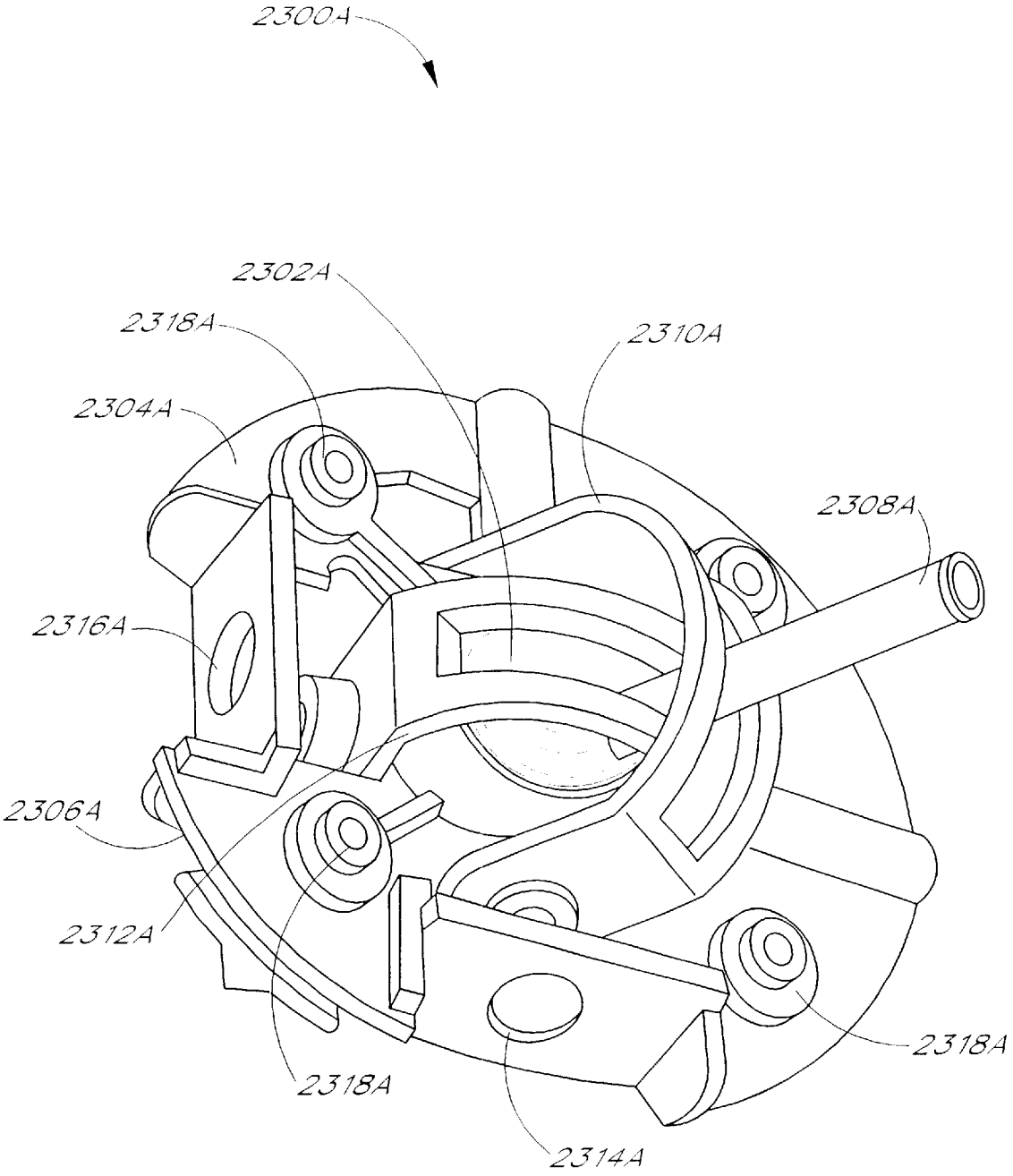
FIGS. 23A–23C illustrate another embodiment of a joint for joining toy components.
Figure 23B:
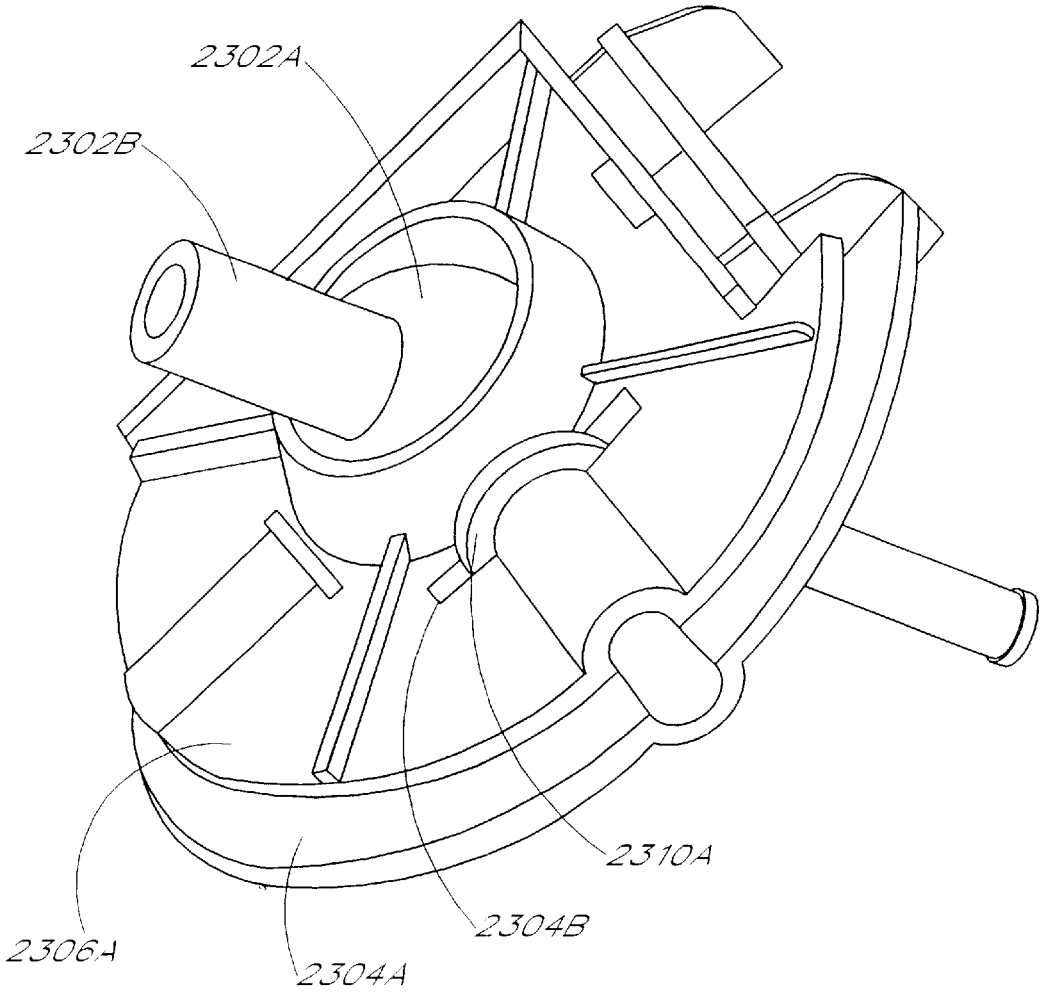
Figure 23C:
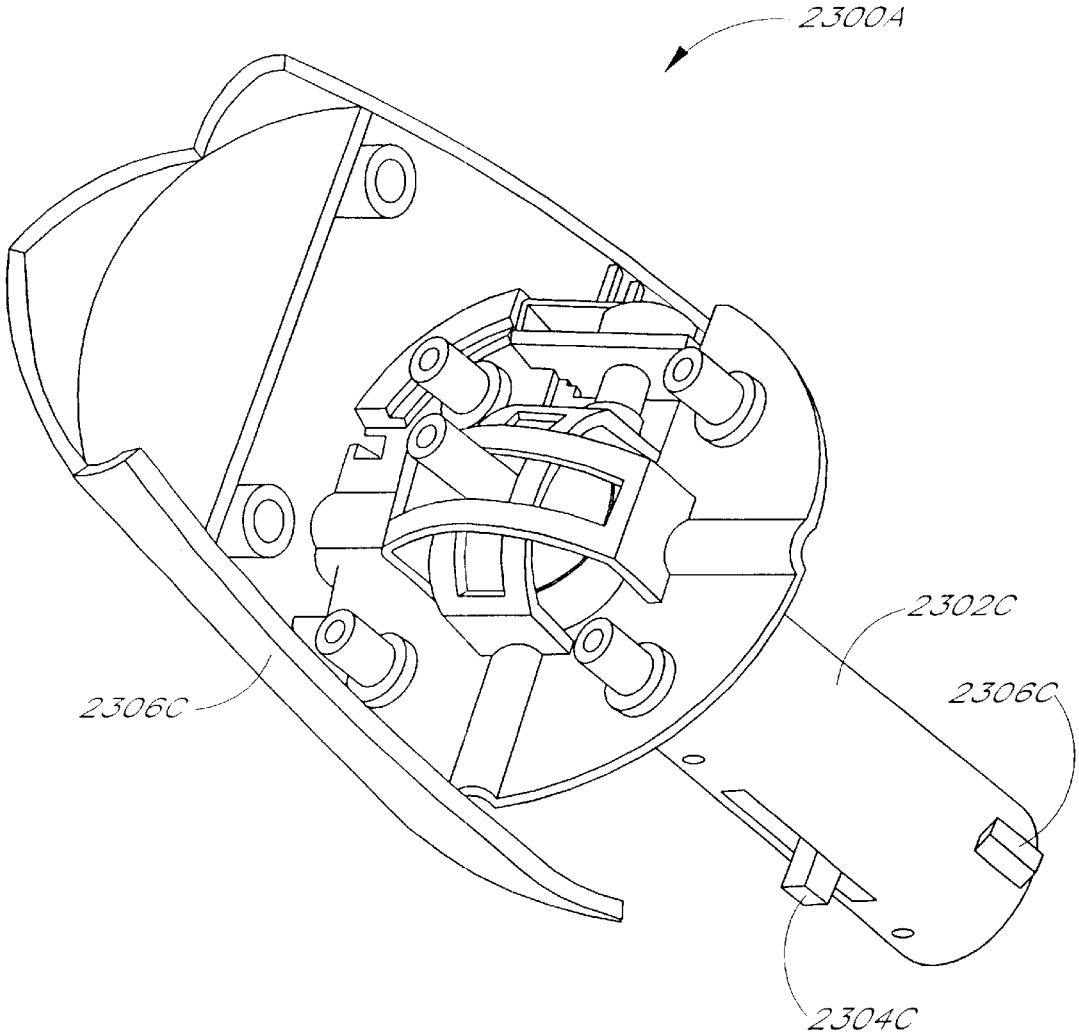

FIGS. 23A–23C illustrate another embodiment of a ball joint. A ball portion is rotatably seated in a housing. The housing includes two clamshell halves. Springs are used to hold the two halves together so as to put an elastic pressure on the ball. Thus, while the ball can rotate, the springs cause the housing to put sufficient pressure on the ball so that a user must exert a given amount of force to cause the ball to rotate. Other techniques may be used to provide the required pressure. For example, the two clamshell halves may be coupled using plastic tabs under compression. A shaft or rod protrudes from the ball and is positioned so as to extend from one side of the ball though a slot in a first axis yoke and through a slot in a second axis yoke. In one embodiment, the two yokes are orthogonally positioned. In another embodiment, the yokes may be positioned so as to define an acute angle or an obtuse angle. The yoke slots may have a variety of shapes and sizes. The shaft may be moved along the slot of each yoke. Each yoke, in turn, is pivotably coupled, either directly or through a gear mechanism, to a motion transducer, such as a rotational potentiometer. Thus, when the shaft is moved at an angle, both yokes will rotate as well. The two transducers provide varying signals as the activation rod and the yokes are correspondingly moved. As described below, the signals may be coupled to a processor circuit for processing.

The shaft may be coupled to a movable toy portion, such as a fuselage, wing, arm, wheel, gun, missile launcher or the like. Similarly, the ball assembly may be coupled to another toy portion, such as a tail assembly. The pressure on the ball maintains the position of the toy portion once the user stops rotating the portion. The shaft may optionally be coupled to a third rotational potentiometer, or similar transducer, mounted in the toy portion providing movement information in a third axis. Thus, as the toy portion, such as an aircraft tail assembly, is rotated, the potentiometer is likewise rotated relative to the shaft and thus provides a varying signal corresponding to the rotation in the third axis.

The shaft may be surrounded by one or more prongs which fit through a fuselage pinch piece. Movement of the tail assembly relative to the fuselage causes the shaft and or yokes to correspondingly move, thereby rotating corresponding potentiometers. Each potentiometer varies its output voltage. The processor derives movement and rotation information from the output voltages. In another embodiment, one end of the shaft may be coupled to another transducer, such as a linear potentiometer, mounted in a toy portion. Thus, for example, coupling the fuselage-end of the shaft to a linear potentiometer allows the tail to be pulled away from the fuselage for easier manipulation about various axes. The potentiometer provides a signal indicating the position and movement of the tail as it is being pulled out. This indication is then provided to the processor.

Figure 20:
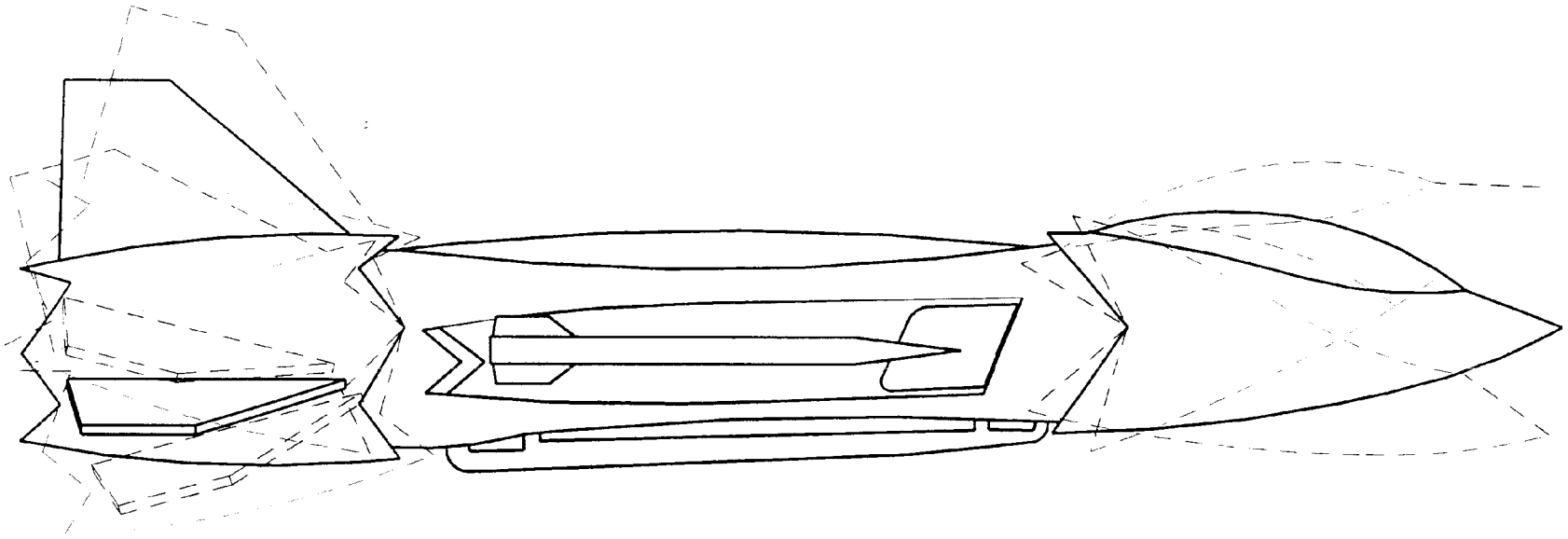
FIG. 20 illustrates the movement of toy portions of one embodiment of the present invention.

FIG. 20 illustrates some of the possible degrees of motion obtainable using the described joints. The tail assembly can be pivoted relative to the fuselage's central axis, rotated about the tail assembly's central axis, and pulled away from or pushed towards the fuselage.

Figure 22:
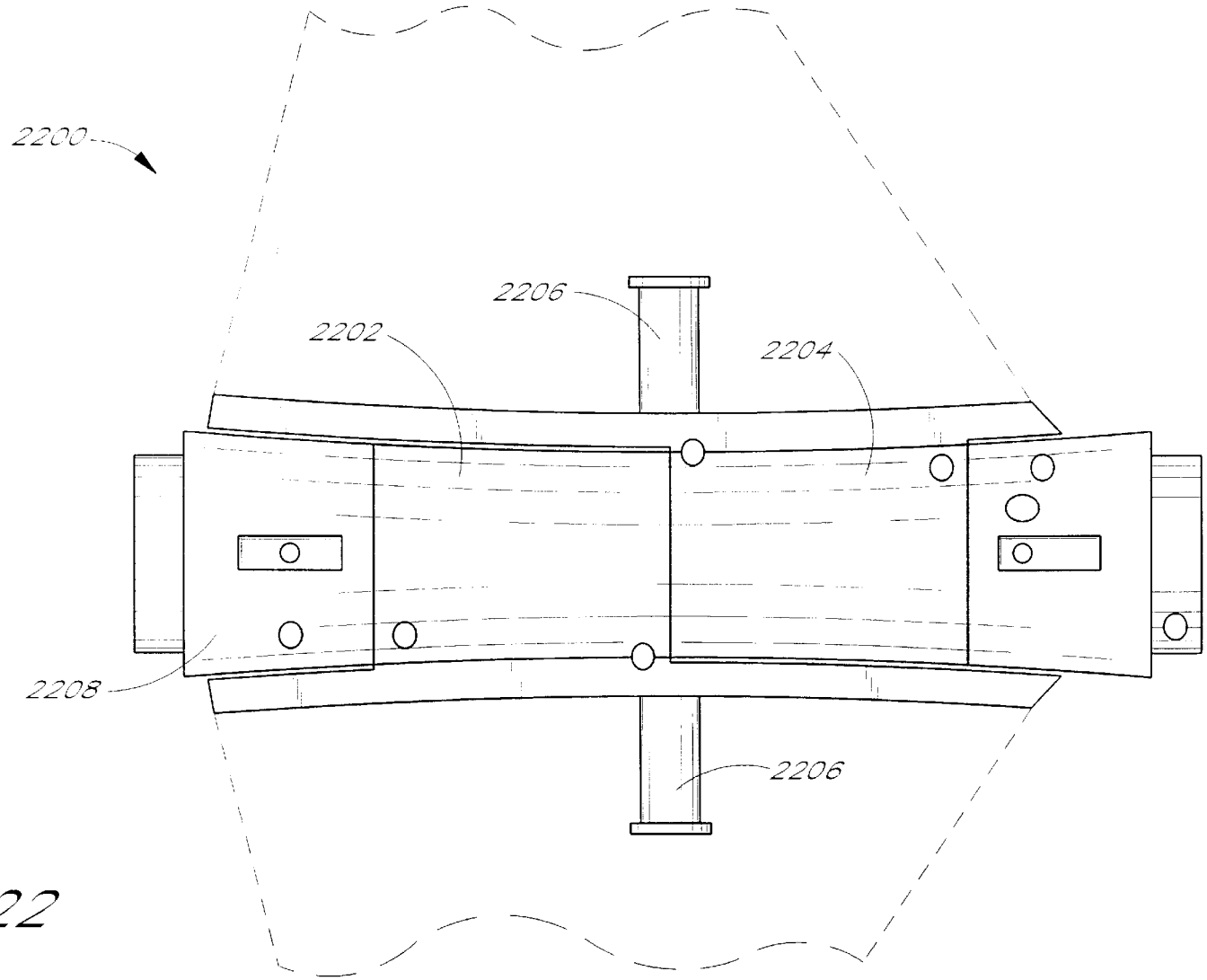
FIG. 22 illustrates another embodiment of a joint for joining toy components.
Figure 25:
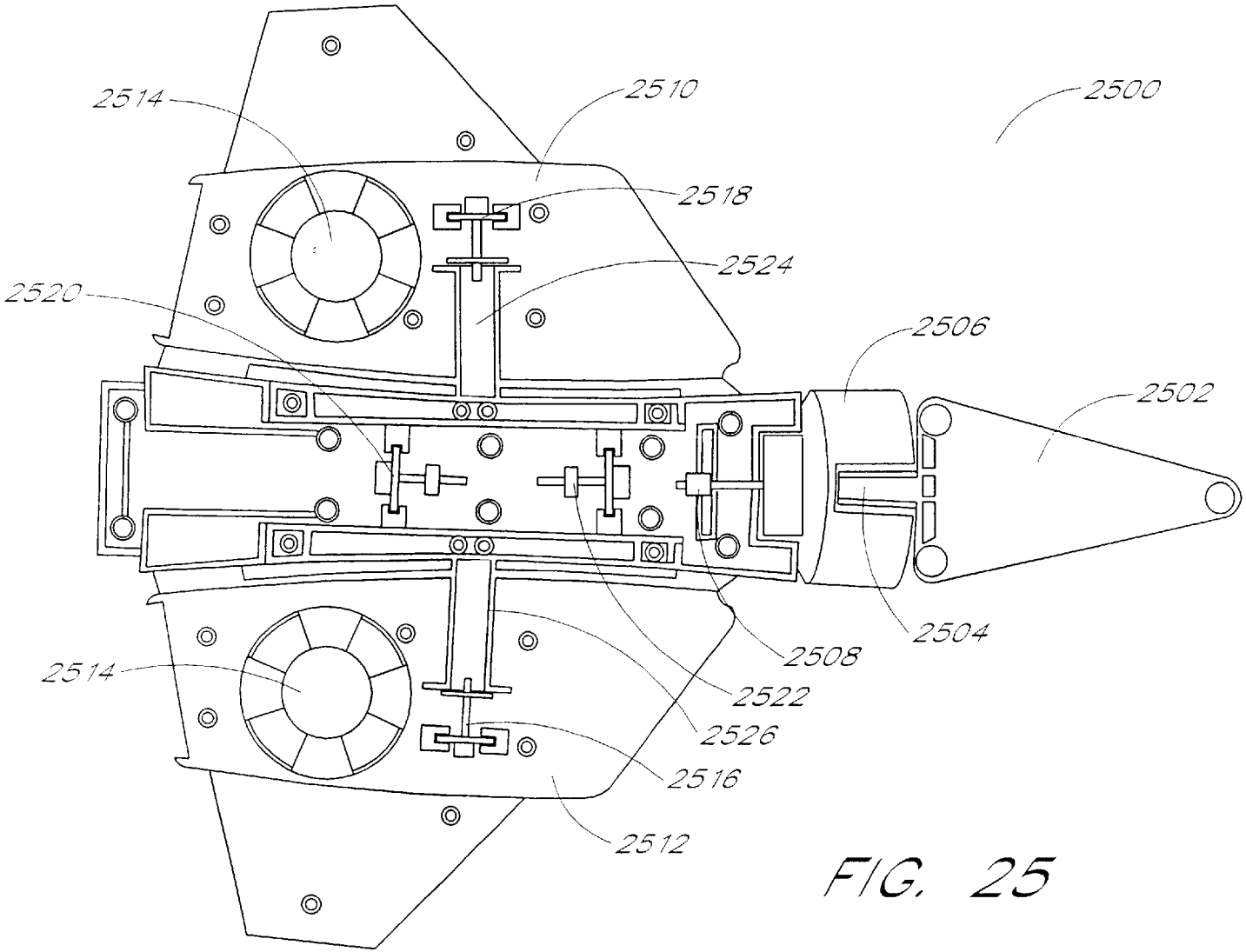
FIG. 25 illustrates the internal construction of one embodiment of the present invention.
Figure 26:
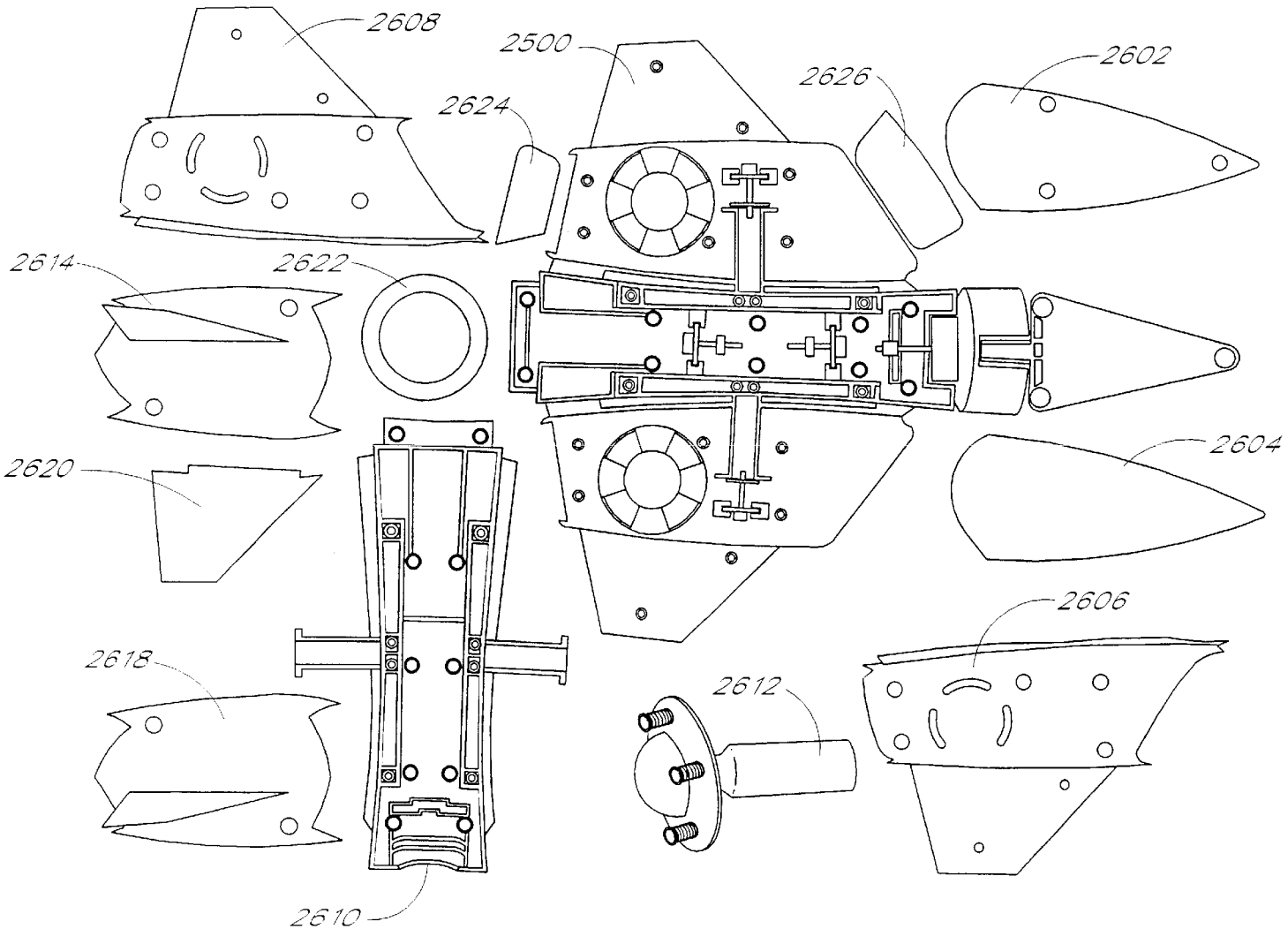
FIG. 26 illustrates the components of one embodiment of the present invention.

FIGS. 22, 25 and 26 illustrate one technique for mounting toy portions, such as two wings, so that they may be independently rotated around a common axis of a second toy portion, such as a fuselage. Advantageously, the wings can still be positioned on opposite sides of the fuselage in the same plane. As illustrated in FIG. 22, in the exemplary joint 2200, a fuselage 2208 acts as a hinge pin about which are positioned two wing mounting assemblies 2202, 2204 which act as cylindrical bearing surfaces or hinge knuckles. Each mounting assembly 2202, 2204 is composed of a top half and a bottom half. During assembly, the fuselage 2208 is first positioned in the bottom half of each mounting assembly 2202, 2204 and then the top half of each mounting assembly 2202, 2204 is mounted to the corresponding bottom half. Thus, a portion of each mounting assembly forms a rotatable cylinder about the fuselage 2208. This technique advantageously does not utilize substantial portions of the internal space of the fuselage 2208. Thus, the internal fuselage space may be used for mounting electronics, sensors, batteries or the like, rather than for wing joints. In addition, each mounting assembly 2202, 2204 optionally has a shaft 2206 extending outward on which a corresponding wing is rotatably positioned. In the illustrated embodiment, each shaft 2206 is positioned in line with the interface 2210 between the two mounting assemblies 2202, 2204. Thus, the wings can be rotated so as to be oppositely positioned on either side of the fuselage 2208. In an alternative embodiment, the wing and corresponding mounting assembly can be manufactured as one assembly.

In one embodiment, sensors are coupled to the mounting assemblies and wings as follows. A slot is cut or formed through the fuselage where each mounting assembly is to be positioned. The slots are oriented perpendicular to the axis of rotation for the mounting assemblies. A wheel, gear, post or other mechanical interface structure coupled to a fuselage-mounted potentiometer is positioned to protrude through each slot so as to be in pressure or frictional contact with the corresponding mounting portion. Alternatively, the wheel, gear or post may mesh with a track, gear, or slot on the wing. Thus, as the wing and associated mounting assembly are rotated, the corresponding wheel, gear, or post is likewise rotated. The corresponding potentiometer provides a signal to the processor indicating the position and movement of the wing as it is rotated about the fuselage. The slot can also be used to limit the rotation of the wing around the fuselage. For example, if the slot extends 180 degrees around the fuselage, then the mechanical interface structure will strike either end of the slot as the wing is rotated, halting further rotation.

Additional sensors can be used to provide information relating to the rotation of the wings about the posts. For example, potentiometers may be mounted in each wing. In one embodiment, the potentiometer shaft is coupled to the post, while the potentiometer body is mounted in the wing. As the wing is rotated about the post the potentiometer body rotates about the potentiometer shaft. The wing-mounted potentiometer provides a signal to the processor indicating the position and the movement of the wing as it is rotated about the shaft.

In another embodiment, motion and position information is provided using light sensors. The light sensor includes a light emitting portion, such as an LED, and a light receiving portion, such as a photodetector. The light emitting portion illuminates a pattern, such as a bar code or a pattern of dots, printed on the ball assembly. The pattern may be coded so as to provide both position and motion information. The light is reflected off the pattern with varying intensitics as thc ball joint is rotated. The photodetector receives the reflected light and translates the intensity into an electrical signal which is provided to the processor.

Figure 27:
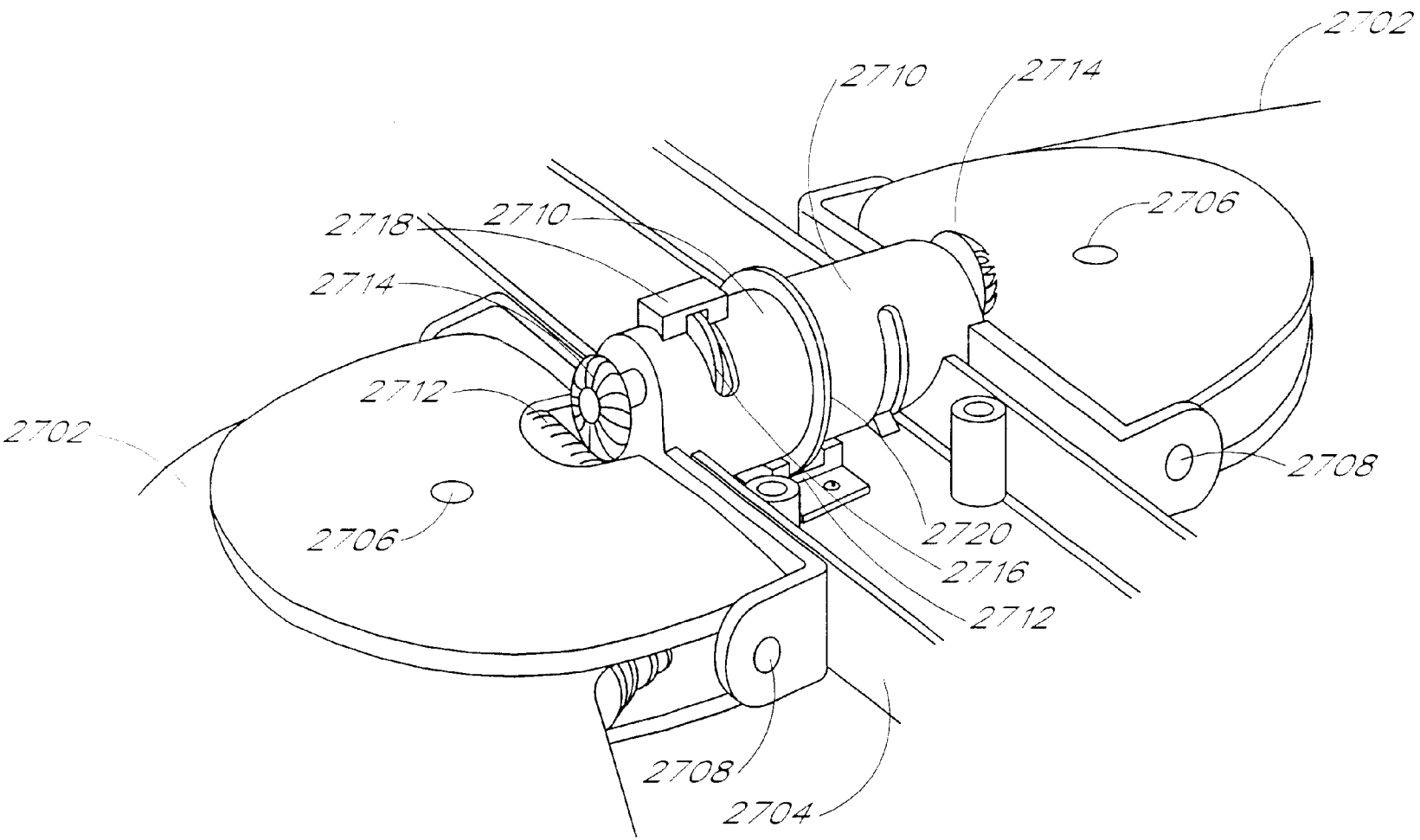
FIG. 27 illustrates one technique for sensing movement.

FIG. 27 illustrates one embodiment 2700 of a coupling/optical sensing system. Toy portions, such as wings 2702, are independently pivotally coupled in two dimensions to a second toy portion, such as a fuselage assembly 2704. Thus, a first set of pivot points 2706 are used to couple the wings 2702 to that they may be swept back or swung forward around a first axis. A second set of pivot points 2708 is used to couple the wings 2702 so that they may be rotated or "flapped" in a second axis. A third set of pivot points 2710 permit the wings to "roll" so that the wings may be rotated so that their leading edges point forward or upward. Teeth 2712 on a portion of each wing 2702 are respectively coupled to a rotating gear 2714. As a wing 2702 is pivoted around the first pivot 2706, the wing teeth 2712 accordingly engage and rotate the gear 2714. The gear 2714 is coupled to a wheel 2716 which rotates through an optical sensor assembly 2718. In one embodiment, the optical sensor assembly 2718 contains a light emitting device (not shown), such as an LED, positioned on one side of the wheel 2718, and a photo sensor (not shown) positioned on the opposite side of the wheel. In one embodiment, the wheel is slotted. As the wheel 2718 is rotated, light from the LED is alternately blocked from reaching the photo sensor by the wheel 2718, or reaches the photo sensor via a wheel slot. The photo sensor produces a varying voltage or current signal corresponding to the amount of light illuminating the sensor. The photo detector signal may be coupled to a processor circuit which can determine from the photo sensor signal the amount of rotation, the rotation velocity, and the rotation acceleration. In an alternative embodiment, instead of slots, the wheel 2716 is patterned. The optical sensor assembly 2718 has both the LED and photo sensor located on the same side of the wheel 2716. As the wheel 2716, the photo sensor detects the variations in light reflected by the wheel 2716 as a result of the pattern being rotated beneath the LED. As before, the resulting photo sensor signal is provided to a processor circuit which then derives motion and position information.

Similarly, when the wing assemblies are rolled, a second wheel 2720 rotates through a second optical sensor 2722. The optical sensor 2722, in turn, provides rotation information to the processor.

In addition, in one embodiment, the toy includes a sensor (not shown) which provides an indication of the orientation and movement of the toy as a whole. By way of example, in one embodiment, the toy includes a gyroscope sensor. In another embodiment, a tilt sensor is provided which indicates, in either a discrete or continuous manner, the tilt of the vehicle relative to the ground. For example, the tilt sensor indicates if the jet nose is pointed up or down, or if the jet is tilted to the left or the right. The tilt sensor may be a pendulum-type sensor, a mercury switch-type detector, a conductive ball-in-a-cage type sensor, or an optical sensor (for example, one may optically detect the movement of a ball along a path), or a magnetic field-type sensor. The tilt sensors described above are well known to one of ordinary skill in the art. The tilt sensor type is not essential for the operation of the present invention. In still another embodiment, an accelerometer sensor, such as a ball-in-a-cage sensor, by way of example, is used to determine the acceleration and deceleration of the toy in up to three dimensions.

In another embodiment, a continuous sensor, such as potentiometer or optical sensor is coupled to a movable jet nose cone. The nose cone may be tiltable, rotatable, or both tiltable and rotatable. In one embodiment, the sensor provides continuous motion information relating to the tilt angle or rotation of the nose cone. The nose cone may optionally act as a radar dome (radome) and may be opened or closed. Contact switches are used to sense whether the dome is opened, closed or locked into place by a latch or the like.

As described above, the toy may be optionally equipped with a removable engine. In addition an engine access panel (not shown) is used to provide access to the engine. Contact sensors or the like may be used to sense whether the access panel has been removed as well as the presence and lock status of the engine.

In one embodiment, the toy is equipped with a sensor that detects the presence and relative distance of another object. For example, in one embodiment, the toy includes an acoustic range finder, such as is used on Polaroid cameras to provide an indication of the distance of the toy from a wall or other object. In another embodiment, the toy includes an optical range finder of the type commonly found on automatic 35 mm cameras.

In another embodiment, a sensor is coupled to a rotatable landing gear wheel. As the jet is pushed along a surface, the wheel rotates. The sensor provides information on the frequency of rotation, which in turn can be used to determine the velocity or acceleration of the toy as it is pushed along the surface. In one embodiment, the sensor outputs a voltage signal having a first voltage every time the wheel makes one rotation.

Furthermore, one or more light sensors are optionally placed at one or more locations on the toy jet. In one embodiment, these light sensors are used to detect light emitted from another toy or other light source. For example, a toy antiaircraft gun may emit visible or infrared light in response to a child firing the gun at the jet. The jet's light sensor detects when a "hit" has been scored. In another embodiment, a light sensor is used to receive data and commands, as described below.

Figure 3:
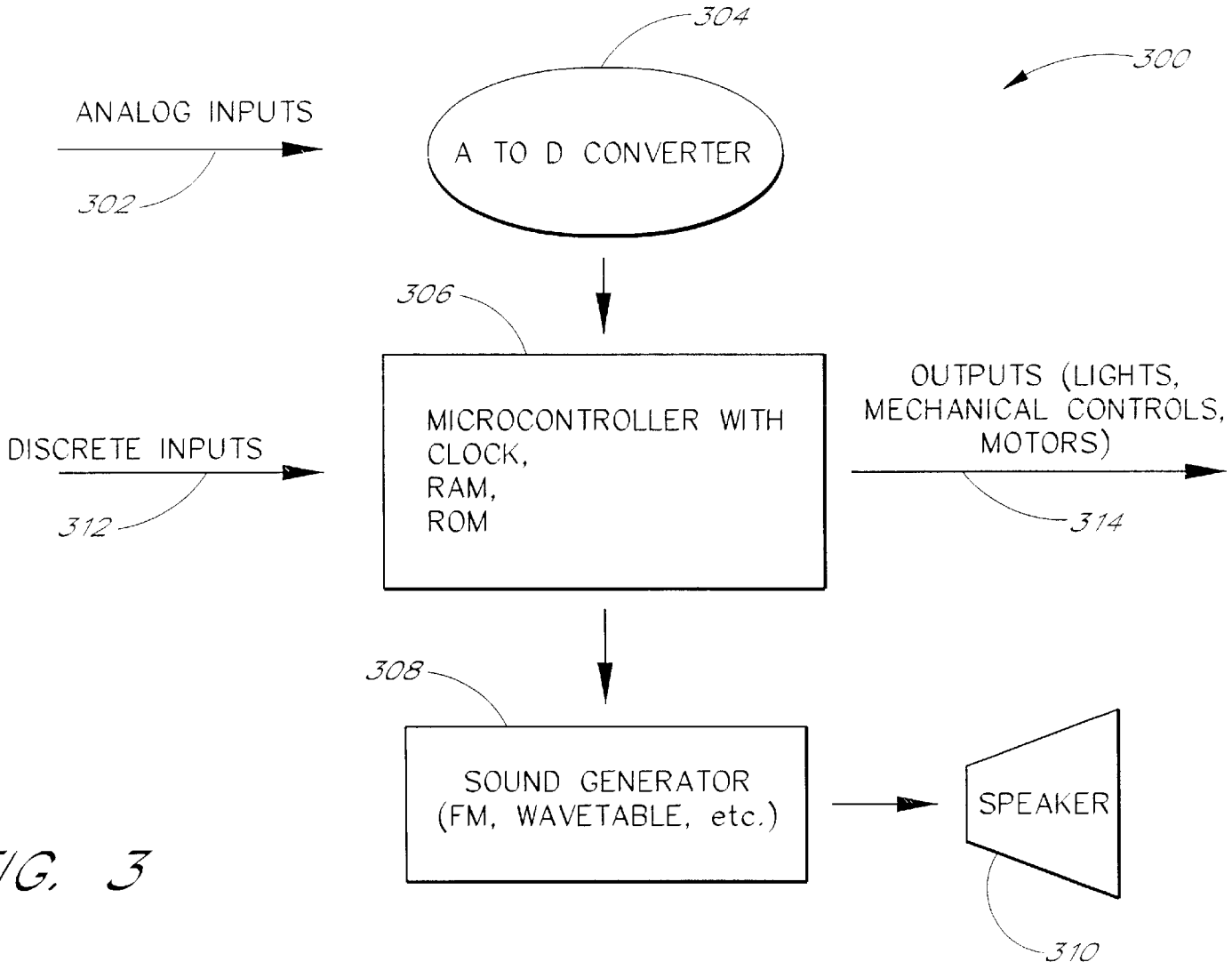
FIG. 3 illustrates a block diagram of one embodiment of the present invention.

In one embodiment, one or more of the sensor outputs are of an analog nature, such as a varying voltage, current or power with more than two discrete values. As illustrated in FIG. 3, these analog signals 302 are provided to an electronic control circuit 300 located in the toy, including an analog to digital (A/D) converter 304 which converts the analog signals to corresponding digital values. Typically, a plurality of analog signals are provided to a multiplexer (not shown) located within the A/D converter 304. Select signals are used to select which analog signal is to be converted. The A/D converter 304 in turn provides the corresponding digital values to a processor 306. In one embodiment, the processor 306 includes a microcontroller. By way of example, the microcontroller may optionally be selected from one of the following microcontroller families: the Microchip PIC 16XX family, the National Semiconductor, Inc. COPS family, Toshiba's T family, and the Epson 62XX family. In another embodiment, the processor 306 is a state machine. The processor 306 may optionally also receive discrete inputs 312, such as the outputs of switch contacts.

In the illustrated embodiment, the processor 306 is coupled to both random access memory (RAM), which is used as a work space memory, and read only memory (ROM), which is used to store software or firmware, including programs, commands and data, including sound data. The software may further include one or more play scenarios. As discussed below, in one embodiment, the user may load new software into ROM. By way of example, the ROM may be an electrically erasable and writable ROM (EEPROM) or may be a battery-backed RAM. As discussed below, in one embodiment, the processor executes the toy software. The software monitors the sensor signals 302 and the discrete inputs 312. In one embodiment, the processor 306 may also receive commands from a remote control unit. The remote control unit transmits and/or receives data and commands via radio waves, light waves, such as infrared light, or via one or more signal lines directly wired to the toy. Thus, by way of example, in one embodiment, the remote control unit downloads immediate commands, such as a "flash lights" command, or entire programs using an IrDA-compatible infrared link. T he remote control unit may be one or more of the following: another toy, a handheld unit operated by a person, a computer executing a program, a networked terminal, or a television set. For example, a television show may cause the television set to emit commands in the form of flashes of light, which are received by the toy. These commands cause the toy to operate in a manner that is coordinated with the television show. Furthermore, the remote unit may be used to download new software to the toy. The software may include new sound files as well as other types of data.

In another embodiment, new software is added to the toy using a cartridge containing a memory device. In one embodiment, the cartridge is inserted into a socket. The socket is concealed behind a movable access door. In another embodiment, the cartridge is disguised to appear as a bomb or other toy play piece. The disguised cartridge is coupled to the controller circuit via a connector located, by way of example, on a wing.

The software responds to the processor inputs by causing the processor 306 to provide appropriate outputs 314, optionally including both digital and analog outputs, which in turn causes some type of external event to happen. For example, the toy may be equipped with lights that simulate aircraft wingtip lights or to simulate cannon flashes. The lights may be of one or more colors. In one embodiment, the lights are light emitting diodes (LED's). The processor may cause one or more of the lights to flash in response to an external input. For example, if the gyroscope indicates that the jet is in a steep dive, such as may occur when a child is simulating a ground attack, the processor may cause the cannon lights to flash, thereby simulating cannon fire. Similarly, the processor may cause the cannon light to flash in response to a command from the remote control unit.

Furthermore, in another embodiment, the processor outputs are used to control electric motors. These motors may be used to move a portion of the toy, such as, by way of example, the landing gear and wheels, or, as described below, to cause the toy to shake, rattle or otherwise vibrate. The shaking may be initiated in response to a variety of conditions, such as the movement of a portion of the toy, pre-programmed commands, or other environmental conditions. As described below, in one embodiment, these motorized motion may associated with appropriate synthesized sounds. In another embodiment, the processor outputs are used to control a variety of transducers, including, by way of example, spring releases, solenoids in the like. By way of example, as described above, when a child "lands" the jet with the landing gear down, pressure is exerted on the piezo electric film sensor. The film sensor in turn outputs an electrical signal to the processor related to the pressure. In response, the processor 306 causes a motorized air brake to open, thereby realistically simulating an actual fighter jet landing. In another embodiment, the landing gear is associated with sensors, such as microswitches, which detect if the landing gear in deployed, retracted. Furthermore, landing gear brakes may optionally be provided. The break may be gradually applied after the child lands the jet and then rolls the jet forward on the landing gear wheels.

In one embodiment, the control circuit 300 causes the toy to shake or rattle in response to an input. In one embodiment, the shaking is strongly felt by a user holding the toy. In another embodiment, the shaking is visible to an observer. In one embodiment, the shaking or rattle mechanism is caused by an internal weight distribution within the toy. In one embodiment, the shaking is caused by quickly moving a weight repeatedly using a solenoid or a motor.

In still another embodiment, the processor outputs are used to cause nitinol wires (wire which shortens when electrically powered) to expand and contract. In one embodiment, one or more nitinol wires are coupled between two relatively movable portions of the toy, such as a spring-loaded bomb bay door (not shown) slidably positioned in the aircraft body. When the processor causes the nitinol wire to expand or contract, the door correspondingly slides open or closed.

As illustrated in FIG. 3, in one embodiment, the processor 306 is coupled to a sound generator circuit 308. As will be understood by one of ordinary skill in the art, the processor 306 and sound generator 308 may be parts of a single integrated circuit, may be separately packaged, or a single circuit may perform their respective functions. For example, the sound generator 308 may be compatible with discrete sound chips, such as those from Sunplus, Winbond, UMC, Holtek, and EMC. Alternatively, the sound generator 308 may be integrated together with the microcontroller 306, such as in the Texas Instruments 50CXX family, the Sunplus SPC family, and the EMC 76XXX family. In the illustrated embodiment, the sound generator circuit 306 is coupled to at least one sound transducer, such as a speaker 310. The speaker may be mounted at various locations within the toy. In one embodiment, an amplifier (not shown) is interposed between the sound generator circuit and the speaker 310. In another embodiment, the sound generator is coupled to two or more speakers, allowing for multi-channel sound production. For example, a toy airplane can have a speaker mounted in each wing to provide stereo sound. The wings may have port opening to increase speaker efficiency. For example, the speakers may be positioned to face upward in a wing, while the bottom of the wing has a port opening. Alternatively, the speakers may be positioned to face forward so as to emit sound via the engine air intakes. In another embodiment, a speaker may be positioned to face rearward in an engine outlet.

In one embodiment, a battery (not shown) provides power for the control circuit 300. In one embodiment, the battery is located in a battery compartment (not shown) which is accessible through a hatch at the bottom side of the fuselage. In another embodiment, the battery is located in a compartment positioned behind the removable engine module, and is accessed by removing the engine module. In an alternative embodiment, power is supplied from an external power source, such as an AC-to-DC converter, via a connector located on the toy. The toy may optionally be turned on using one or more of the following techniques. In one embodiment, a user accessible on/off switch is used. In another embodiment, when one or more mechanical or non-powered sensors, such as a mechanical tilt switch, detects that jet has been picked up or moved, power will be coupled to the control electronics via the mechanical sensor. The control electronics will power itself off upon one or more conditions. For example, power is turned off if no motion is detected for a predetermined period of time.

The sound generator advantageously provides interactive, real-time sound synthesis in response to sensor inputs. Thus, rather than storing a limited vocabulary of prerecorded sounds played back virtually unaltered as in conventional systems, one embodiment of the present invention efficiently and flexibly uses wavetable synthesis techniques to create real-time sound effects. In one embodiment, the synthesized sound effects are perceived by a user to be substantially concurrent with the corresponding discrete and continuous inputs. Furthermore, as described below, in one embodiment, the sound generator provides "sound-on-sound" capability, allowing multiple independent sounds to be generated.

In one embodiment, digital sound recording are stored in the control circuit memory. These recordings may be derived from real life sounds, sound effect libraries, or computer modified data or recordings. The sound records may be compressed using one or more techniques. In one embodiment, the sound is time compressed. In another embodiment, the sound is frequency compressed. The sound records also may be in the form of MIDI commands. The sound generator can produce variations of the stored sound. For example, the recording data can be modified as it is being played. Thus, the sound generator can modify the pitch, timber, speed, sound level, reverberation, waveshape, and frequency. Furthermore, in one embodiment, the sound generator combines all or parts of two or more sound recording data files and play the result to create a new sound.

In one embodiment, the control circuit mathematically derives sounds using formulae stored in memory. The formulae describe one or more desired sound wave patterns. The patterns may be combined or modified to create new sounds, thus allowing for a great variety of sounds and sound effects.

In one embodiment, sound generation is accomplished using one or more oscillators producing oscillating signals at one or more frequencies. These oscillating signals are combined and controlled by the control circuit to produce a wide variety of sounds.

In one embodiment, one or more of the following sounds which may be generated include, but are not limited to, the following: engine starting sounds, engine revving sounds (including acceleration and deceleration of the engine RPM); engine cruise sounds, missile launch sounds; bomb drop sounds; cannon firing sounds; machine gun firing sounds; braking screech; warning sirens sounds; voices; turret or pod rotation sounds; Doppler shift zoom sounds, such as occur when a jet approaches a listener and then departs; crash sounds; battle damage sounds; whoosh sounds; aircraft banking and climbing sounds; clanking sounds; whining sounds (used for landing gear retractions, weapon loading, etc.); whirring sounds; gear sounds; tire rumble sounds; breaking glass sounds; cockpit and access panel opening sounds; and musical sounds. In one embodiment, different sounds may be used in other toys using the same electronics. For example, in the case of a tank toy, the engine control electronics may generate the sound of moving tank treads, tank turret rotation sounds, different engine sounds, different cannon fire sounds, etc. In another embodiment, a toy castle may generate drawbridge opening sounds, arrow firing sounds, catapult sounds, etc., in response to appropriate inputs.

The synthesized sound may be altered based on a variety of conditions. For example, a sound associated with the movement of the toy or of a portion of the toy may be modified in response to the sensed velocity of acceleration. The sound may further be modified in accordance with the direction or angle of movement. Thus, an engine sound may be different when the jet is climbing as compared to when the jet is diving. Similarly, the sound made when a wing it rotated clockwise may be different than the sound made when the wing is rotated counterclockwise. In addition quickly repeating events, such as the rapid fire of the jet's cannon, will be associated with a different or modified sound than the occurrence of a single corresponding event, such as firing the cannon once. Furthermore, a sound may be modified based upon the absolute number of occurrences of an event, such as the number of cannon firings. In another embodiment, the sound may be different or modified based upon the time between events. Further, the sequence of events may influence which synthesized sound is generated. For example, lifting the jet off the ground and then opening the canopy will produce a different canopy opening sound (an explosive decompression sound) then when the canopy is opened before lifting the jet off the ground, which will produce an electric motor whining sound.

In addition, a microphone is optionally provided which permits a user to record his own voice or other sounds, which may then be later reproduced by the toy. In one embodiment, user provided sounds may be downloaded from a remote device. In still another embodiment, the toy electronics and software detects and/or recognizes voices and other sounds. In one embodiment, the user may optionally program a different sound to be associated with one or more toy portions. The sound may be programmed by the user from an existing sound palette stored in memory or from a new palette download by the user using the downloading techniques described above. Thus, a child may associate an eagle's shriek with engine start up. Similarly, the child may associate a creaking noise with wing flap movement.

Several exemplary play situations will now be described. In one example, the control electronics may cause an engine roar sound to be generated in response to sensing that the jet has been lifted off the ground. The frequency profile and volume of the engine roar sound may be modified in response to an accelerometer sensing that the jet is being swiftly accelerated through air or in response to sensing the position of the wings. A cannon fire sound may be generated in response to the tilt sensor indicating that the front of the toy, that is the jet nose, is being tilted downward, as in a simulated strafing run. Furthermore, in one embodiment, the toy is configured with "sound-on-sound" capability, allowing multiple independent sounds to be generated. Thus, two or more sounds may be generated or modified at substantially the same time in response to the inputs from two or more sensors. For example, upon sensing that the jet is being lifted off the ground and is being moved forward, the control electronics may cause the motorized landing gear to retract. At the same time, the control electronics causes the generation of a whirring sound, such as would be made by the retraction of real landing gear, and an engine roar sound. If the control electronics further detected that the jet was "hit" by antiaircraft fire, as described above, a third sound, that of an explosion or tearing metal, can be generated as well. In addition, in one embodiment, the control circuit causes the jet to shake in response to the hit.

Furthermore, the software may cause a stored play set or play scenario, including predetermined sequences of sounds and action, to be initiated either randomly, or in response to an external input. For example, upon sensing that the jet has been lifted off the ground, the following sequence may be initiated: the wings may be automatically rotated into the vertical takeoff position, with the engine exhaust pointed downward. In conjunction with the wing rotation, a whirring sound and an engine roar sound is synthesized. After a period of time, the landing gear is retracted, and a clunking noise is generated, indicating that the landing gear is fully retracted. The software may then cause the wings to be rotated to a flight position, accompanied by more whirring sounds and an appropriate change in the pitch and volume of the engine sounds. New scenarios may be created or downloaded by the user, or the user may edit existing scenarios. Scenarios may be exchanged by users or sold by developers via television (in the form of a broadcast light pattern and/or light intensity detected by a light sensor positioned on the toy), the Internet, CD-ROM, bar codes, or other methods of storing or providing computer readable data.

Furthermore, in one embodiment, the control circuit optionally provides voice warnings, instructions, and other information in response to various inputs to provide a more immersive play experience. For example, if the child moves the jet in a steep climb, the control circuit may generate a warning, such as "Danger! Engine cut-off is about to occur. Level out!" Similarly, if the control circuit determines that the jet is rapidly approaching an object, such as a wall, the control circuit may generate a warning such as "Warning! You are about to crash! Bank!" If the control circuit determines that the jet has been "hit" by another toy, the control circuit generates a warning "You've been hit!" Furthermore, if either the user or the processor has initiated an ejection sequence, a warning siren will be generated as well as a voice alert before the pilot ejected using an ejection seat. Thus, various audible information, including voice and sound effects may be generated in response to the information provided by one or more of the sensors described above.

Another scenario will now be described to further illustrate the flexibility and immersive quality of one embodiment of a toy aircraft. The play session may begin when a child grasps the airplane while the airplane is on the ground. This grasping action is sensed using either a heat sensor, a pressure sensor or other types of sensors. In response, the toy synthesizes a jet engine sound at idle. The airplane is made to vibrate in coordination with the engine idle sound. In addition, a light simulating engine flames is activated to burn dimly. As the airplane is rolled forward on its landing gear by either the child or under motorized control, the engine sound volume and pitch is increased to indicate the engine is speeding up. The vibration level is increased contemporaneously with the change in engine sound as is the engine light brightness. A pressure sensor coupled to the landing gear or an internal tilt sensor is used to detect if the child has picked the airplane off the ground and is "flying" the airplane. An accelerometer, tilt sensor or the like is used to detect that the child is moving the plane forward, and in response, the engine sound changces to an afterburner sound with the engine light glowing brightly. As the child banks the airplane, corresponding airflow "whoosh" sounds are made. If the child rotates the wings into a swept wing configuration, corresponding mechanical and airflow sounds are synthesized. The airplane, under processor control, may then enact a "damage" scenario. Thus, scenario involves simulating that the toy has been hit by cannon fire. The scenario may be initiated at randomly, in response to optically detecting "gunfire" from another toy, or in response to other stimuli. In simulating a hit, the toy will synthesize the sound of shells tearing into metal. An actuator is then commanded to release a portion of the airplane, such as a tail wing, to simulate damage. An engine sputtering sound is synthesized, with a corresponding variation in the toy vibration. The engine light may be caused to flicker as well. A klaxon sound may also be synthesized, along with the pilot's voice calling "mayday! mayday!"

If the child then points the airplane at a downward angle, the sequence continuous until the pilot is ejected and a crash sound is heard, indicating that the airplane has crashed and the play session is at an end. If, instead, the child points the airplane at an upward angle and then levels the airplane, a different scenario is played out, wherein the airplane recovers and audible instructions arc given to return to base. If, alternatively, the child first points the airplane at an upward angle, then dives, a battle scenario is played out, with the airplane's cannon lights are caused to flash, along with accompanying gunfire sounds. The processor determines how many shells were left at the end of the previous play session by reading a non-volatile memory, and will continue "firing" until the toy is pulled out of its dive or until there are no more shells left. Thus, an innumerable number of play scenarios may be played in response to how the child decides to play with the toy, stored play scenarios, and stored play patterns.

Table 1 illustrates examples of various verbal and sound effects which may be used in conjunction with one embodiment of the toy. Table 2 illustrates examples of various discrete and continuous sensors, one or more of which may be used in conjunction with one embodiment of the present invention. Different embodiments of the present invention may use discrete sensors in place of continuous sensors or continuous sensors in place of discrete sensors, though the amount and type of information obtained may vary depending on the choice of sensor. The decision on the number and types of sensors to use may be affected by cost and size constraints as well as by the amount of sensor information desired. Corresponding types of sensors and sound affects may be used in other toys, such as tanks, boats, robots and the like.

TABLE 1

| Sound Category | Sound |
|---|---|
| Air Dynamics | 1. Various "whoosh" sounds for maneuvers (climbing, banking diving, accelerating, decelerating) |
| | 2. Sonic Boom |
| | 3. Doppler shift sounds |
| Engine | 1. Start-Up/Shutdown |
| | 2. Revving up/down |
| | 3. Idle |
| | 4. Cruising |
| | 5. AfterBurner |
| | 6. Stalling/FlameOut |
| | 7. Malfunction |
| | 8. Explosion |
| Voice | 1. Pilot warnings |
| | a. Over G |
| | b. Crash Warning |
| | c. IFF (Identify friend or foe) Threat Warning |
| | d. Ejection Seat Activation Warning |
| | e. Mayday Warning |
| | f. Damage Warning |
| | g. Low fuel Warning |
| | h. Amount of ordinance remaining Waring |
| | 2. Pilot Directions |
| | a. Level Out |
| | b. Dive |
| | c. Pull-up |
| | d. Land |
| | e. Fire ordinance |
| | 2. Mission Controller Commands |
| | 3. On Board AI Weapon Targeting & Fire & Weapon Status/Inventory |
| | 4. Radio Transmission |
| | a. white noise |
| | b. pilot bantering |
| Landing Gear | 1. Wheels down mechanical sounds |
| | 2. Braking screech |
| | 3. Taxiing |
| | 4. Rotating wheel sounds |
| | 5. Tire blow-out sounds |
| | 6. Peelout |
| Munitions | 1. Missile lock claxon and launch sound |
| | 2. Rotary cannon mechanical and firing sound |
| | 3. Munitions lock-in sound |

TABLE 1-continued

| Sound Category | Sound |
|---|---|
| | 4. Countermeasure deployment sound |
| | 5. Bomb dropping sounds |
| | 6. Missile flying sounds |
| | 7. Bomb and missile explosion sounds |
| Other exemplary sounds | 1. Air brake deployment/retraction sound |
| | 2. Wing flaps mechanical and air turbulence sounds |
| | 3. Canopy opening and closing sounds |
| | 4. Ejection sounds |
| | 5. Explosive decompression sounds |
| | 6. Radar antenna movement sounds |
| | 7. Tearing and crushing metal sounds |
| | 8. Fluid leaking sounds |
| | 9. Fueling sounds |
| | 10. Electronic sounds, such as beeping |
| | 11. Warning Sirens |
| | 12. Glass breaking sounds |
| | 13. Cracking sounds |
| | 14. Musical sounds |
| | 15. Grinding sounds |
| | 16. Gear sounds |
| | 17. Various general servo/actuator motion sounds |

TABLE 2

| Sensor Type | Toy Portion | Sensors |
|---|---|---|
| Continuous | Nose Cone | 1. Spinning Motion |
| | | 2. Up/Down |
| | Wings Assembly | 1. Independent wing movement along "roll" axis |
| | | 2. Independent wing movement along "pitch" axis |
| | Tail Assembly | 1. SpinningMotion |
| | | 2. Pivotal Motion |
| | Vehicle body | 1. Gravity Sensor |
| | | 2. Tilt Sensor |
| | | 3. Motion Sensor |
| | | 4. Accelerometer |
| | Landing gear | 1. Wheel rotation |
| Discrete | Landing Gear | 1. Deployment |
| | | 2. Retraction |
| | | 3. Ground Contact |
| | | 4. Braking |
| | Cockpit Canopy | 1. Open |
| | | 2. Close |
| | | 3. Lock |
| | Ejection Seat | 1. Present |
| | | 2. Eject |
| | Ordinance | 1. Lock in |
| | | 2. Release |
| | Radar Dome | 1. Open |
| | | 2. Close |
| | | 3. Lock |
| | Engine Access | 1. Access Panel Removal |
| | | 2. Engine Insertion/Lock In Place |
| | | 3. Engine Removal/Unlock |
| | Refueling Port | 1. Hatch open/close |
| | | 2. Fuel probe contact |
| | Wing Control Surfaces | 1. Elevator up/down |
| | | 2. Ailerons up/down |
| | Exchangeable External Pod | 1. Lock In |
| | | 2. Jettison |
| | Speed Brake | 1. Deployment |
| | | 2. Lock in place/Unlock |

Figure 14A:
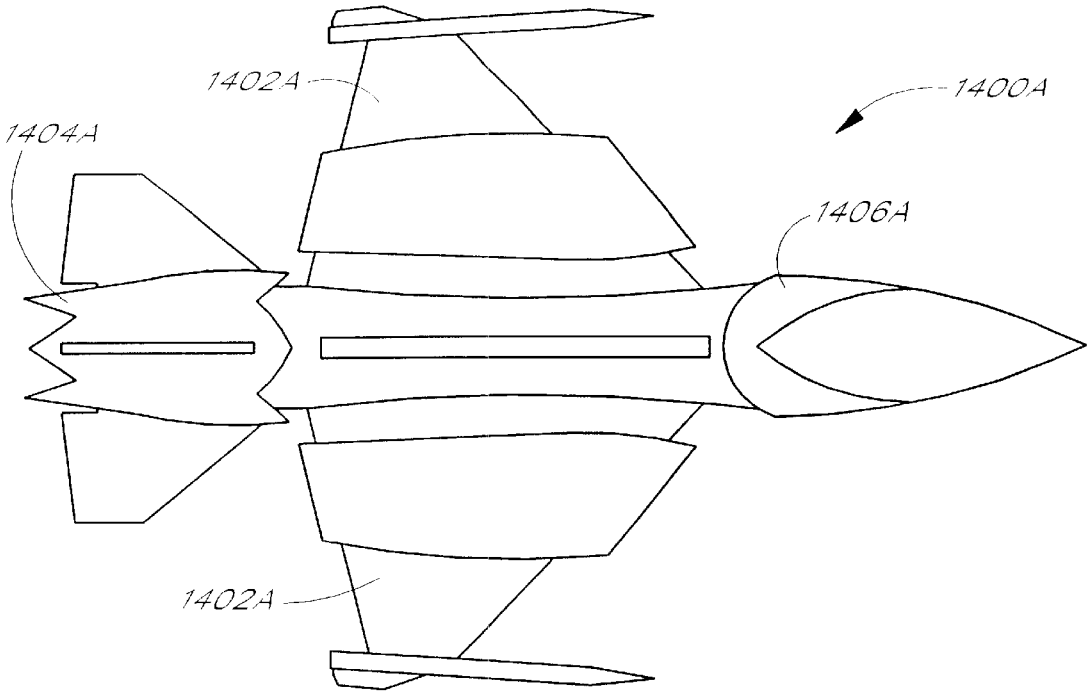
Figure 14B:
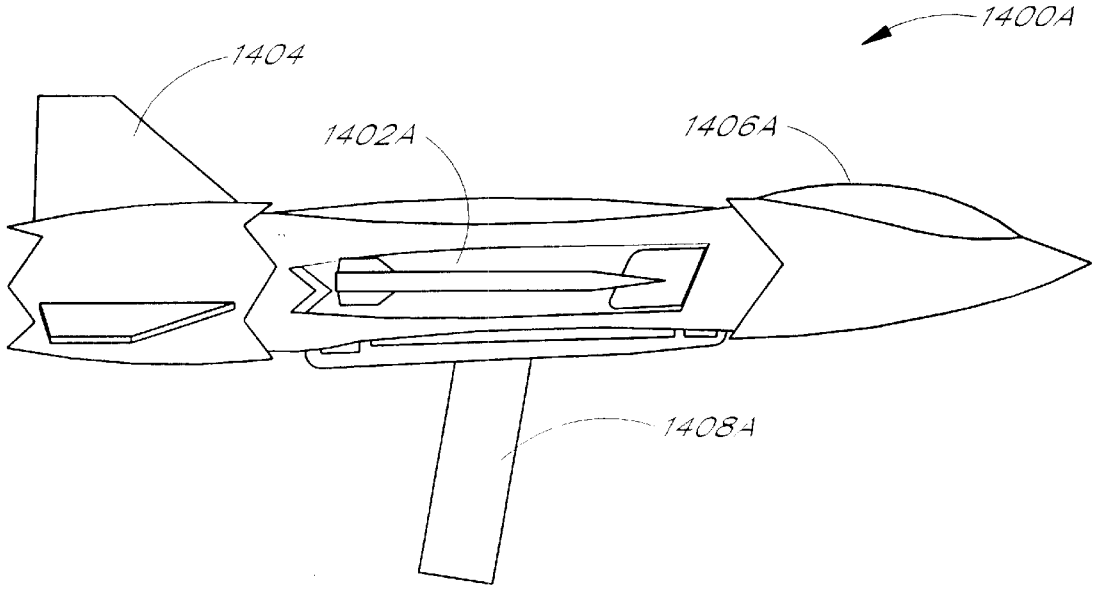
Figure 14C:
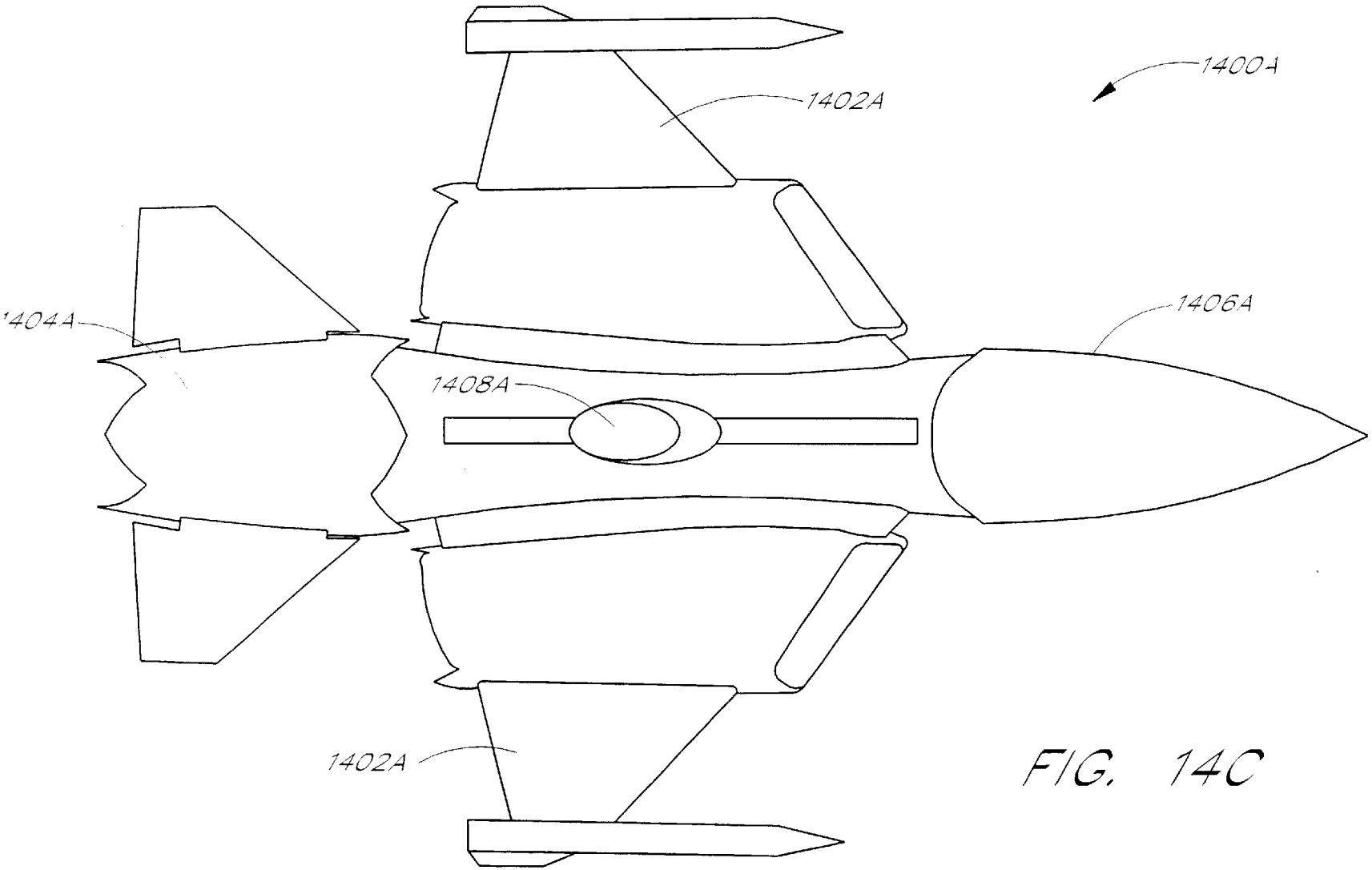
Figure 14D:
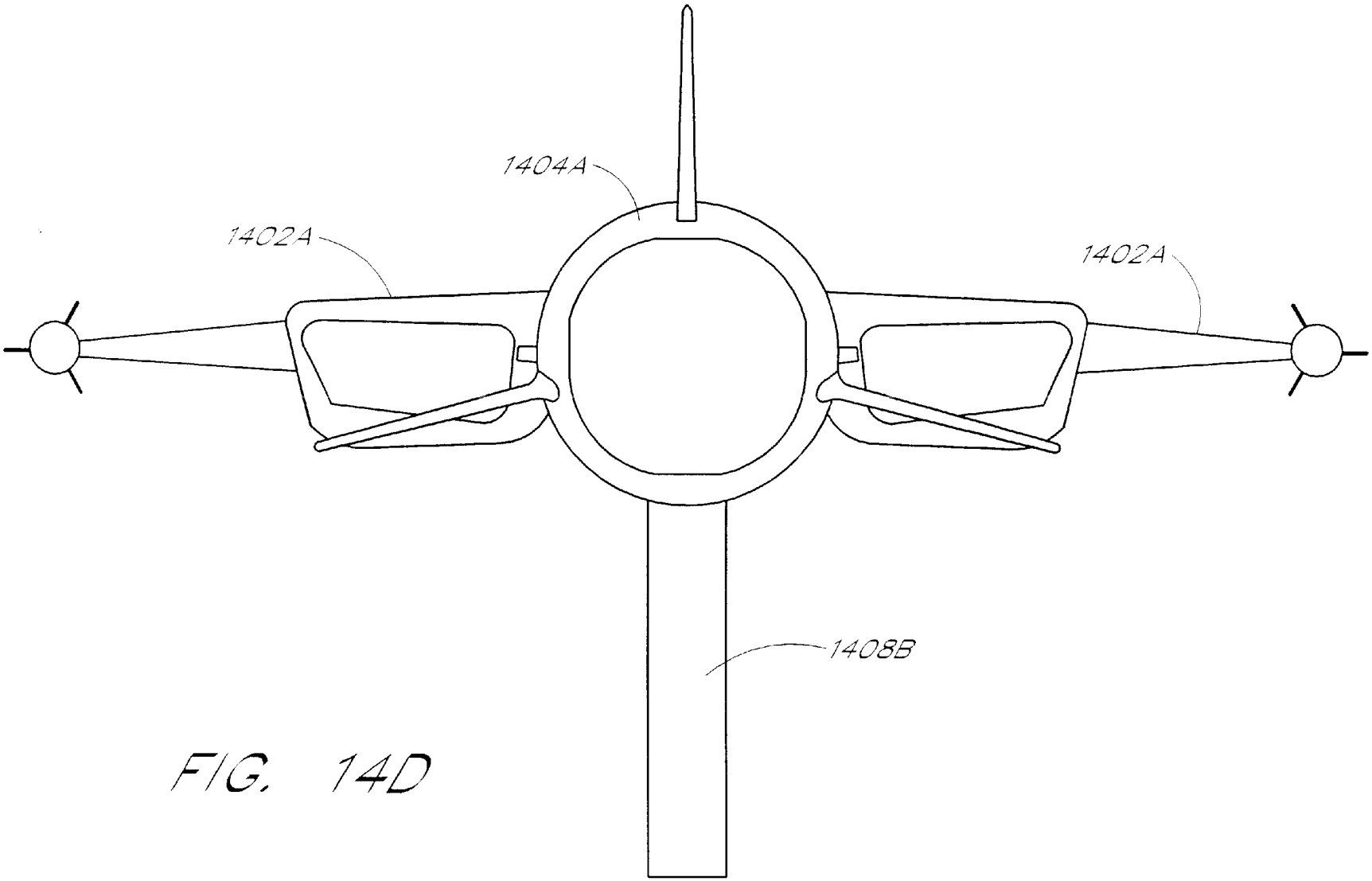
Figure 14E:
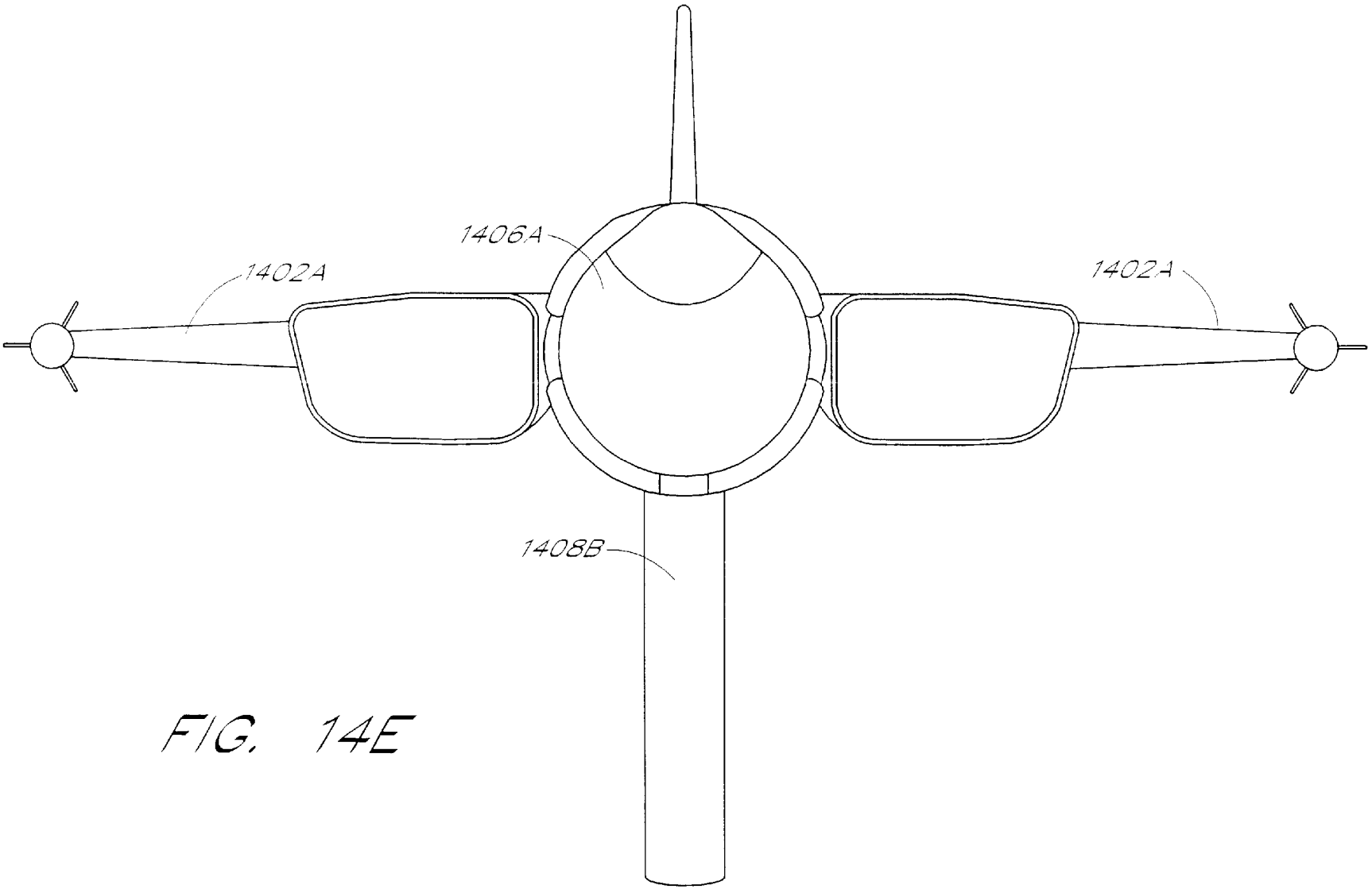
Figure 14F:
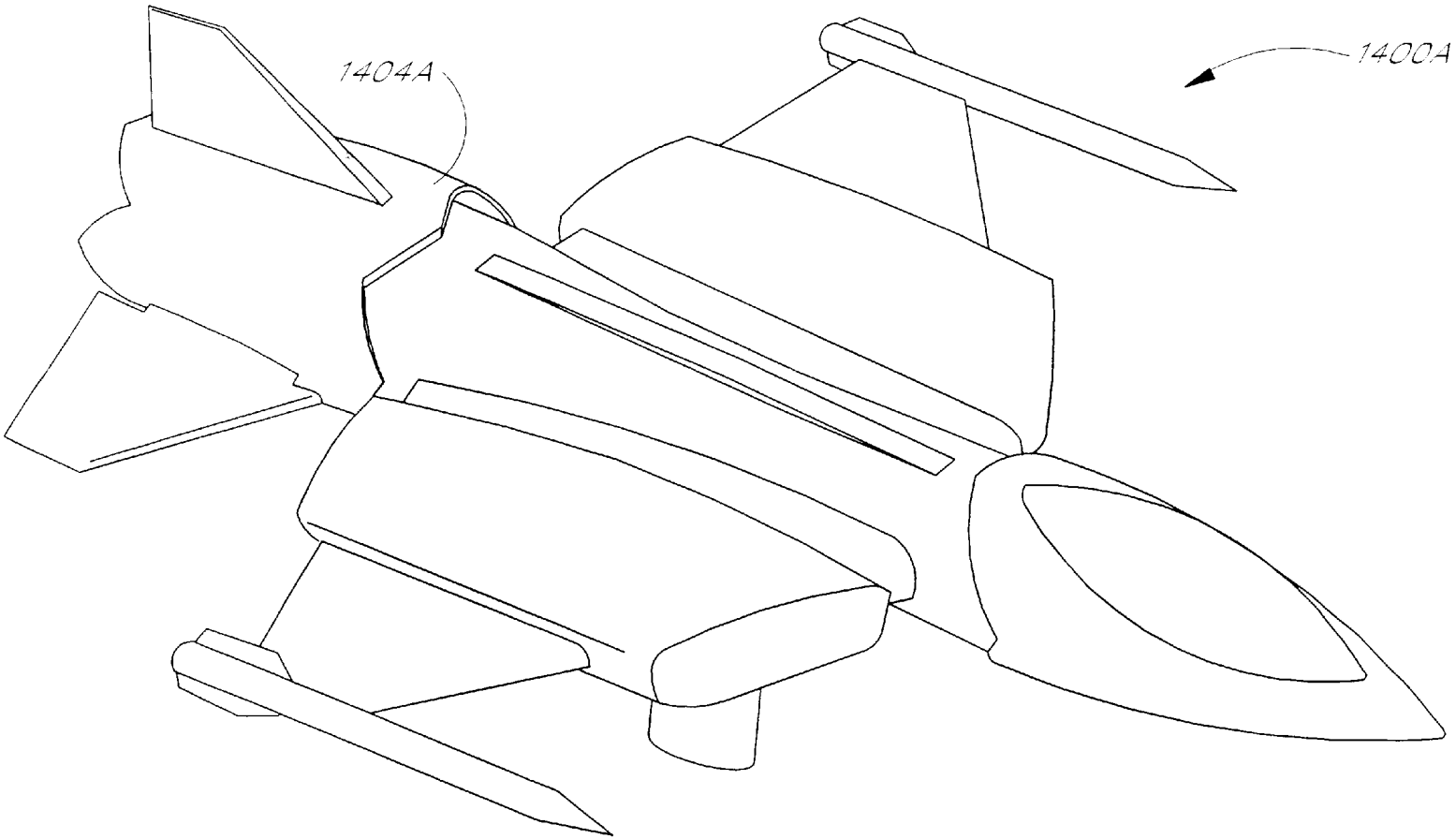
Figure 21:
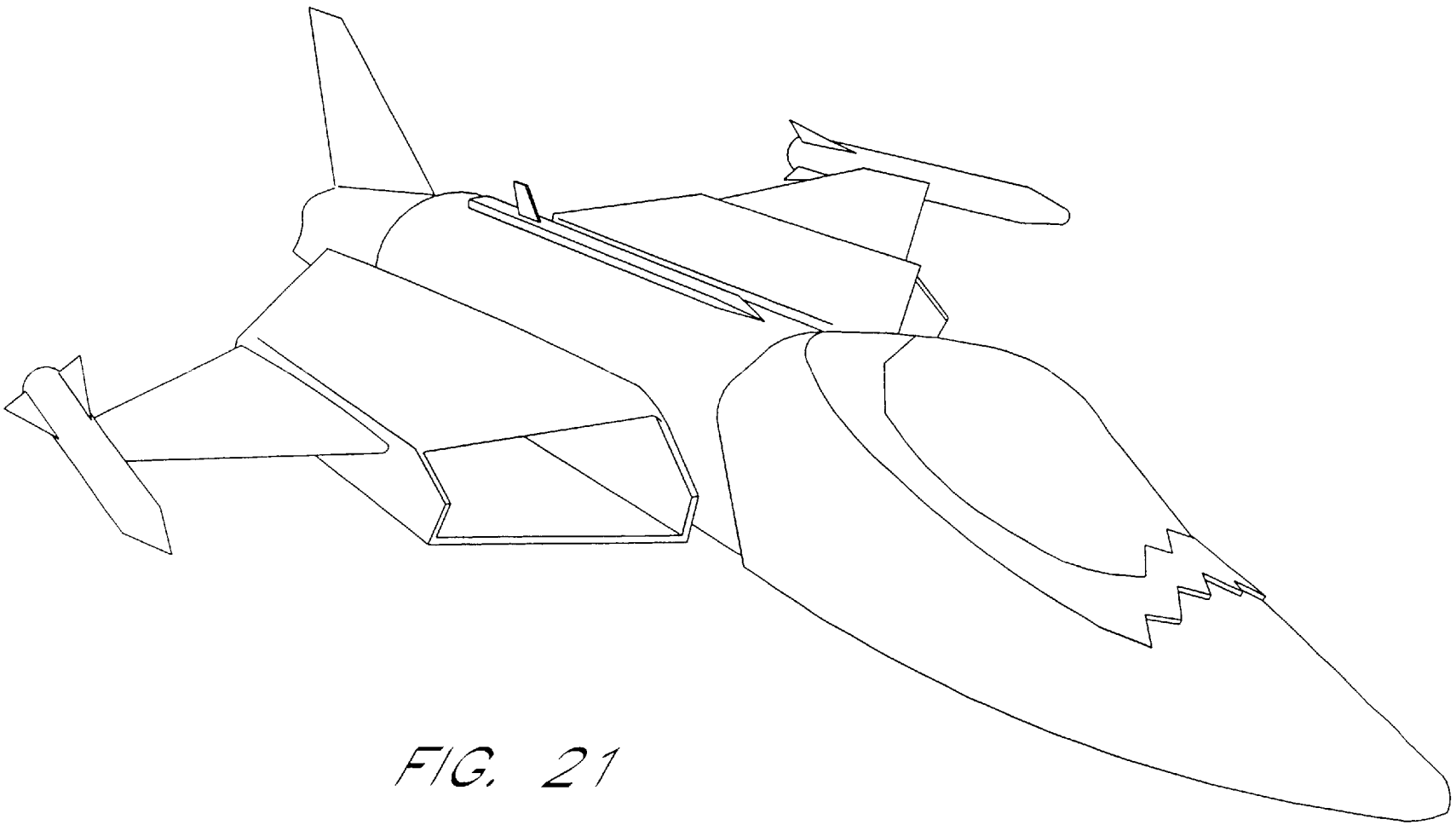
FIG. 21 illustrates a perspective view of one embodiment of the present invention.

In one embodiment, different views of which are illustrated in FIGS. 14A–F, a toy plane 1400A, including one or more of the features described above, may also include a handle 1408B. FIG. 14A illustrates a top plan view of the toy, FIG. 14B illustrates a right hand view, FIG. 14C illustrates a bottom plan view, FIG. 14D illustrates a rear view, FIG. 14E illustrates a front view, and FIG. 14F illustrates a top perspective view. The illustrated embodiment also includes a rotatable, tiltable, push/pull tail assembly 1404A. Wing assemblies 1042A may be independently rotated about their own axes as well as at least part way about the fuselage axis. A nose/cockpit assembly 1406A may be rotated about its own axis and may be pivoted. These movements may be accomplished using one or more of the joints or links described herein. FIG. 20 illustrates some of the possible movements. FIG. 21 illustrates a perspective view of an alternative embodiment of the toy illustrated in FIGS. 14A–F.

The handle 1408B, illustrated in FIG. 14B, permits a child to grasp and "fly" the plane without having to grasp and interfere with motorized movable toy portions, such as wings or landing gear. For added realism and comfort, in one embodiment (not shown), the handle 1408 is configured and ergonomically contoured to resemble an airplane control stick. Furthermore, the handle 1408B may be equipped with a variety of controls (not shown), implemented as buttons, a touch-sensitive display screen, rotary controls, or other types of user input devices. These devices allow the user to turn on the toy, select a specific play scenario, to select initial conditions, such as the amount of fuel, ordinance, play time, to select sound palettes, or to associate a sound with a toy portion. The handle 1408B may also contain a microphone for voice input, as described above. In one embodiment, the user may remove the handle 1408B.

In one embodiment, the primary input device is a touch-sensitive LCD display screen (not shown). The user is presented with an initial menu of choices, allowing the user to select a particular function. Once the user selects a function, the user is presented with further menu choices. For example, if user selects the sound palette function, the user is presented with a list of sound palettes, such as F-15 sounds, biplane sounds, sci-fi sound effects or the like. Similarly, if the child selects from the initial menu to associate a sound with a movable toy portion, the child is then presented with a list of toy portions, such as wings, hatches, bombs, engine, and the like. Once the child selects a toy portion, the child is presented with a list of sounds from which the child can select. In addition, the display screen may be used to provide help instructions. The help instructions can also be provided audibly using a synthesized human voice. A similar user interface can be presented to the user via a personal computer or the like linked to the toy.

Figure 18:
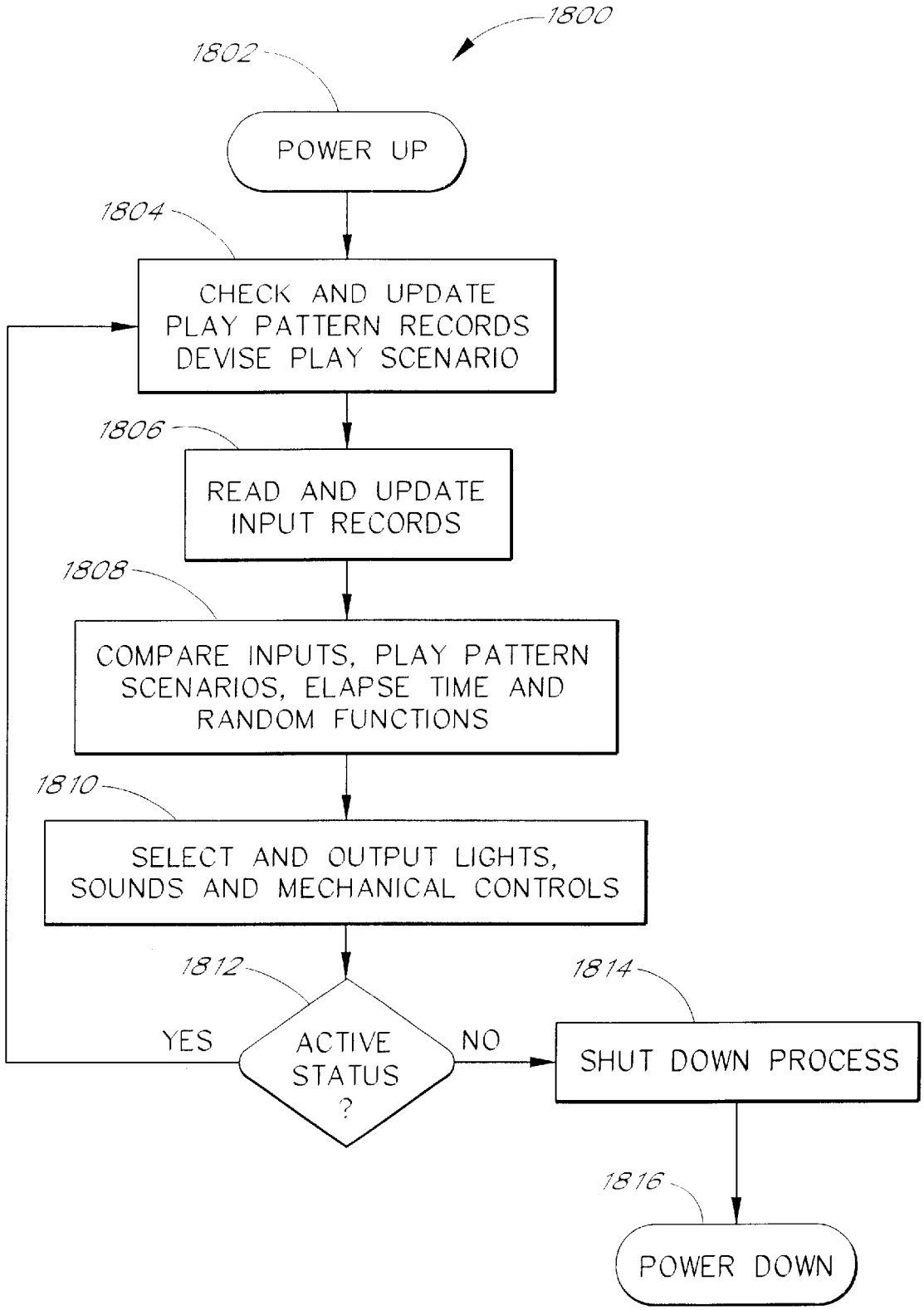
FIG. 18 illustrates a flowchart describing the high level operation of one embodiment of the present invention.

FIG. 18 illustrates a flowchart describing the high level operation of one embodiment of the present invention. The toy is first powered-up at a step 1802. Next, at a step 1804, the control circuit 300 determines if there are any play pattern records indicating how the toy was previously played. For example, the play pattern may include how long the previous play session or sessions lasted, how much ordinance was used and how much ordinance remains, the amount of fuel used and the amount remaining, previous "damage" inflicted on the toy, which toy portions were manipulated by the user, etc. Based on the play pattern records, a play scenario may optionally be devised. The control circuit then reads both its analog and digital inputs at a step 1806. The status of the inputs are then typically stored in a register or other memory element. The inputs' status is compared with the previous status to detect changes at a step 1808. Based on the inputs' status and other factors, including, by way of example one or more of the following: the current play pattern scenario; the elapsed time between changes in various I/O; the frequency of the changes in I/O; and randomizer functions (which ensures that the play will not be redundant), the control circuit set various outputs at a step 1810. These outputs control the toy lights, sounds, motors and other mechanical controls. Thus, for the same set of current sensor readings, the control circuit may cause different sounds to be generated, different lights to flash and different actuators to be activated based upon the other factors described above. If the control circuit fails to detect activity for a predetermined period of time at step 1812, then the control circuit gracefully shuts down the system and shuts off power at a step 1814.

In one embodiment, the control electronics is mounted in a reusable core module, illustrated in FIGS. 4, 5, 9, 15, 16 and 17. The core module is configured to receive compatible subassemblies. In one embodiment, the core module provides both a physical and an electrical interface to the compatible subassemblies. The electrical interface is used to connect to the control electronics to optional subassembly sensors, motors, solenoids, actuators, lights, remote processors, and the like. In one embodiment, the electrical interface is a standard USB or IEEE-242 serial interface. In another embodiment, discrete, individual interface signals are provided. In one embodiment, a core module electrical connector includes one or more male or female banana plugs. In another embodiment, the electrical connector is a mini-headphone-type connector.

The core module optionally identifies an attached subassembly using one or more techniques so as to properly communicate and control the subassembly. In one embodiment, a subassembly has an identification resistor having a unique value. The core module measures the resistance, thereby determining the subassembly identity. In another embodiment, the core module reads out an identification code stored in a subassembly memory. In still another embodiment, the core module scans a bar code identifier located on the subassembly. In still another embodiment, the subassembly is equipped with a unique physical "key," such as a pattern of bombs or ridges which interface with a "keyhole" on the core module. The core module reads the physical pattern, thereby identifying the subassembly.

Figure 4A:
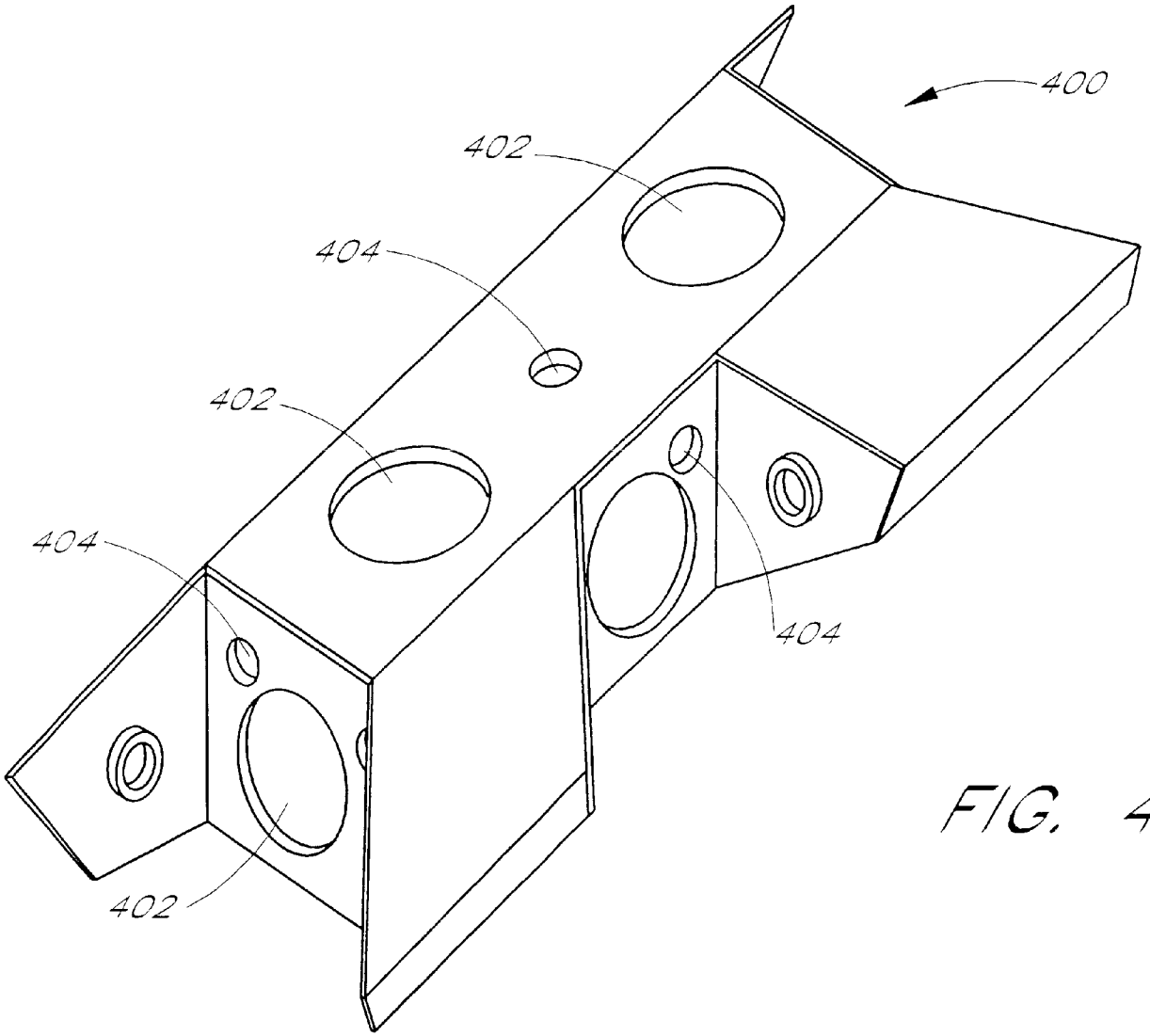
FIGS. 4A–4D illustrate a first embodiment of a coupling mechanism.
Figure 4D:
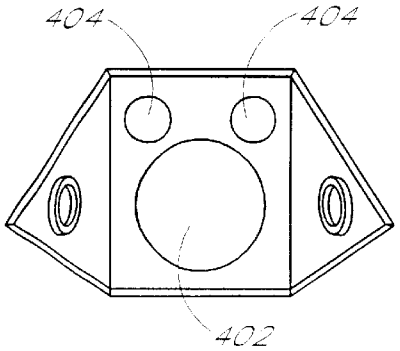
Figure 4B:
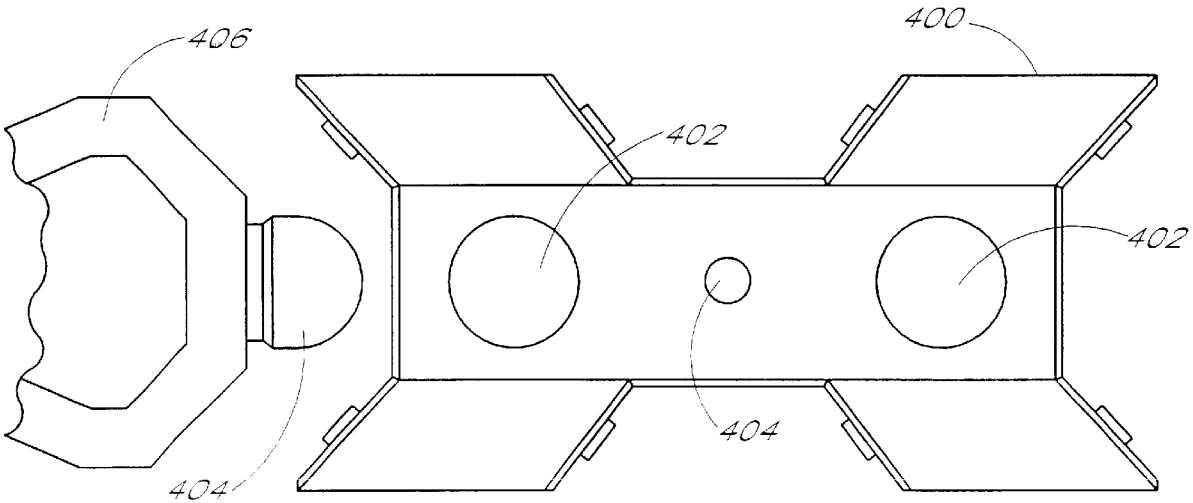
Figure 4C:
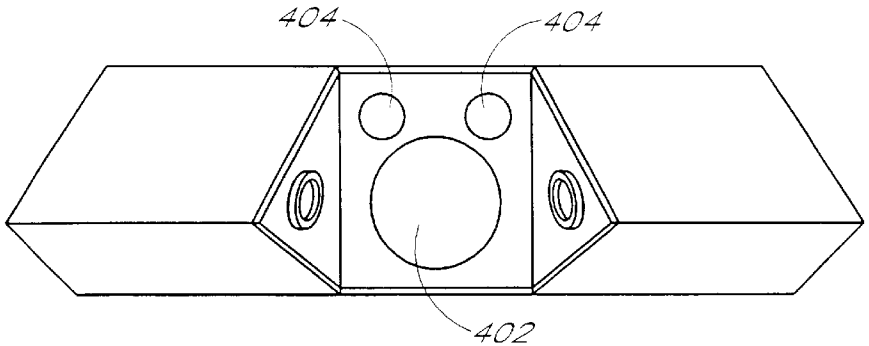
Figure 5A:
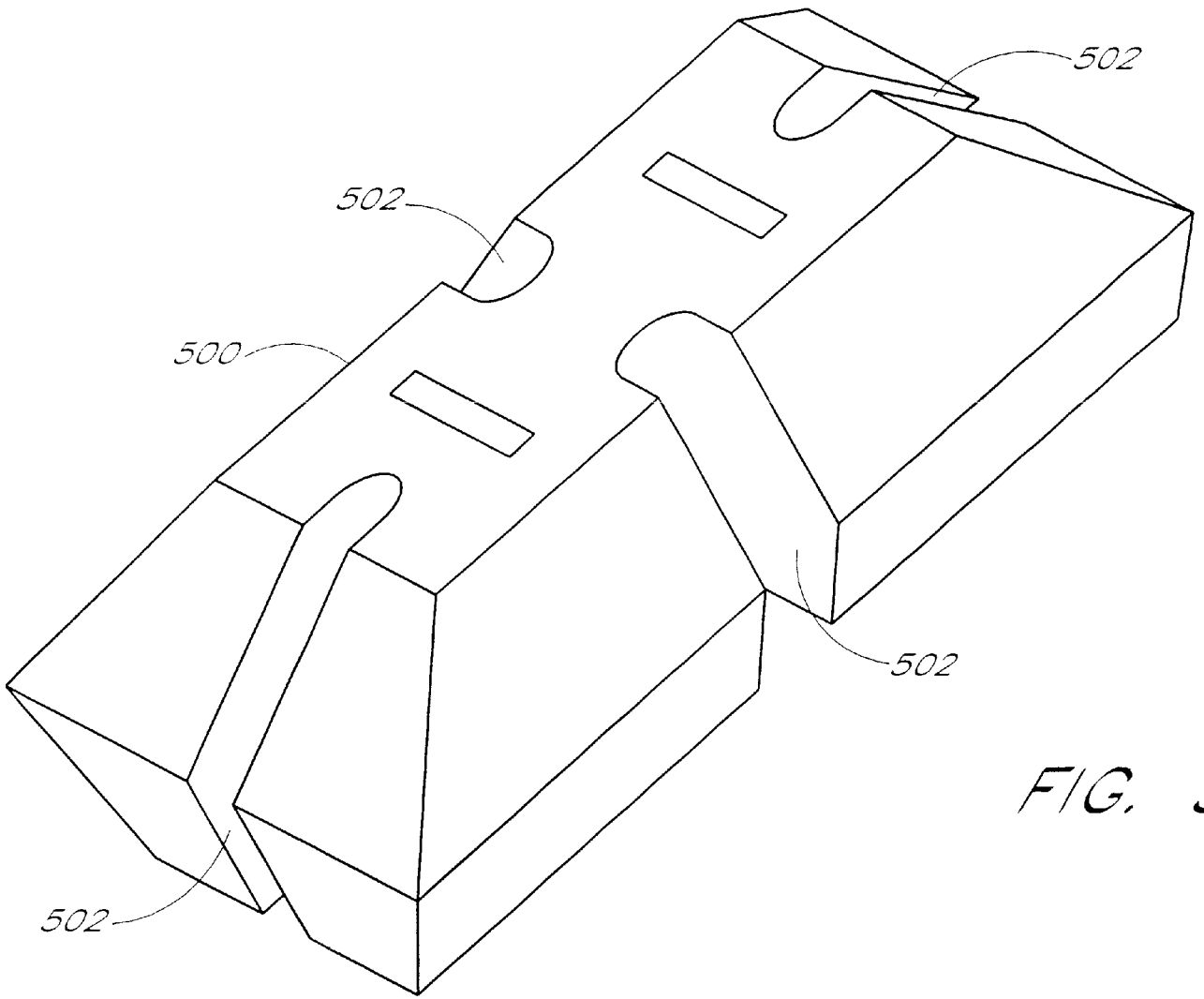
FIGS. 5A–5D illustrate a second embodiment of a coupling mechanism.
Figure 5D:
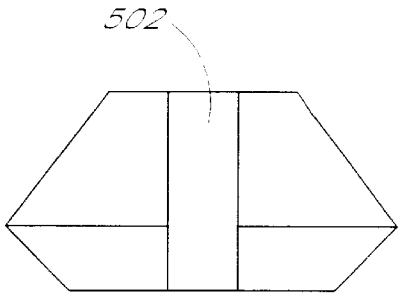
Figure 5B:
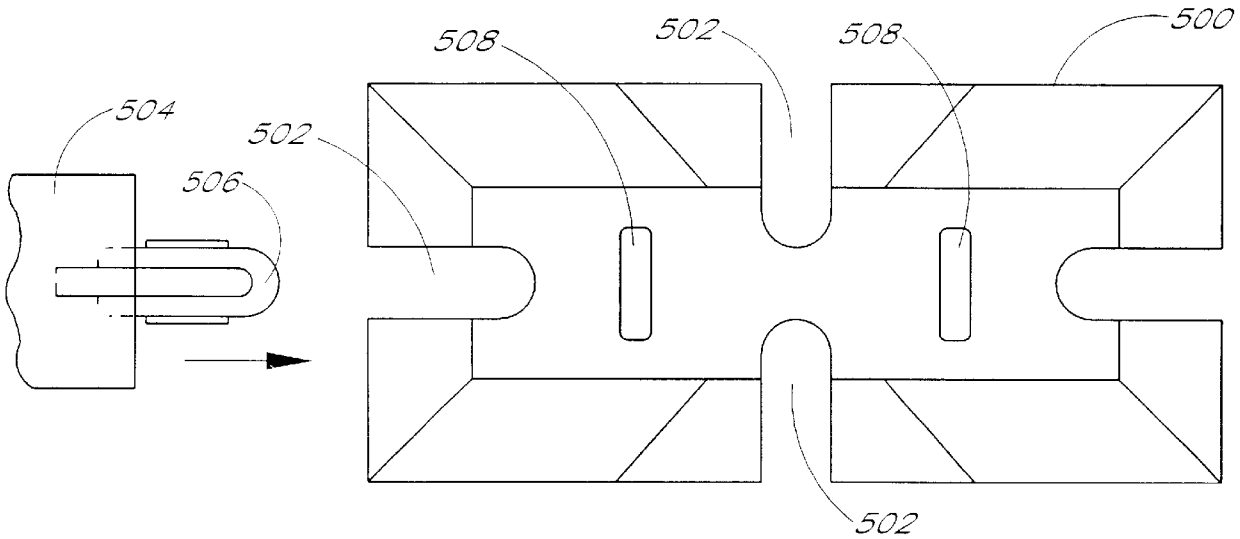
Figure 5C:
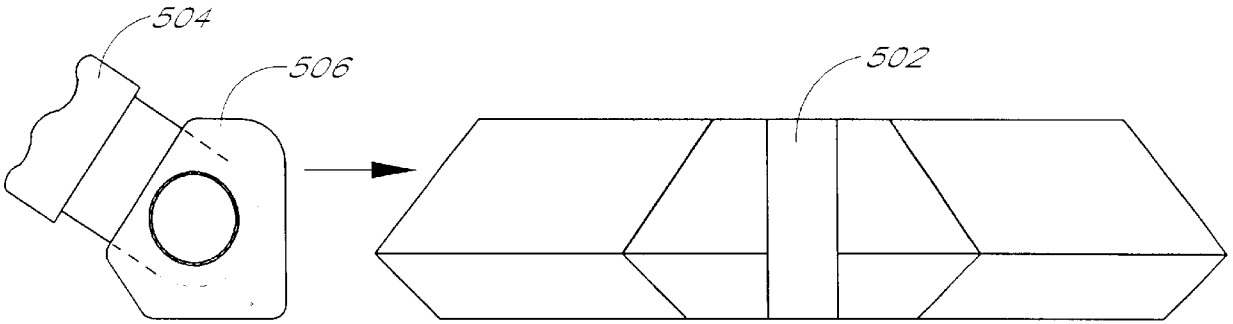

The toy subassemblies may be coupled to the core assembly using one or more techniques. For example, as illustrated in FIGS. 4A–B, a ball/socket interface is provided as a coupler. Thus, in the illustrated embodiment, a core module 400 has one or more sockets 402 configured to receive on or more ball assemblies 404, having a ball shaped protrusion 406. The ball assembly 404 is typically part of a second module or a peripheral assembly. The ball/socket interface allows the second module to be coupled to the core module 400 so that the two modules may be rotated in at least two axes with respect to each other. The core module may optionally include various size sockets 402, 404 which may be use for electrically and/or mechanically coupling toy assemblies together. In another embodiment, a hinged slot interface is provided, as illustrated in FIG. 5. A core module 500 includes one or more slots 502 for receiving an assembly 504 having a knuckle 506. The hinged slot interface permits the assembly 504 to be rotated with respect to the core module 500 in at least one axis. The module may further include receiving slots 508 which may provide a coupling mechanism with more limited travel as compared with the travel provided by the slots 502.

Figure 15:
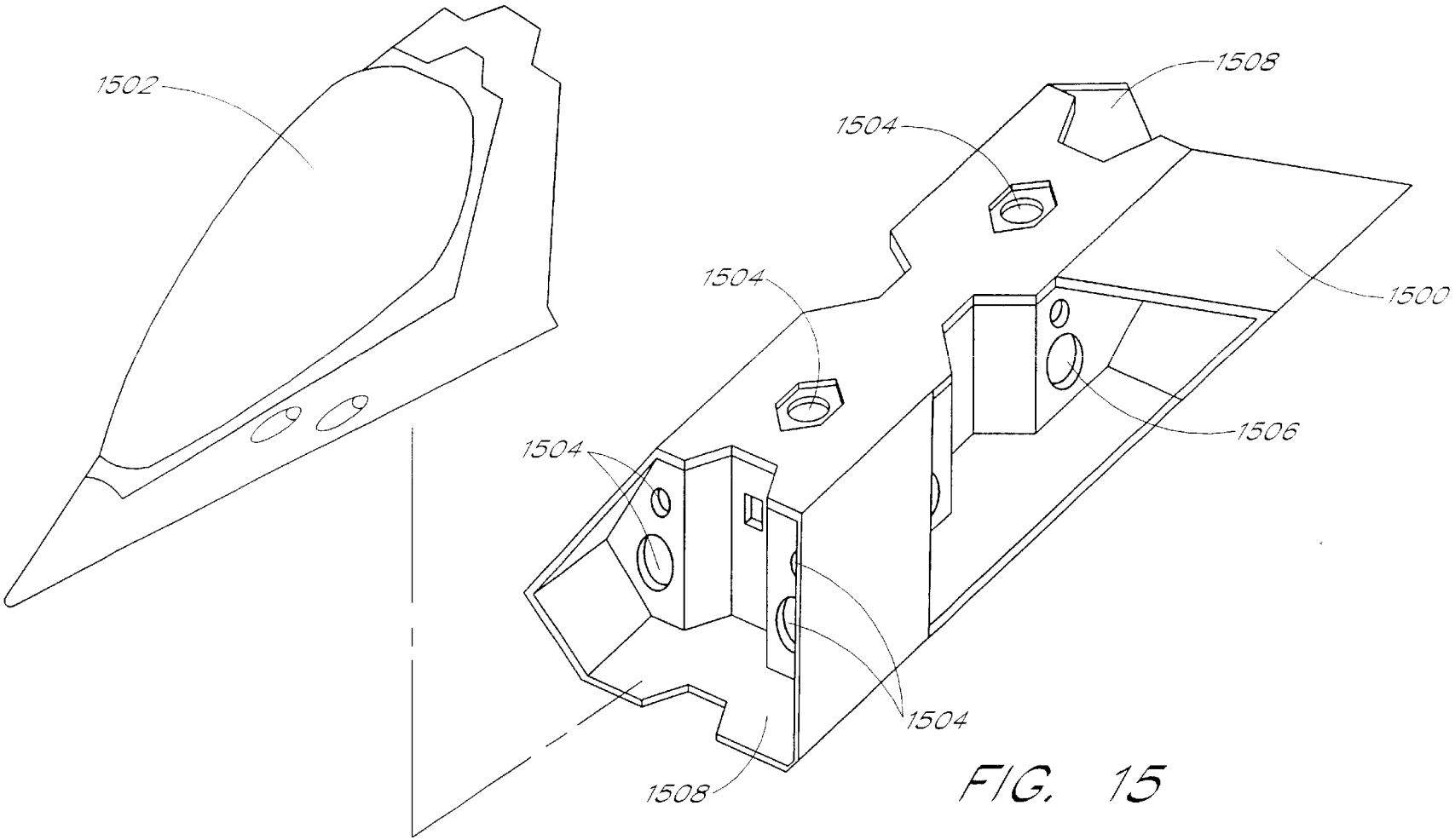

As illustrated in FIG. 15, in still another embodiment, a core module 1500 may have different types of standard physical interfaces 1510, 1508, 1504 to receive different types of subassemblies, such as primary feature modules and secondary feature modules, as illustrated in FIG. 15. The terms "primary" and "secondary" are used herein to indicate modules having different interfaces. Thus, a primary module interface 1510 has a first physical configuration, including shape, size, and socket configurations 1506 and a first type of electrical interface. The primary module interface 1510 may be used to receive a first type of module, such as wing assemblies or chassis assemblies. A secondary module interface 1508 has a second physical configuration, including shape, size, and socket configurations 1504 and, optionally, a second type of electrical interface. The secondary module interface 1508 may be used to receive a second type of module, such as a cockpit module 1502. A third physical interface consisting of sockets 1504 may be provided as well.

Figure 12A:
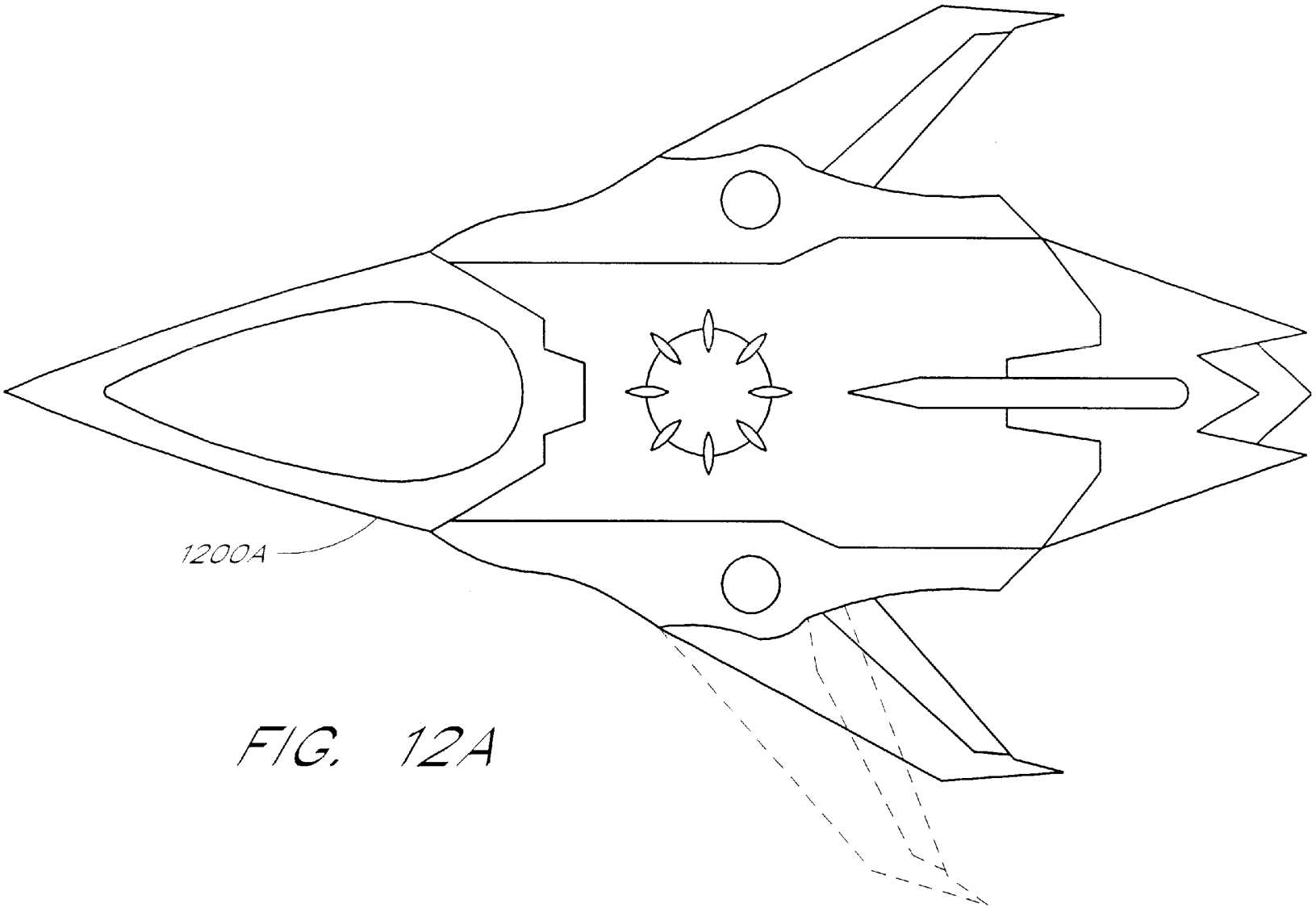
Figure 13A:
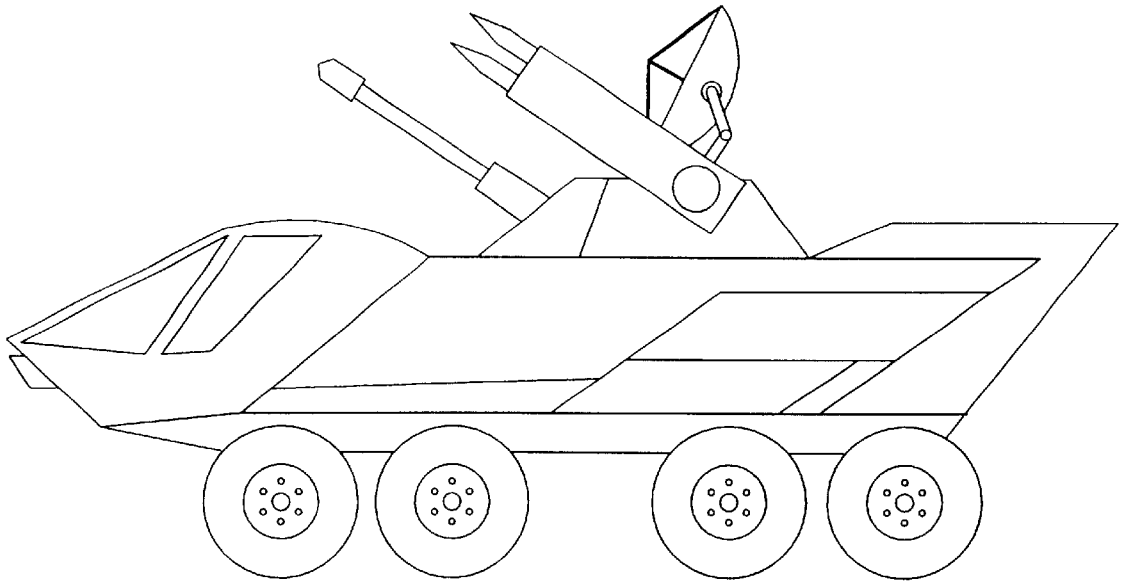
Figure 13B:
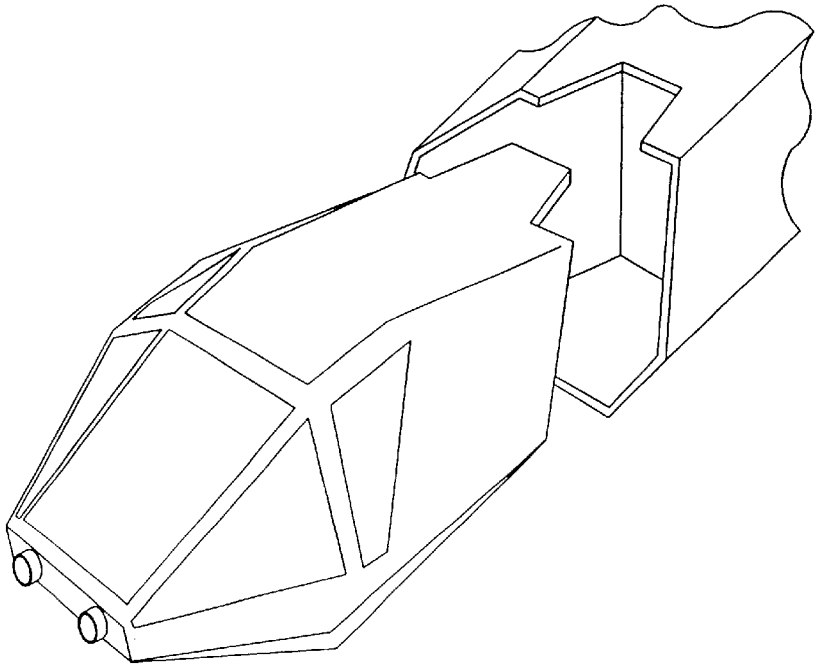

FIGS. 12A–B illustrate a toy swing wing fighter jet 1200A assembled from a variety of modules. Thus, as illustrated in FIG. 12B, a core module 1210B contains a variety of interfaces to allow the core module 1210B to be assembled with a variety of other modules. The core module 1210B has sockets 1214B for receiving ball joints. Thus, for example, a cockpit module 1216B may be tiltably coupled to the core module 1210B using a ball-socket interface. The core module 1210B also has slots 1220B for receiving stationary modules, such as a tail assembly 1206B and wing assemblies 1222B. The wing assemblies include pivots 1222B which permit wing portions 1204B to swing forward and backward. A engine module 1208B may be plugged into the rear of the core module 1210B. The core module 1210B may optionally include a rotating turbofan 1212B for use in simulating short takeoff, vertical landing operations. The modules may optionally include processors, sound synthesizers, speakers, sensors, and actuators as described above.

Figure 11A:
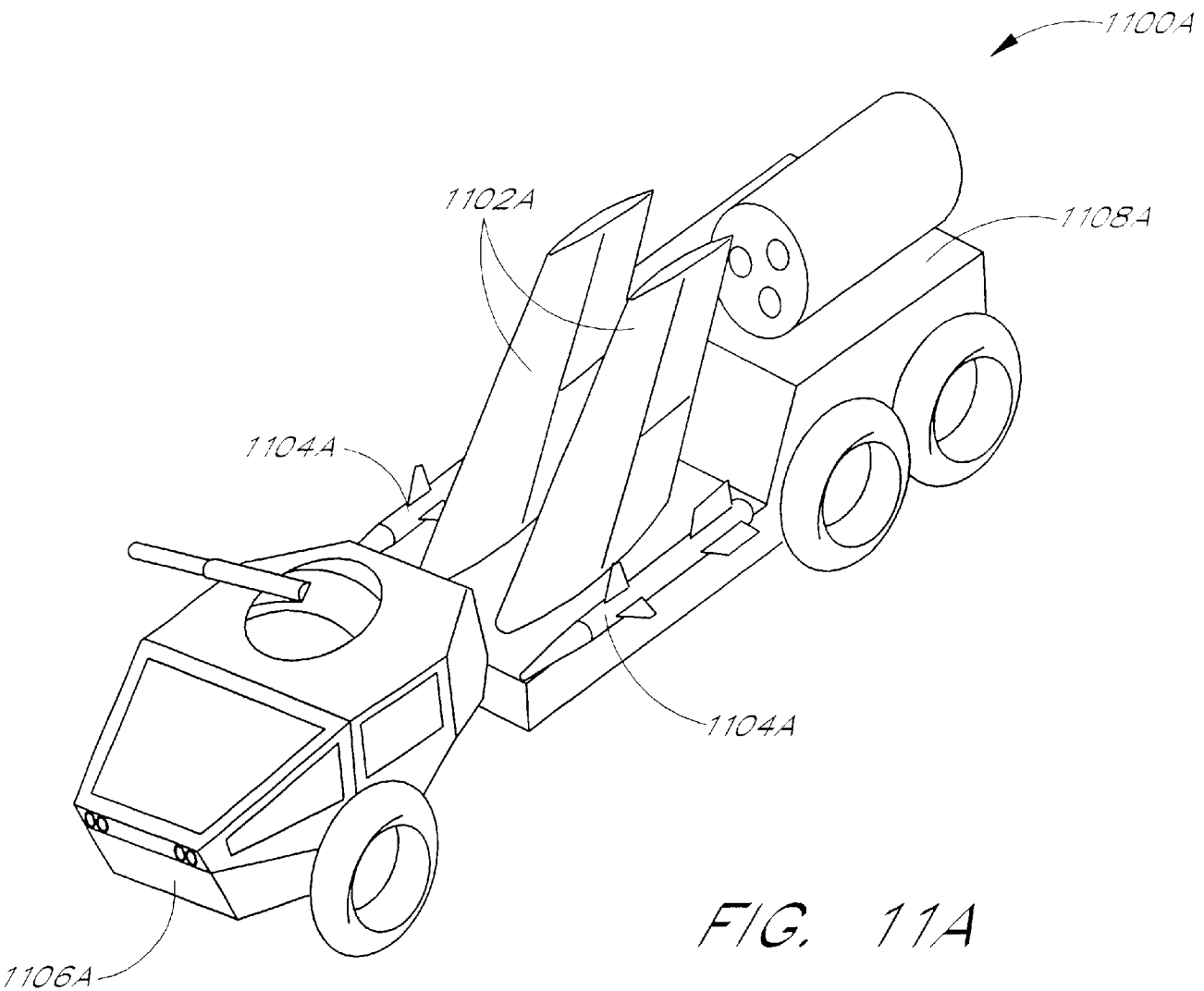
FIGS. 11A–17D illustrate several embodiments using modular components.
Figure 11B:
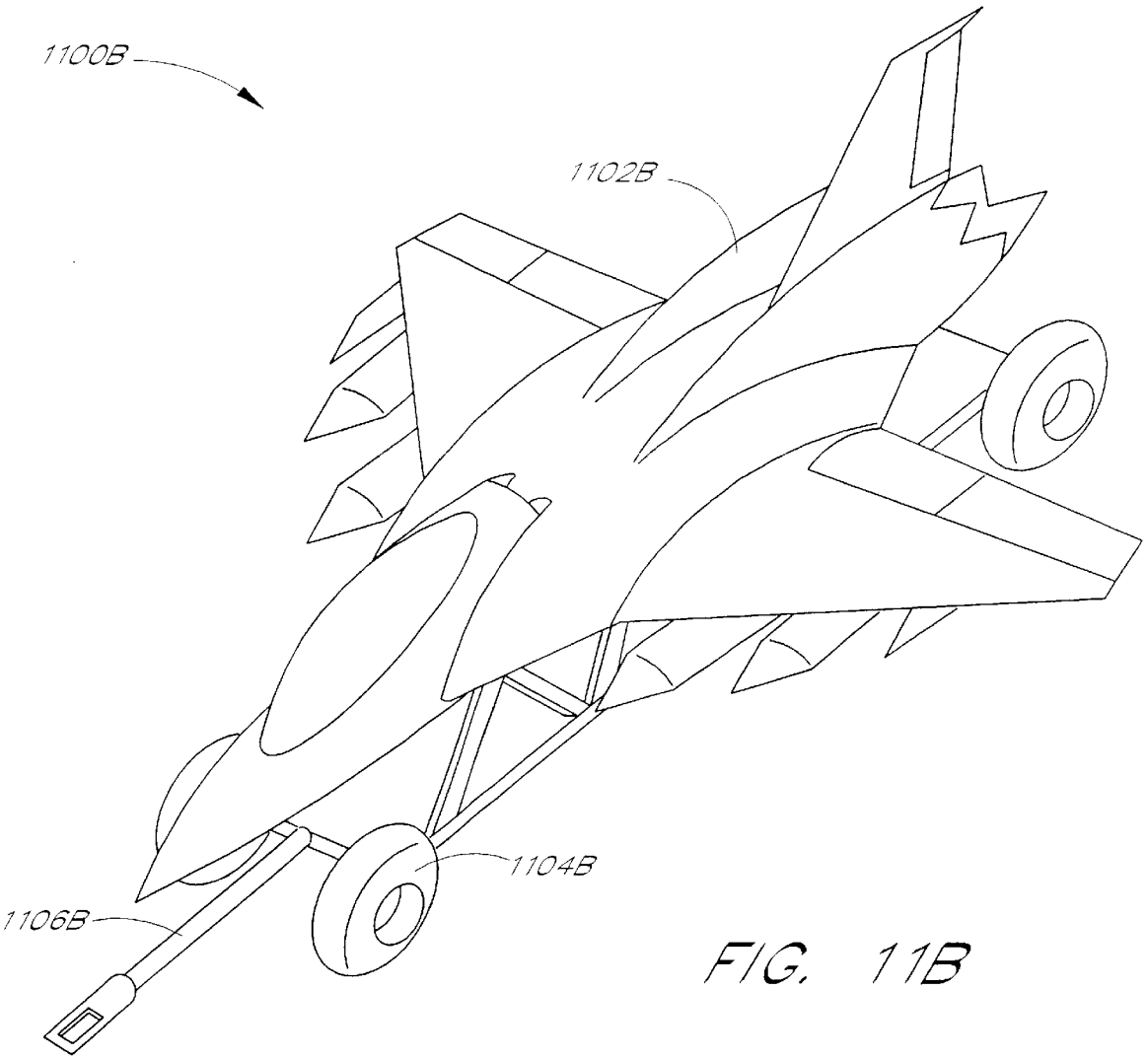
Figure 11C:
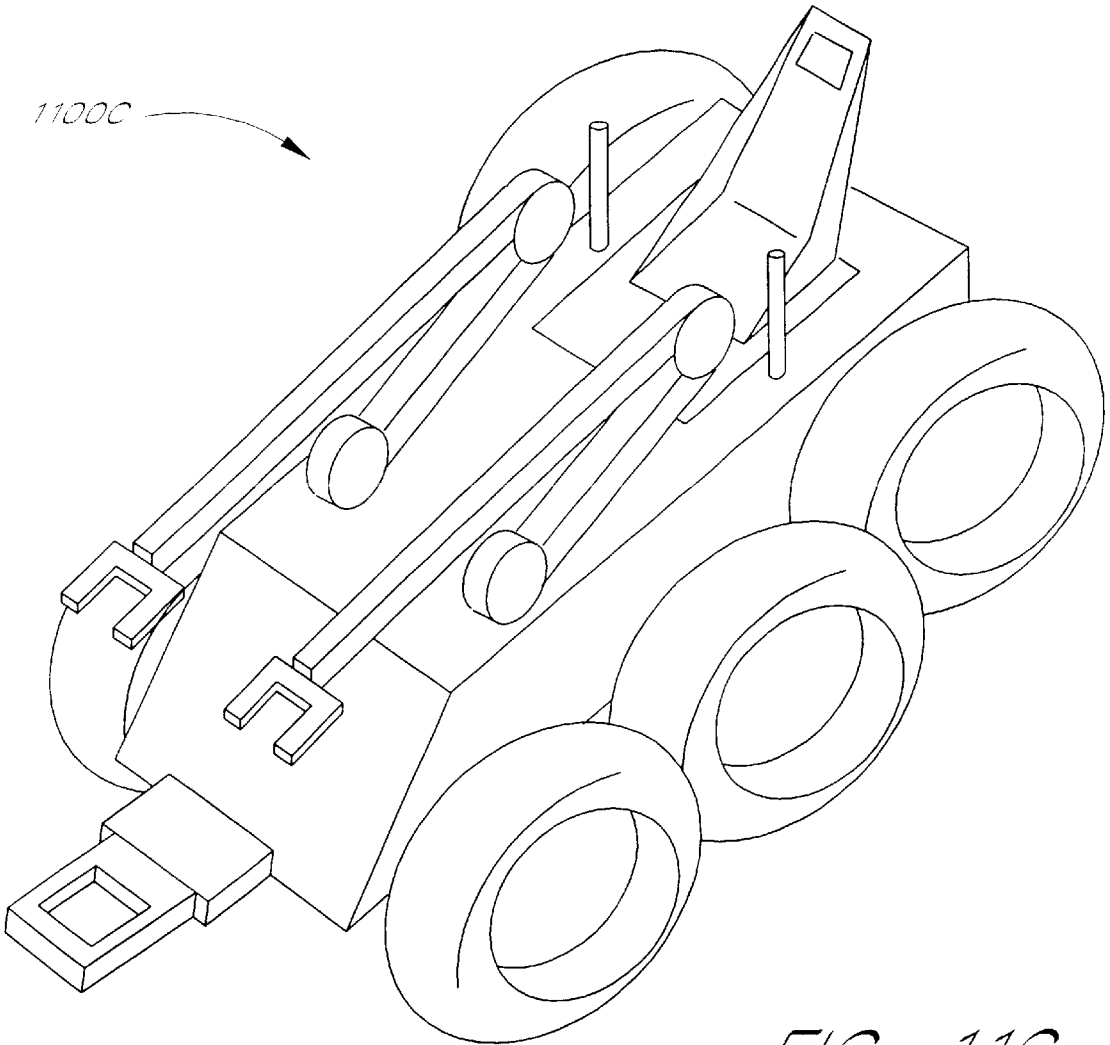

A child may advantageously build his own toy by selecting appropriate subassemblies, thus giving the child's imagination free reign. For example, as illustrated in FIGS. 11A–17D, one or more types of core modules may be turned into either a tank, a jet or a combination of the two by selecting the desired subassemblies. As illustrated, the subassemblies may include turrets, tank treads, wheels, wings, cockpits, jet engines, etc. Thus, FIG. 11A illustrates a transport vehicle 1100A which includes aircraft parts, such as wings 1102A and missiles 1104A, as well as ground vehicle parts, such as a armored truck cab 1106A and wheeled chassis 1108A. The illustrated vehicle 1110A may be intended as a transport vehicle for aircraft parts or as a hybrid vehicle. Similarly, FIG. 11B illustrates an aircraft body 1102B mounted on a wheeled chassis 1104B, for towing purposes. The wheeled chassis includes a towing assembly 1106B. In addition, a support vehicle toy 1100C may be provided for attaching and detaching peripheral modules to a core module.

Figure 16B:
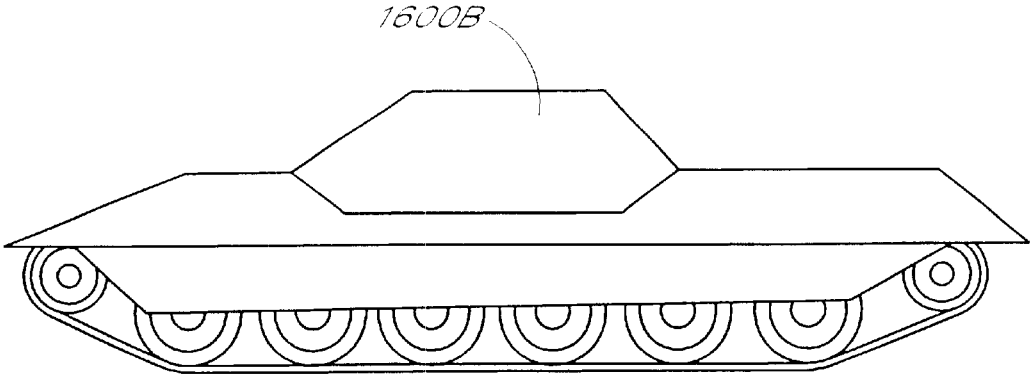
Figure 16C:
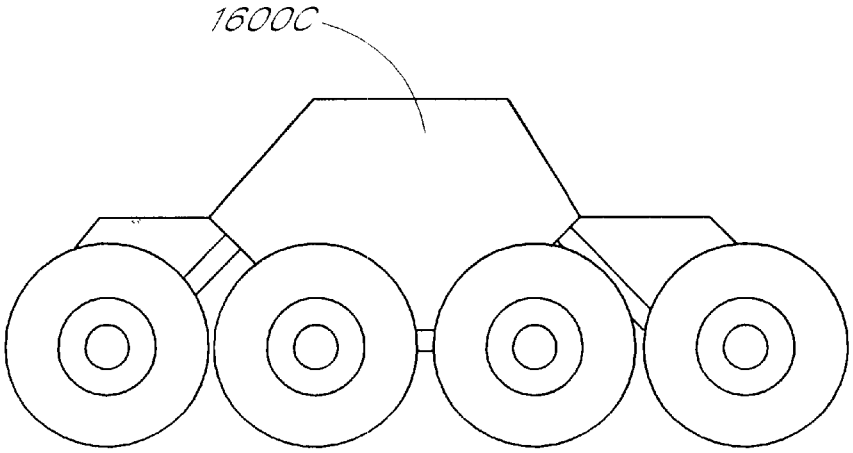

FIG. 16A illustrates how a core module 1602A may be combined with a variety of other modules to assemble different types of vehicles, such as the all-terrain vehicle illustrated in FIG. 16B and the tank illustrated in FIG. 16C. Thus, the core module 1602A may be combined with one or more of the following modules: an air propulsion engine and tail module 1604, a space propulsion engine and tail module 1606A, a ground propulsion engine and tail module 1612A, side pod modules 1610A, wing modules 1608A, a ramjet pod module 1618A, an air defense turret module 1614A, a multirole weapons pod module 1616A, an aerospace-type cockpit module 1626A, a ground vehicle cockpit module 1628A, turret modules 1620A, 1622A, 1624A, a tread module (not shown), and a wheeled chassis module (not shown).

Figure 17A:
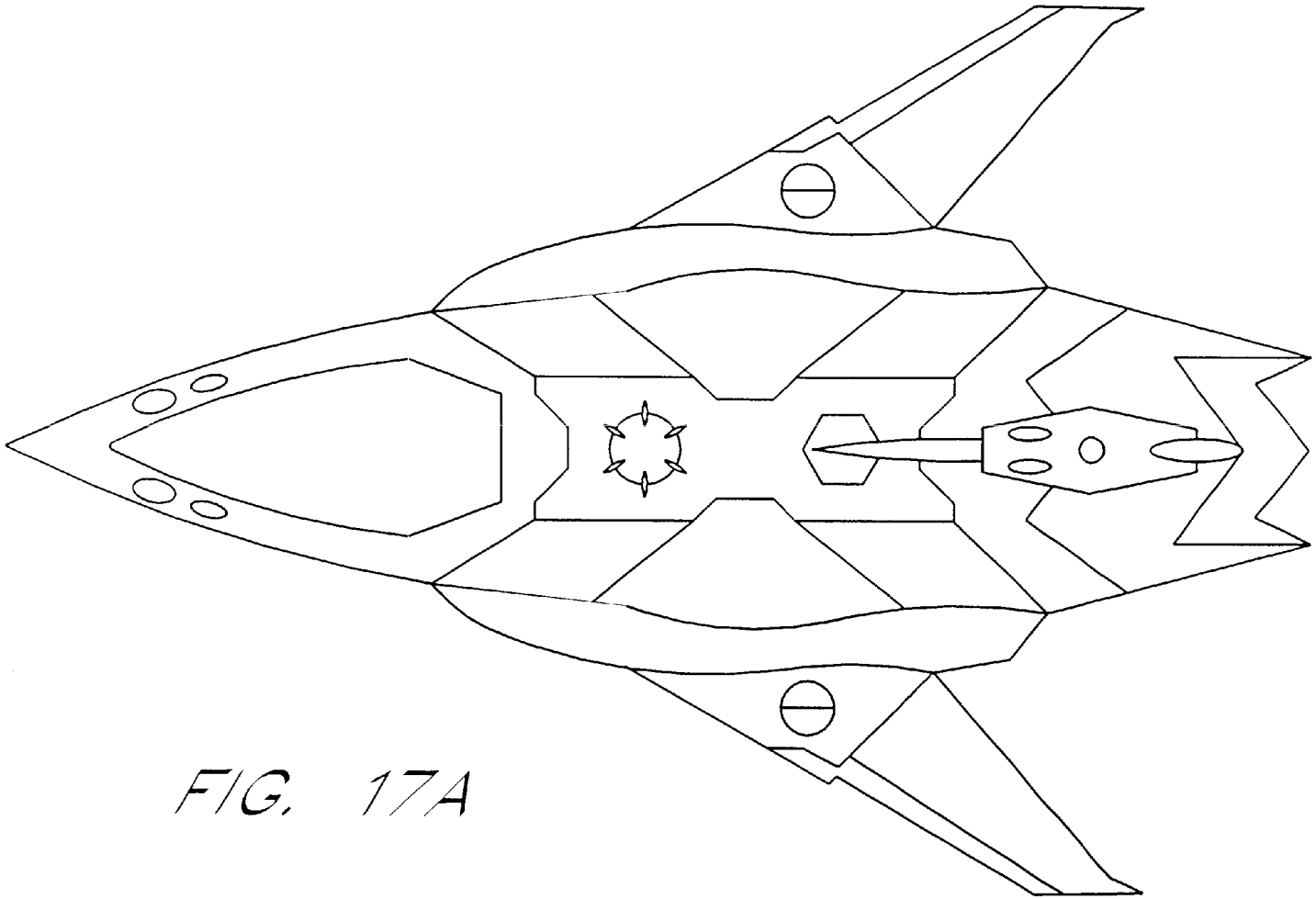
Figure 17B:
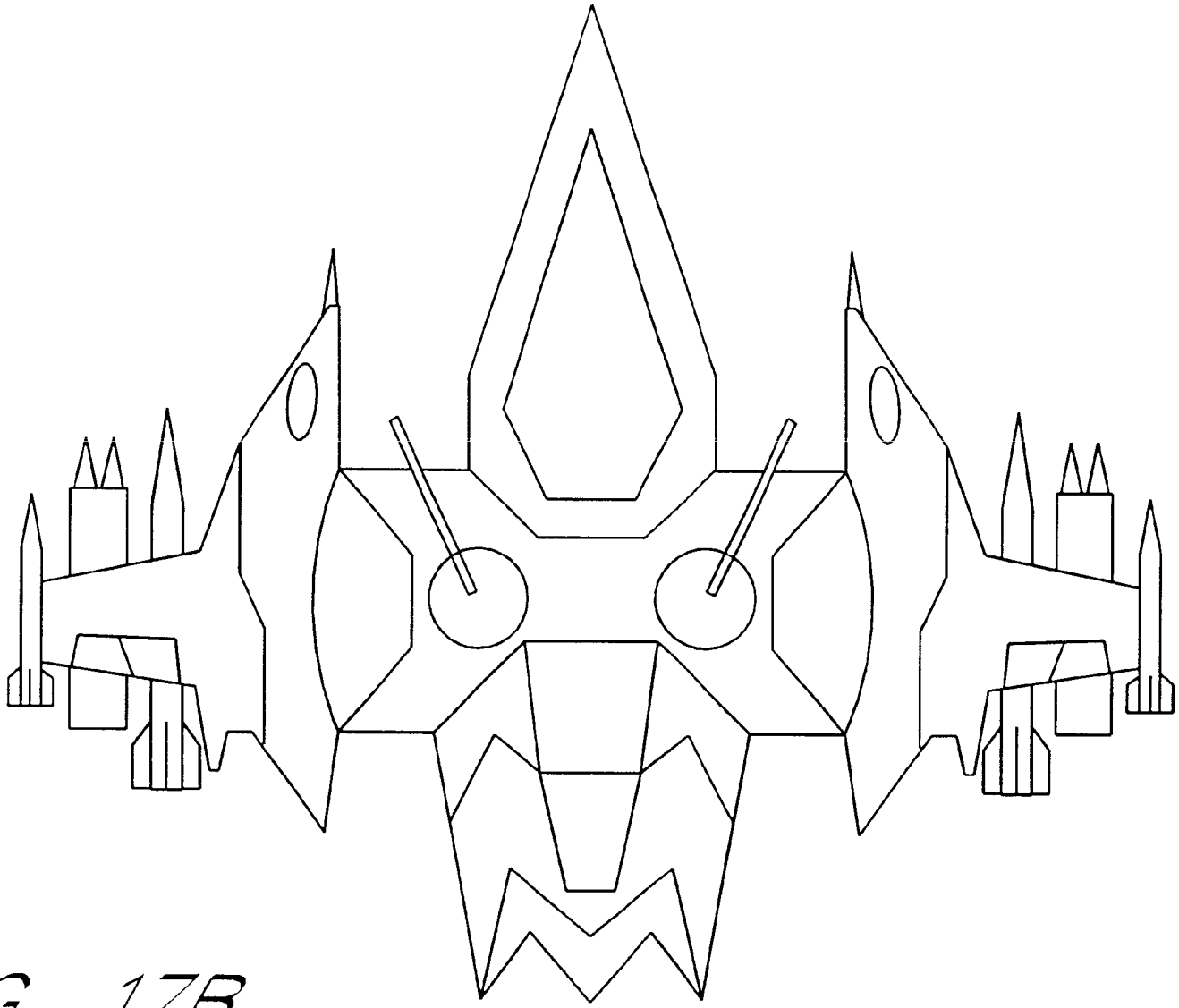
Figure 17C:
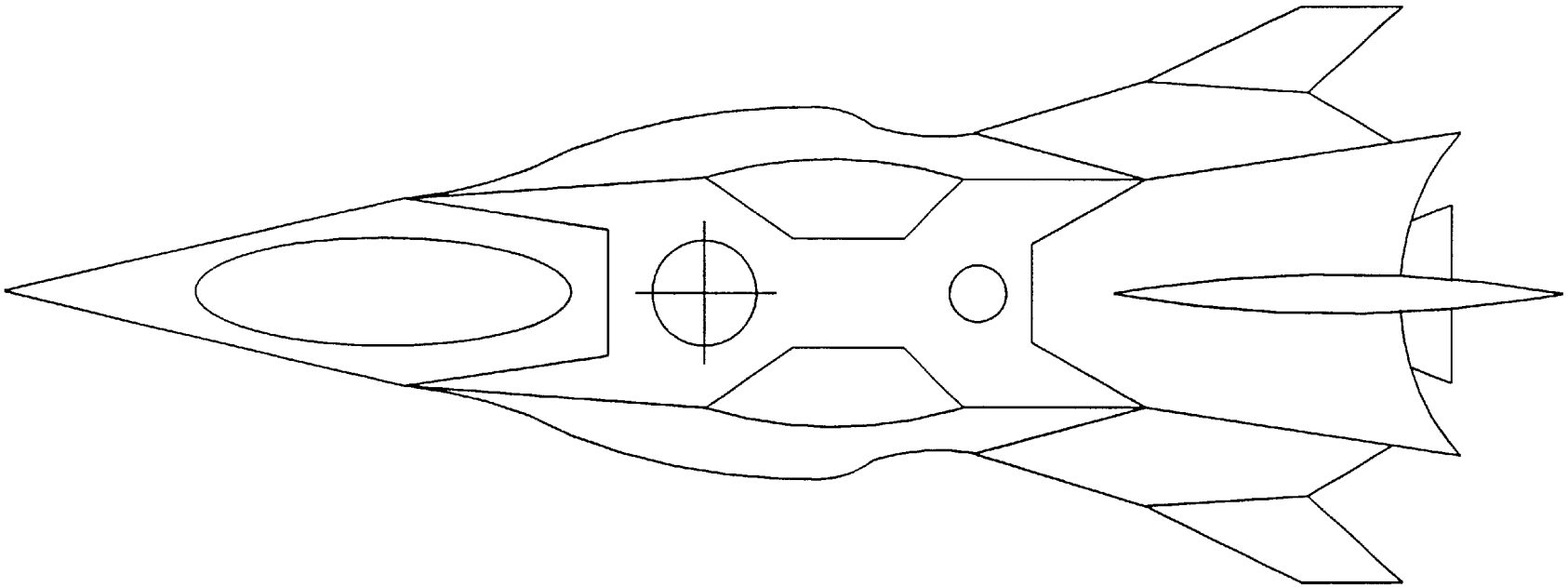
Figure 17D:
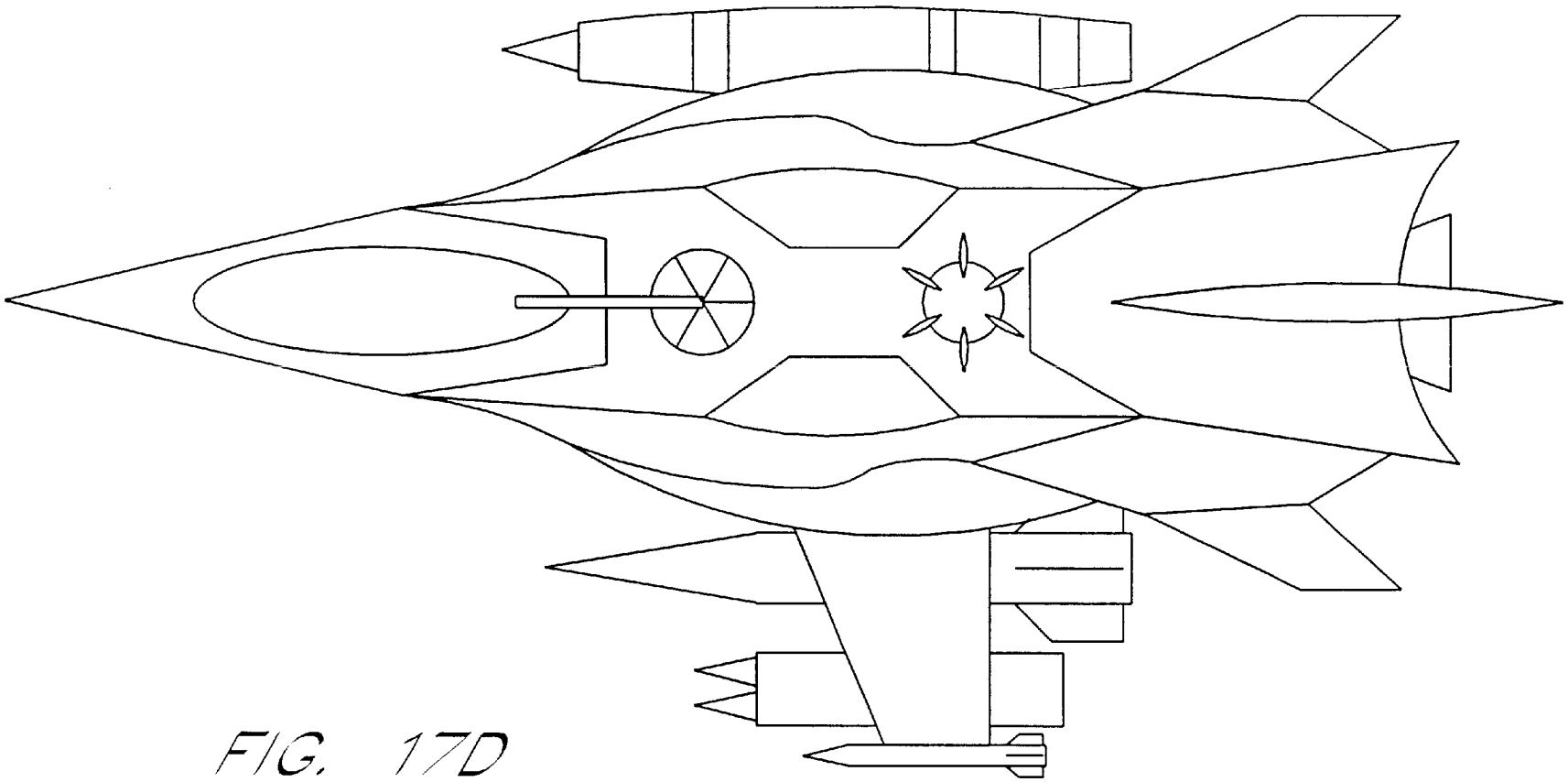

Reuse of the core modules, as illustrated in FIG. 16, allows the child to build an innumerable permutations of different toys, without having to pay for the control electronics over and over again. FIGS. 17A–C similarly illustrate a variety of flying vehicles built using the same core module with different subassemblies. In other embodiments, the toy system may be pre-assembled.

Figure 24:
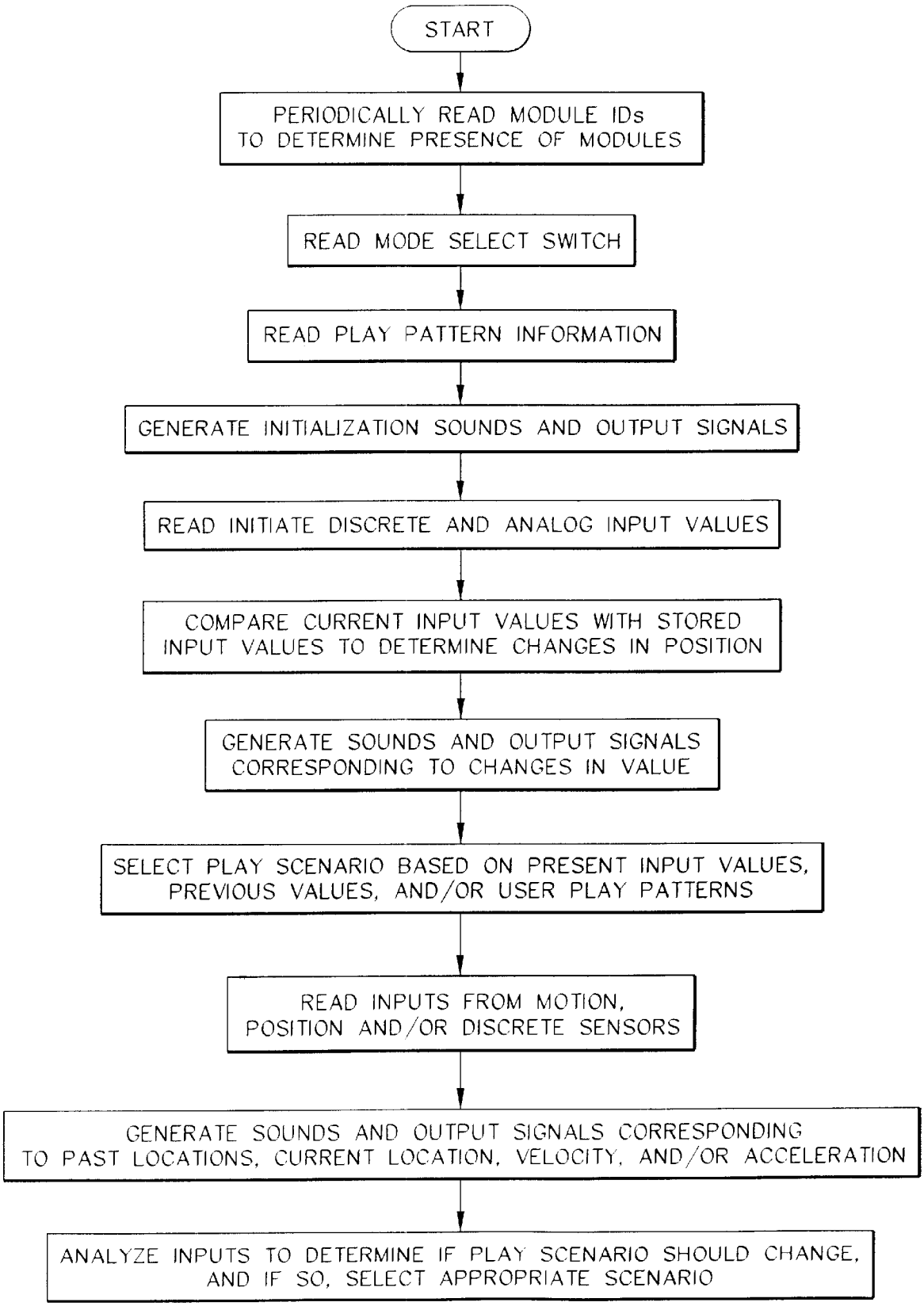
FIG. 24 illustrates a flowchart describing the operation of one embodiment of the present invention.

FIG. 24 illustrates a flowchart describing the operation of one embodiment of the present invention incorporating modules as described above. For the purposes of illustration, it is assumed that the toy is a jet, though the flowchart could equally apply to other toys, such as other vehicle-types, figures, buildings, and the like. Upon startup the processor reads the module identification codes to determine which modules are present. The processor next reads an optional mode select switch which permits the user to manually select the play scenario. The processor then reads the stored play pattern information to determine such things as how much fuel or ammunition remains from a previous play session. The processor next causes initialization sounds and signals to be generated. For example, engine idle sounds may be generated and landing lights may be caused to flash. The processor then reads various discrete and analog input signals to determine the relative positions of various toy portions. The present positions are then compared to stored values indicating the positions of the toy portions when the toy was last played with. Servo sounds may then be generated to give the audible impression that the toy portions are moving from their previous positions to the present positions. The processor then selects a play scenario based upon the present input values, previous input values, and/or user play patterns. The processor then continuously reads input values, including discrete sensors and sensors indicating motion, position, acceleration, temperature, and/or pressure. Corresponding sounds are then generated based upon the present input values, previous input values, present and past locations of toy components as well as the toy itself, velocity information, and/or acceleration information. In addition, the processor continuously monitors the above to determine if the play scenario should change.

Figure 6:
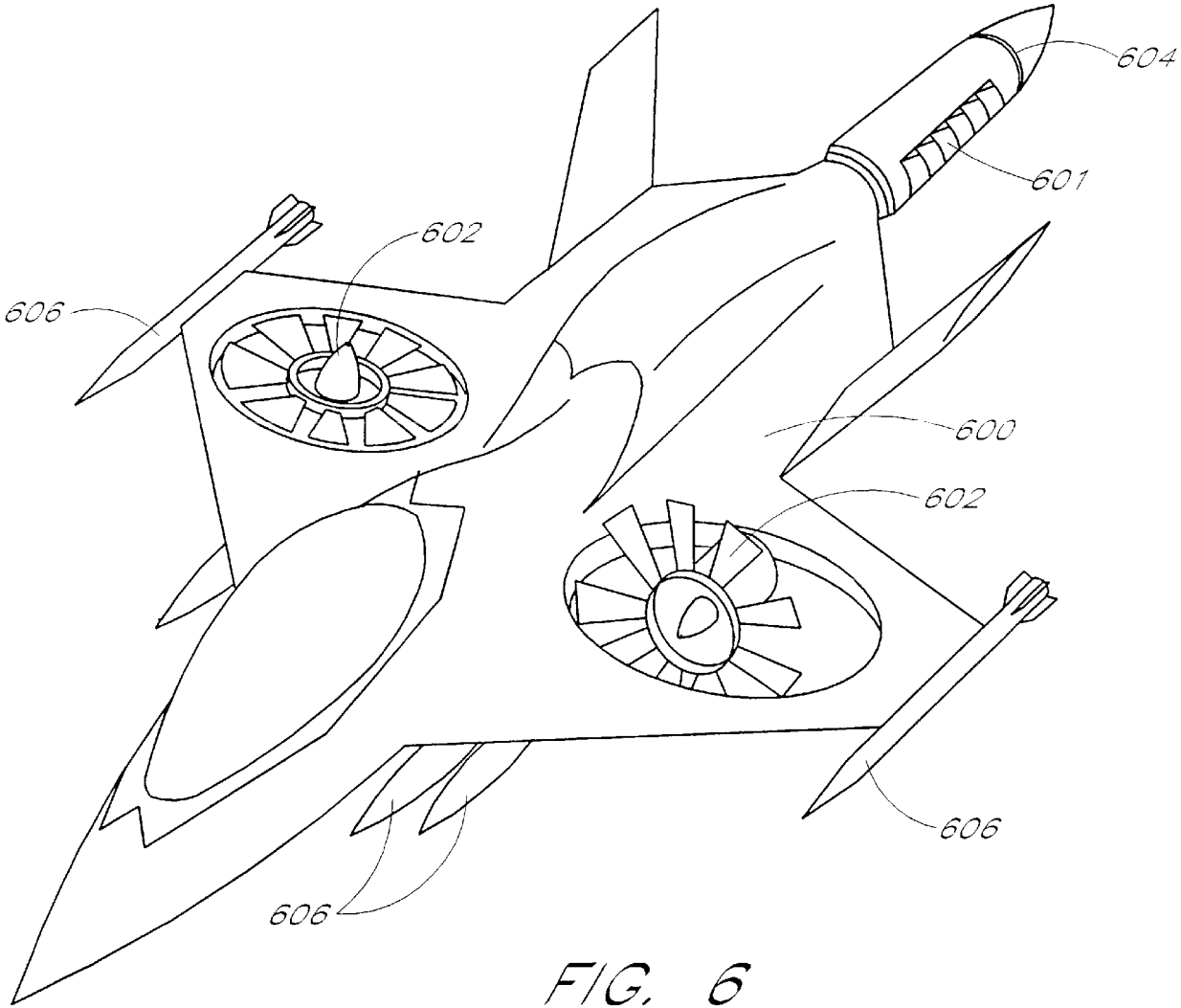
FIG. 6 illustrates one embodiment of a toy aircraft.

FIGS. 6, 7, 8, 9A–C, 10, and 11 illustrate other exemplary embodiments of the present invention. For example, FIG. 6 illustrates a plane 600 having tiltable unducted fan rotors 602. In one embodiment, a user may physically rotate the rotors 602 to face either upward or forward. Either a continuous sensor may be used to continuously sense the rotation of the rotor or four discrete sensors may be used to indicate if the rotors 602 are pointed up, down, forward or backward. Sound generation circuits in the plane 600 synthesize appropriate wind noise and engine noise in response to rotor rotation. The plane is also equipped with removable ordinance 606, including air-to-ground and air-to-air ordinance.

Figure 7:
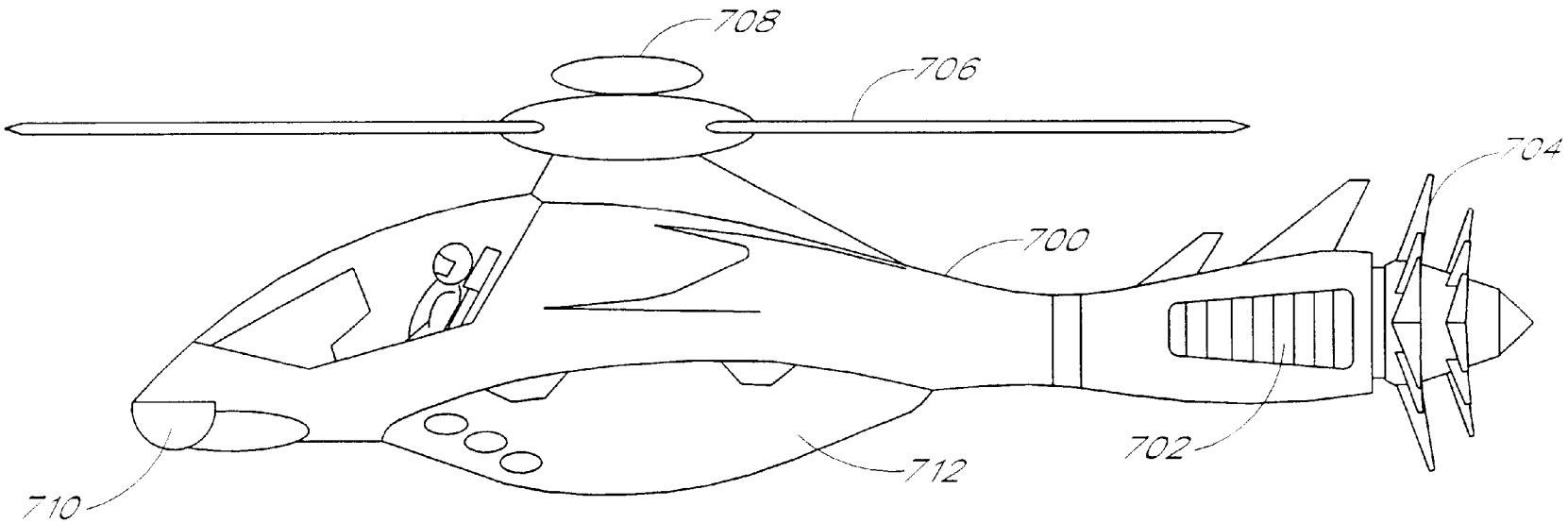
FIG. 7 illustrates one embodiment of a toy helicopter.

FIG. 7 illustrates a helicopter 700, equipped removable weapon pods 712, openable notar vents 702, a rotating turbo-prop 704, a rotatable rotor assembly 706, and targeting sensor pod 708, and a pointable navigational, forward looking infrared sensor 710. Sensors may be coupled to one or more of the movable or removable helicopter portions. Sounds may then be synthesized in response to sensed motion or changes in position as similarly described above. Each of the movable portions may be motorized under processor control.

Figure 8:
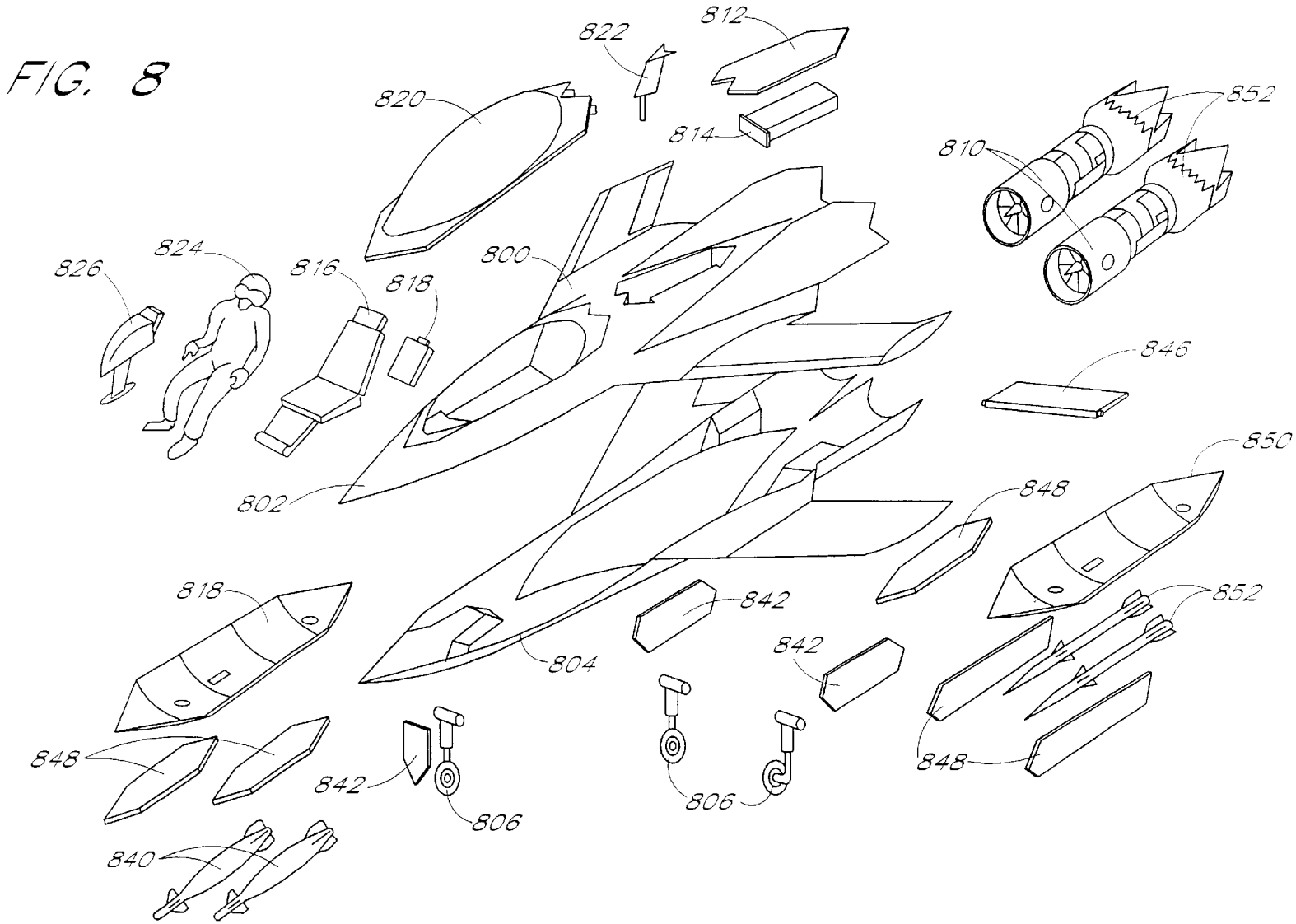
FIG. 8 illustrates a modular toy aircraft.

FIG. 8 illustrates a modular toy plane 800. The plane 800 consists of several modules, each of which may contain one or more sensors, motors, or other actuators. In the illustrated embodiment, the plane consists of an upper module 802 which may be assembled by a child or at the factory with a lower module 804. The lower module 804, includes retractable landing gear 842 and corresponding closeable landing gear covers 842. A variety of different weapons modules 828, 850 may be attached to the bottom of the lower module 804. The air-to-ground weapons module 828 includes toy bombs 840 which may be dropped through openable bay door 848s. Similarly, the 25 air-to-air weapons module 850 includes toy missiles 852 which may be dropped through openable bay doors 848. Removable engines 810 equipped with movable thrust vectoring nozzles may be inserted into the plane 800. The plane 800 may also be equipped with movable wing flaps 846, an ejectable seat 816 and survival pack 818, a cockpit control/display pod 826, a tilt-up canopy 820, a removable action figure 824, and removable electronics modules 814 with a hinged access cover 812. The movable portions of the plane may configured to move under both or either computerized motor control and in response to physical manipulation of the portions. Furthermore, the plane may be equipped with buttons disguised as plane assemblies which, when pressed, may cause bombs to drop, doors to open, or the ejection of the pilot. For example, a button may be disguised a an antenna 822. When a user pushes the antenna 822 bombs are dropped. Sensors may be coupled to one or more of the movable or removable portions. Sounds may then be synthesized in response to sensed motion or changes in position as similarly described above.

Figure 9A:
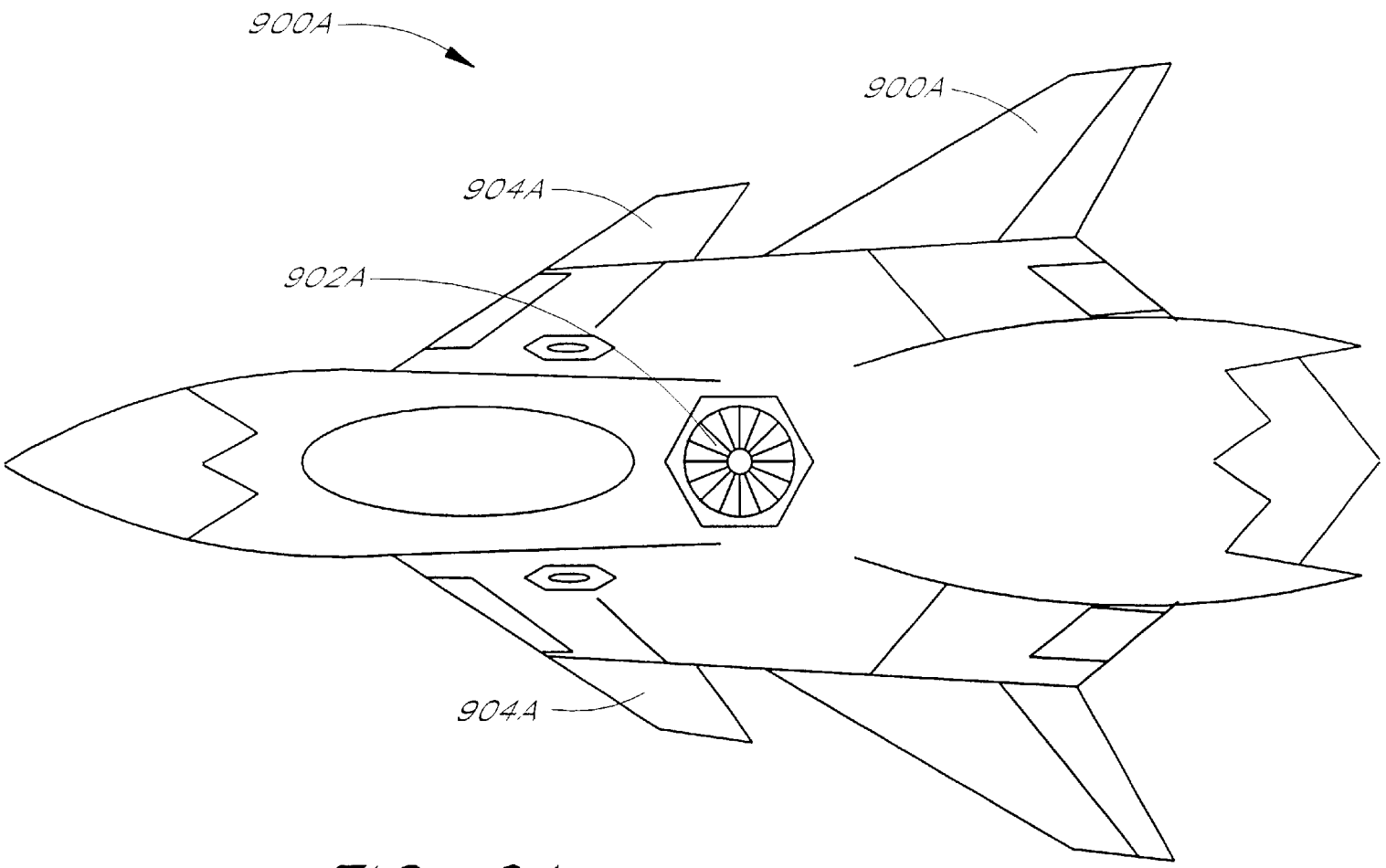
FIGS. 9A–9C illustrate multiple embodiments of toy flying vehicles.
Figure 9B:
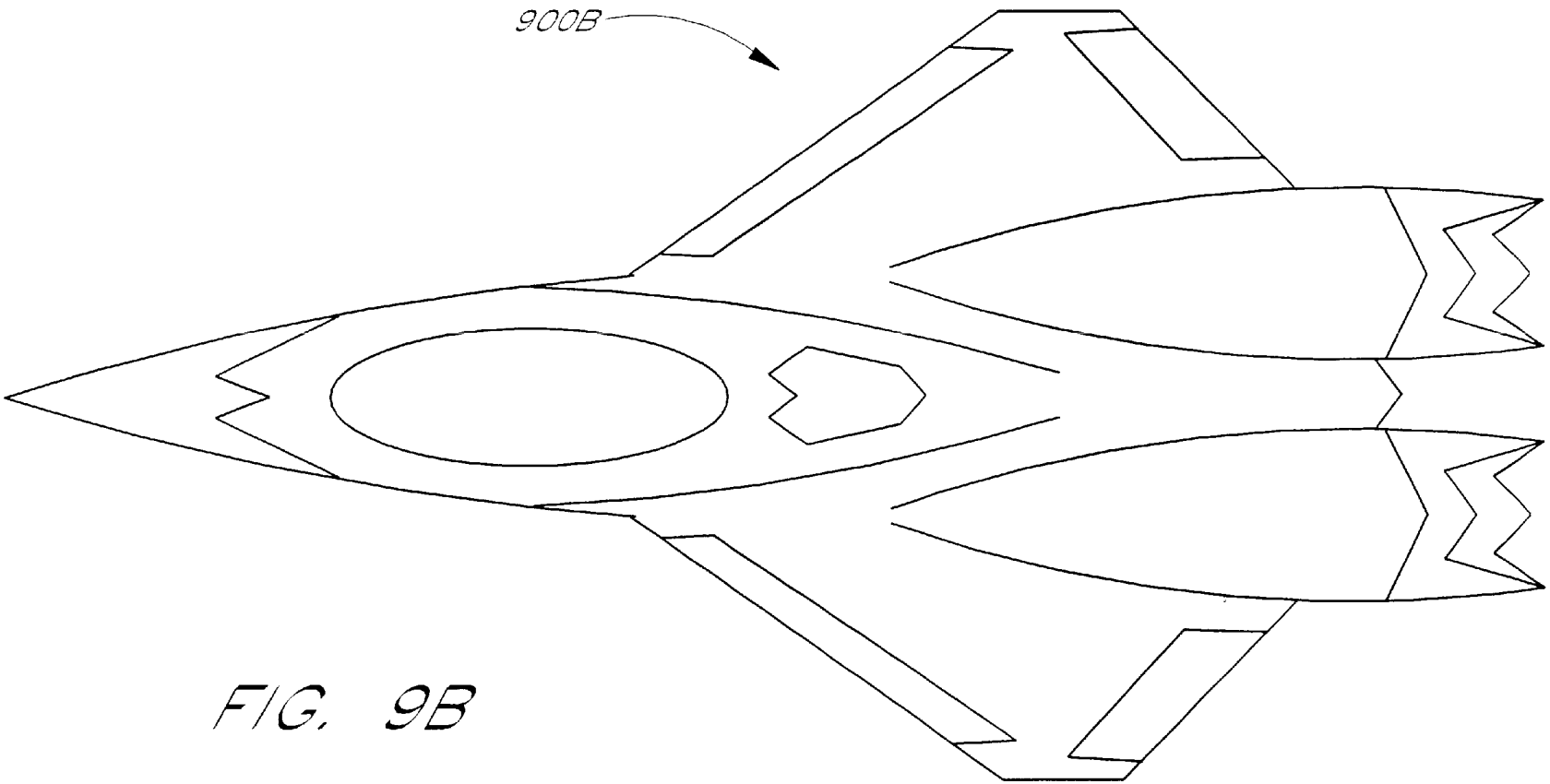
Figure 9C:
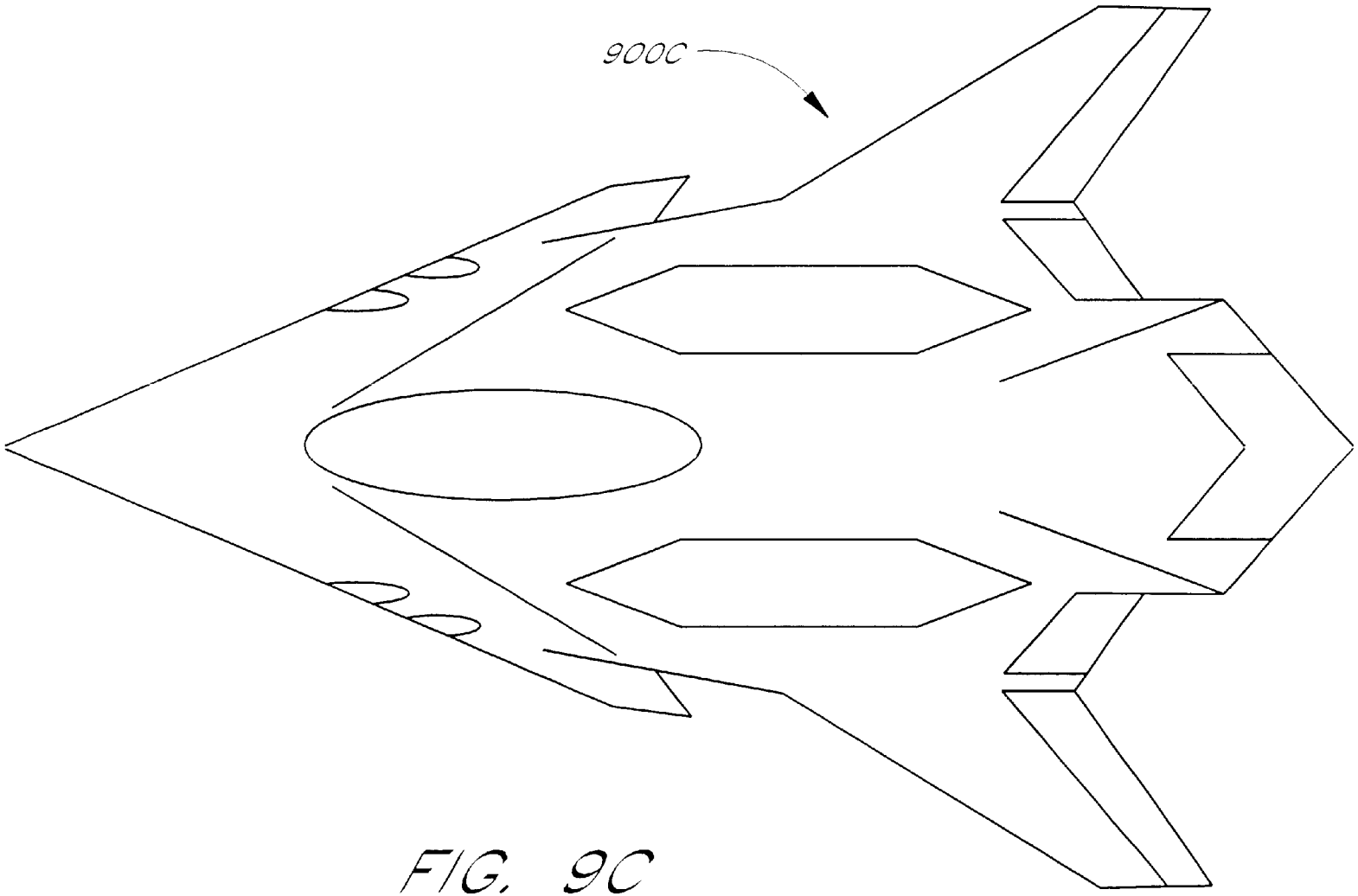

FIG. 9A illustrates a single engine plane 900A with canards 904A and a toy lift fan 902A, simulating a short take-off, vertical landing plane. FIG. 9B illustrates a diamond wing plane 900B, while FIG. 9C illustrates an arrowhead shaped plane 900C.

Figure 10:
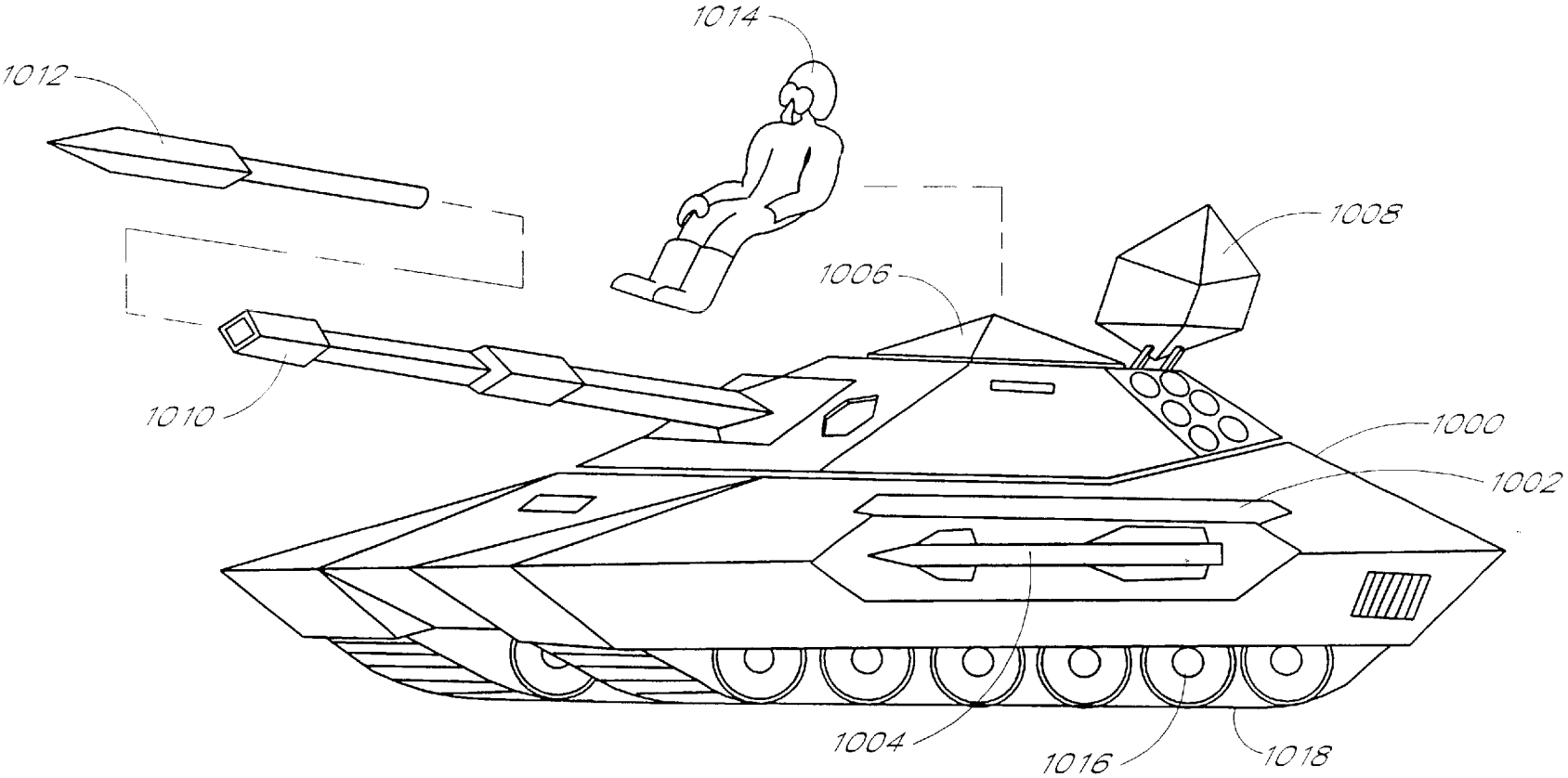
FIG. 10 illustrates a toy armored vehicle.

FIG. 10 illustrates a stealthy appearing battle tank 1000. The tank 1000 includes a missile bay with an openable hatch 1002 concealing ordinance 1004. Furthermore, the tank includes a rotatable turret 1006 with a cannon 1010 that can be moved in elevation. The cannon 1010 can actually fire a spring-loaded shell 1012. An openable hatch 1008 provides access to a tank cabin configured to receive an action figure 1014. The tank is also equipped with wheels 1016 and treads 1018. The tank 1000 can move backwards, forwards, and can turn. All movement of the tank as well as of movable portions of the tank may be accomplished by computer controlled actuators or by physical manipulation by the user. Further, sensors may be appropriately placed in the tank and on all moving portions. Information from these sensors may be used by a processor to generate appropriate sound, as described above.

While certain preferred embodiments of the invention have been described, these embodiments have been presented by way of example only, and are not intended to limit the scope of the present invention. Accordingly, the breadth and scope of the present invention should be defined only in accordance with the following claims and their equivalents.

What is claimed is:

1. A joint used to movably couple a first toy portion to a second toy portion, said joint comprising;

a housing coupleable to said first toy portion;

a ball rotatably positioned in said housing;

a first yoke rotatably positioned about said ball, said first yoke defining a first slot;

a second yoke rotatably positioned about said ball, said second yoke defining a second slot; and a shaft coupleable to said second toy portion extending from at least one side of said ball through said first slot and said second slot, wherein said first yoke and said second yoke rotate at least partially about said ball when said shaft is moved in a first direction.

2. The joint as defined in claim 1, further comprising a sensor coupled to at least said first yoke, wherein said sensor provides information related to the rotation of said first yoke.

3. The joint as defined in claim 2, further comprising a sensor coupled to at least said second yoke, wherein said sensor provides information related to the rotation of said second yoke.

4. The joint as defined in claim 1, further comprising a sensor coupled to said shaft, wherein said sensor provides information related to the rotation of said shaft around an axis parallel to said shaft.

* * * * *